US006710525B1

(12) United States Patent
Lee et al.

(10) Patent No.: US 6,710,525 B1
(45) Date of Patent: Mar. 23, 2004

(54) ELECTRODE STRUCTURE AND METHOD FOR FORMING ELECTRODE STRUCTURE FOR A FLAT PANEL DISPLAY

(75) Inventors: Jueng Gil Lee, Cupertino, CA (US); Christopher J. Spindt, Menlo Park, CA (US); Johan Knall, Sunnyvale, CA (US); Matthew A. Bonn, Saratoga, CA (US); Kishore K. Chakravorty, San Jose, CA (US)

(73) Assignees: Candescent Technologies Corporation, San Jose, CA (US); Candescent Intellectual Property Services, Inc., Los Gatos, CA (US)

( * ) Notice: Subject to any disclaimer, the term of this patent is extended or adjusted under 35 U.S.C. 154(b) by 0 days.

(21) Appl. No.: 09/421,781

(22) Filed: Oct. 19, 1999

(51) Int. Cl.[7] ..... H01J 1/02

(52) U.S. Cl. ..... 313/309; 313/495; 313/311; 313/306

(58) Field of Search ..... 313/495, 309, 313/310, 311, 336

(56) References Cited

U.S. PATENT DOCUMENTS

| | | | | | |
|---|---|---|---|---|---|
| 3,803,443 | A | | 4/1974 | Hant | 315/11 |
| 4,561,009 | A | | 12/1985 | Yonezawa | 357/67 |
| 4,697,123 | A | | 9/1987 | Shinoda et al. | 315/169.4 |
| 4,940,916 | A | | 7/1990 | Borel et al. | 313/306 |
| 5,090,932 | A | | 2/1992 | Dieumegard et al. | 445/24 |
| 5,191,217 | A | * | 3/1993 | Kane et al. | 250/423 F |
| 5,283,500 | A | | 2/1994 | Kochanski | 315/58 |
| 5,319,279 | A | * | 6/1994 | Watanabe et al. | 193/41 |
| 5,509,839 | A | | 4/1996 | Liu | 445/24 |
| 5,594,297 | A | * | 1/1997 | Shen et al. | 313/309 |
| 5,601,466 | A | | 2/1997 | Shen et al. | 445/24 |
| 5,821,622 | A | | 10/1998 | Tsuji et al. | 257/763 |
| 5,866,979 | A | | 2/1999 | Cathey, Jr. et al. | 313/496 |
| 5,894,188 | A | * | 4/1999 | Chakvorty et al. | 313/309 |
| 6,019,657 | A | | 2/2000 | Chakvorty et al. | 445/24 |
| 6,064,149 | A | * | 5/2000 | Raina | 313/309 |
| 6,106,352 | A | | 8/2000 | Fujii | 445/24 |
| 6,163,110 | A | * | 12/2000 | Arai | 313/503 |
| 6,180,030 | B1 | * | 1/2001 | Hirai et al. | 252/512 |
| 6,265,822 | B1 | * | 7/2001 | Kuroda et al. | 313/495 |
| 6,313,572 | B1 | * | 11/2001 | Yamada | 313/306 |
| 6,320,138 | B1 | * | 11/2001 | Kamiya et al. | 174/250 |
| 6,326,725 | B1 | * | 12/2001 | Xia | 313/495 |

FOREIGN PATENT DOCUMENTS

| | | | |
|---|---|---|---|
| DE | 3720298 A1 | 12/1988 | H01L/27/01 |
| EP | 503638 A2 | 9/1992 | H01J/1/30 |
| EP | 542271 A2 | 5/1993 | H01L/29/784 |
| EP | 731507 A1 | 9/1996 | H01L/29/49 |
| EP | 855451 A1 | 7/1998 | C23C/14/14 |
| EP | 964423 A1 | 12/1999 | H01J/31/12 |
| WO | WO 93/21650 | 10/1993 | H01J/29/70 |
| WO | WO 98/43268 | 10/1998 | H01J/9/02 |
| WO | WO 98/49705 | 11/1998 | H01J/5/00 |

OTHER PUBLICATIONS

Patent Abstracts of Japan vol. 017, No. 518 (E–1434), Sep. 17, 1993 & JP 05 136411 A (Casio Comput Co Ltd), Jun. 1, 1993 abstract.

Patent Abstracts of Japan vol. 011, No. 003 (C–395), Jan. 7, 1987 & JP 61 183433 A (Matsushita Electric Ind Co Ltd), Aug. 16, 1986 abstract.

* cited by examiner

*Primary Examiner*—Nimeshkumar D. Patel
*Assistant Examiner*—Sikha Roy

(57) ABSTRACT

An electrode structure for a display that includes lower electrodes and upper electrodes. In one embodiment, lower and upper electrodes are formed of either an aluminum alloy or a silver alloy. In another embodiment, upper and lower electrodes are formed using a metal alloy layer over which a cladding layer is deposited. A silicon nitride passivation layer is used to protect the upper electrodes from damage in subsequent process steps. Various other materials and structures are also disclosed that protect the upper electrodes from damage in subsequent process steps.

4 Claims, 120 Drawing Sheets

ELECTRODE STRUCTURE AND METHOD FOR FORMING ELECTRODE STRUCTURE FOR A FLAT PANEL DISPLAY

FIELD OF THE INVENTION

The present claimed invention relates to the field of flat panel displays. More particularly, the present claimed invention relates to a method for forming an electrode structure for a flat panel display.

BACKGROUND ART

Display devices such as, for example, flat panel display devices typically utilize a cathode structure that is formed over a backplate. The cathode structure includes row electrodes and column electrodes that are used to activate regions of field emitters. The field emitters emit electrons that are directed towards respective pixel or sub-pixel regions on a faceplate. By selectively activating row electrodes and column electrodes, electrons are emitted that strike the respective pixel or sub-pixel regions on the faceplate. Typically, phosphors are coated on the inside of the faceplate. The electrons strike the phosphors, producing red, green or blue visible light that forms a visible display.

In prior art processing techniques, aluminum is commonly used for forming row electrodes and column electrodes. However, aluminum is subject to hillock formation. Hillock formation results in nonuniform planarization and can cause both row and column shorts to occur.

In one recent prior art process a layer of tantalum is deposited over the aluminum layer for reducing hillock formation. However, the resulting structure has a conductivity that is too low for use in large flat panel display devices. That is, though this process is sufficient for making small flat panel displays, the resulting row or column has too high a resistivity to be used in making large flat panel displays.

In prior art processes that use a layer of aluminum that is overlain by a layer of tantalum, the layer of aluminum is first deposited by placing the backplate into a sputtering chamber. Once the aluminum layer deposition is complete, the backplate is removed from the sputtering chamber. The layer of aluminum is then masked. More particularly, photoresist is deposited over the backplate, and the photoresist is exposed. The layer of aluminum is then etched using a wet etch process to form the desired aluminum structure.

The backplate is then placed into a second sputtering chamber that deposits the tantalum layer. Once the deposition of the tantalum layer is complete, the backplate is removed from the second sputtering chamber. The layer of tantalum is then masked. More particularly, photoresist is deposited over the backplate, and the photoresist is exposed. The tantalum layer is then etched. Because wet etch processes are not effective for etching tantalum, prior art processes must use a dry etch process. In one recent prior art process a reactive ion etch is used for etching the tantalum layer.

The use of two separate sputtering deposition steps is expensive and time consuming. Also, the use of two separate masking process steps is expensive and time consuming. These factors result in a low manufacturing yield and throughput. In addition, the steepness of the row electrodes and column electrodes of prior art processes results in manufacturing defects related to cracking of the overlying tantalum layer.

The dry etch process is complex. Also, the use of a dry etch process is expensive as it requires the use of expensive capital equipment (e.g. reactive ion etcher). Moreover, the dry etch process is corrosive to aluminum and can result in corrosion of the aluminum layer when pinholes are present in the tantalum layer. In addition, the dry etch process forms polymers within the tantalum layer. Thus, following the dry etch, a polymer strip process is required for removing the polymers. The polymer strip process is expensive. In addition, the corrosive dry etch process can result in pinholes in the glass backplate.

During subsequent conventional process steps, the column electrode is subjected to potential damage. More particularly damage often results from, ion bombardment, cavity etch, cone deposition, dielectric deposition, masking and etching of the dielectric layer, deposition and etch of a molybdenum layer, deposition and etch of a chromium layer, polyimide deposition, etc. These process steps lead to shorts and opens that result in reduced yield and device failure.

Another problem that occurs in prior art devices is column to focus waffle shorts. These column to focus waffle shorts lead to reduced yield and device failure. In addition, the electrodes used in prior art column electrodes can react with the frit seal in the frit seal region, leading to shorts between column electrodes.

Thus, a need exists for an electrode structure and a method for forming an electrode structure that does not result in hillock formation. Still another need exists for an electrode structure and a method for forming an electrode structure that meets the above-listed needs but which does not produce undesired electrical shorts or opens in the cathode structure. Still another need exists for an electrode structure and a method for forming an electrode structure that meets the above-listed needs and that is inexpensive to manufacture and that does not result in reduced yield.

SUMMARY OF INVENTION

The present invention provides an electrode structure and a method for forming an electrode structure that does not result in hillock formation. Also, the present invention provides an electrode structure and a method for forming an electrode structure that meets the above-listed need but which does not produce undesired electrical shorts or opens in the cathode structure. Also, the present invention provides an electrode structure and a method for forming an electrode structure that meets the above-listed needs and that is inexpensive and that increases yield and throughput.

In one embodiment of the present invention, an electrode structure for a flat panel display is shown that includes lower electrodes and upper electrodes. In the present embodiment, the lower electrodes are row electrodes and the upper electrodes are column electrodes. The lower electrodes and the upper electrodes are separated by a resistive layer and a dielectric layer. In one embodiment, both the upper electrodes and the lower electrodes are formed of a metal alloy. In one embodiment, the metal alloy is an aluminum alloy. Alternatively, a silver alloy is used.

A method for forming an electrode structure of a flat panel display is disclosed. First, a metal alloy layer is deposited over a backplate. A cladding layer is then deposited over the metal alloy layer. A wet etch step is then performed so as to form a layer of electrodes. By performing the deposition of the metal alloy layer and the cladding layer in the same sputtering tool sequentially, cost savings, increased yield and throughput result as compared to prior art processes that require two separate trips to a sputtering tool. Moreover, because a single masking step and a single wet etch is required, significant cost savings, increased yield and throughput result as compared to prior art processes that require two separate masking steps and etch steps.

The present invention does not use a dry etch process. Thus, significant cost savings are realized because there is no need for complex and expensive capital equipment for performing the dry etch process. In addition, because the present invention does not use a dry etch process, there is no corrosion of an underlying aluminum layer and no damage (e.g. pinholes) to the glass backplate. Moreover, because the present invention does not use a dry etch process, there is no need to perform a polymer strip process. This results in further time and cost savings as compared to prior art processes and increased throughput and yield.

In one embodiment, a passivation layer is deposited over the upper electrode. In the present embodiment, the passivation layer is silicon nitride. The silicon nitride layer is then masked and etched. The resulting silicon nitride structure partially covers the upper electrodes. This protects the upper electrodes during subsequent process steps.

Gate metal is then deposited, masked and etched to form a gate structure. The passivation layer protects the upper electrodes during deposition, mask and etch steps. Conventional process steps are then used to complete the cathode structure. In one embodiment of the present conventional process steps are used to form emitters and to form a focusing structure. In the present embodiment, these process steps include ion bombardment, cavity etch, cone deposition, dielectric deposition, masking and etching of the dielectric layer, deposition and etch of molybdenum layer, deposition and etch of chromium layer, polyimide deposition, etc. During these process steps, the upper electrodes are protected by the passivation layer. Thus, damage to upper electrodes is prevented. By preventing damage to upper electrodes, column shorts and opens are reduced. Also, because there is less exposed metal alloy, column to focus waffle shorts are decreased.

The use of either an aluminum alloy or the use of a silver alloy provides good conductivity. The resulting conductivity is sufficient for fabrication of large flat panel displays. In addition, the present invention prevents hillock formation as occurs in prior art processes that use aluminum. Thus, electrical shorts and opens are prevented as compared with prior art processes that use aluminum and good planarity of overlying layers is obtained. This results in increased yield as compared with prior art processes that use aluminum.

Thus, the present invention provides an electrode structure and a method for forming an electrode structure that does not result in hillock formation. Also, the present invention provides an electrode structure and a method for forming an electrode structure that meets the above-listed need but which does not produce undesired electrical shorts or opens in the cathode structure. Also, the present invention provides an electrode structure and a method for forming an electrode structure that meets the above-listed needs, that is inexpensive and that increases yield and throughput.

These and other objects and advantages of the present invention will no doubt become obvious to those of ordinary skill in the art after having read the following detailed description of the preferred embodiments which are illustrated in the various drawing figures.

BRIEF DESCRIPTION OF THE DRAWINGS

The accompanying drawings, which are incorporated in and form a part of this specification, illustrates embodiments of the invention and, together with the description, serve to explain the principles of the invention:

FIG. 28K is a side sectional view of a display device showing the structure of FIG. 28I after an etch step has been performed in accordance with one embodiment of the present claimed invention.

FIG. 28L is a side sectional view of a display device showing the structure of FIG. 26J after an etch step has been performed in accordance with one embodiment of the present claimed invention.

The drawings referred to in this description should be understood as not being drawn to scale except if specifically noted.

DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Figure 1:
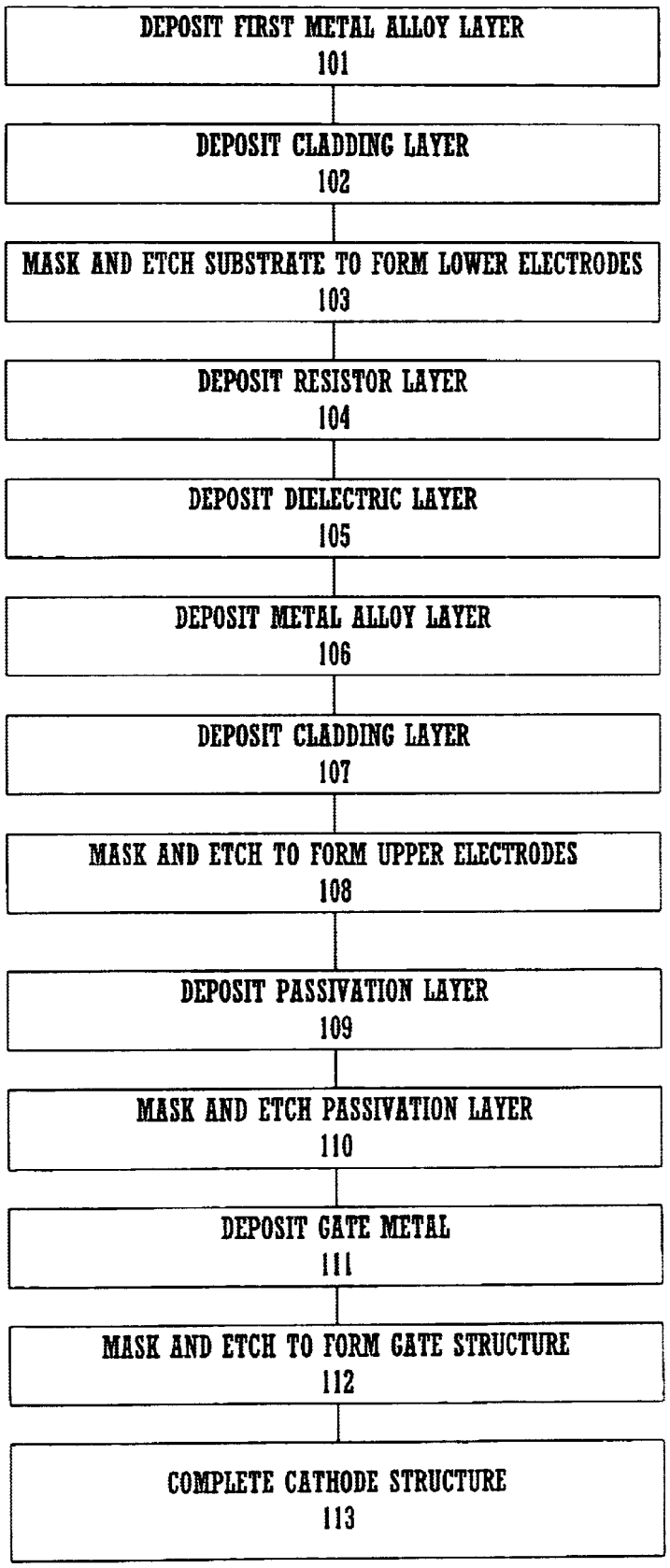
FIG. 1 is a diagram showing a method for forming an electrode structure of a display device in accordance with one embodiment of the present invention.
Figure 2:
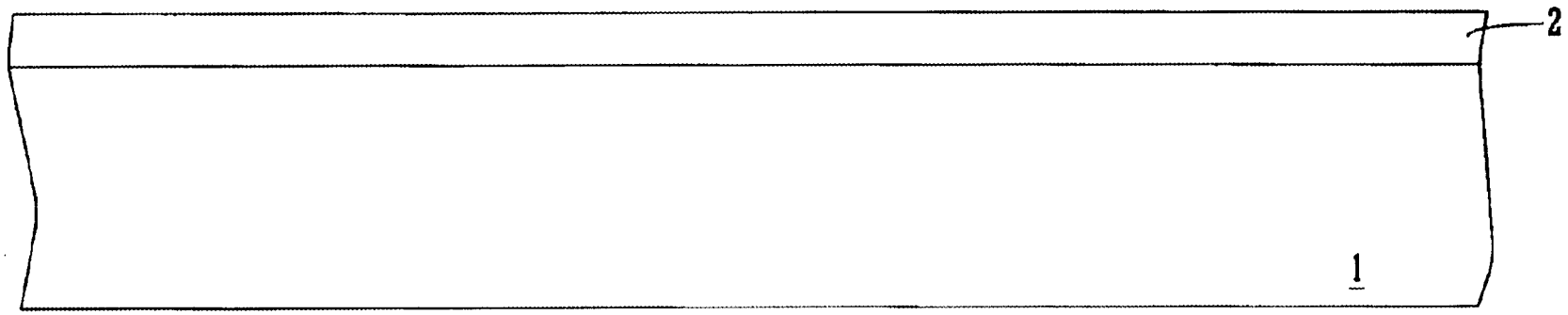
FIG. 2 is a side sectional view of a display device showing a backplate over which a metal alloy layer is deposited in accordance with one embodiment of the present invention.

With reference now to FIG. 1, a method for forming an electrode structure for a display device is shown. As shown by step 101, a metal alloy layer is deposited. FIG. 2 shows a metal alloy layer 2 deposited over glass plate 1.

In one embodiment, metal alloy layer 2 is an aluminum alloy. In one embodiment, metal alloy layer 2 has a thickness of 500–5000 Angstroms. In one specific embodiment, an aluminum alloy is used that includes aluminum (Al) and Neodymium (Nd). In the present embodiment, the aluminum alloy has an concentration of from 0.5 to 6 atomic percent Nd. In another-embodiment, an aluminum alloy is used that has a concentration of from 0.5 to 6 atomic percent Nd and from 0 to 5 atomic percent titanium (Ti).

Continuing with FIGS. 1–2, in an alternate embodiment, metal alloy layer 2 is a silver alloy. In one embodiment a silver alloy is used that includes silver (Ag) and 0.5 to 2 atomic percent palladium (Pd) and 0.5 to 2 atomic percent copper (Cu). In yet another embodiment, a silver alloy is used that includes 0.5 percent to 2 atomic percent palladium and 0.0 to 2.0 atomic percent titanium.

When a silver alloy is used, an adhesion layer can be used to promote adhesion to the glass plate. In one embodiment, a molybdenum adhesion layer is used that has a thickness of approximately 500–1000 angstroms.

Figure 3:
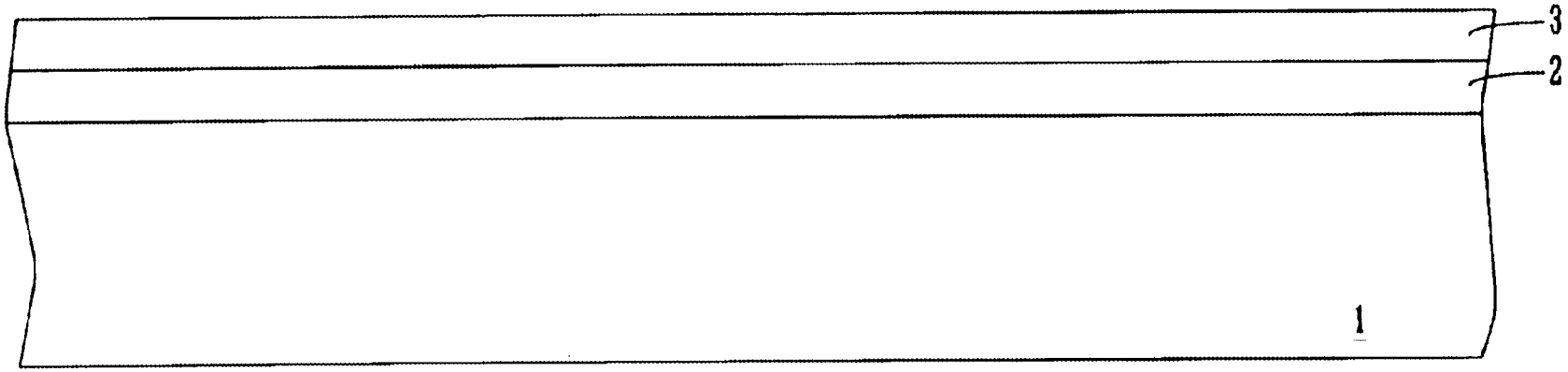
FIG. 3 is a side sectional view of a display device showing the deposition of a cladding layer in accordance with one embodiment of the present invention.

Referring to FIG. 1, as shown by step 102, a cladding layer is then deposited. FIG. 3 shows the structure of FIG. 2 after cladding layer 3 has been deposited. It can be seen that cladding layer 3 directly overlies metal alloy layer 2.

In one embodiment, cladding layer 3 of FIG. 3 is a molybdenum (Mo) tungsten (W) alloy. In the present embodiment, cladding layer 3 has a thickness of approximately 500–4000 angstroms. The use of cladding layer 3 produces a contact pad that is reliable and that maintains good electrical contact. In addition, the use of cladding layer 3 further reduces hillock formation.

Though the present invention includes the deposition of cladding layer 3, the present invention is well adapted for use without cladding layer 3. That is, the use of aluminum alloy or silver alloy provides sufficient reduction in hillock formation and results in good conductivity as compared with prior art processes.

In one embodiment, a diffusion barrier layer is used. The diffusion barrier layer can be formed of is titanium, titanium nitride or titanium tungsten that is deposited directly over the silver alloy. In one embodiment, a diffusion barrier layer is used that has a thickness of approximately 500–2000 Angstroms. The use of a diffusion barrier layer is particularly useful in an embodiment that does not include a cladding layer.

In one embodiment, the deposition of metal alloy layer 2 and cladding layer 3 is conducted using a single sputtering tool. That is, in the present invention, a sputtering process is used whereby metal alloy layer 2 and cladding layer 3 are sequentially deposited in a single sputtering tool. More particularly, in one embodiment, glass plate 1 is placed into a sputtering tool that includes a sputtering chamber that first deposits metal alloy layer 2 and then deposits cladding layer 3. The glass plate is then removed from the sputtering chamber. This provides significant cost savings over prior art methods that require two separate sputtering process steps and results in increased throughput and yield.

The use of either an aluminum alloy or the use of a silver alloy in conjunction with a cladding layer provides good conductivity. The resulting conductivity is sufficient for fabrication of large flat panel displays. In addition, the present invention prevents hillock formation as occurs in prior art processes that use aluminum. Thus, shorts are prevented as compared with prior art processes that use aluminum and planarity of overlying layers is obtained. This results in increased yield as compared with prior art processes that use aluminum.

Figure 4A:
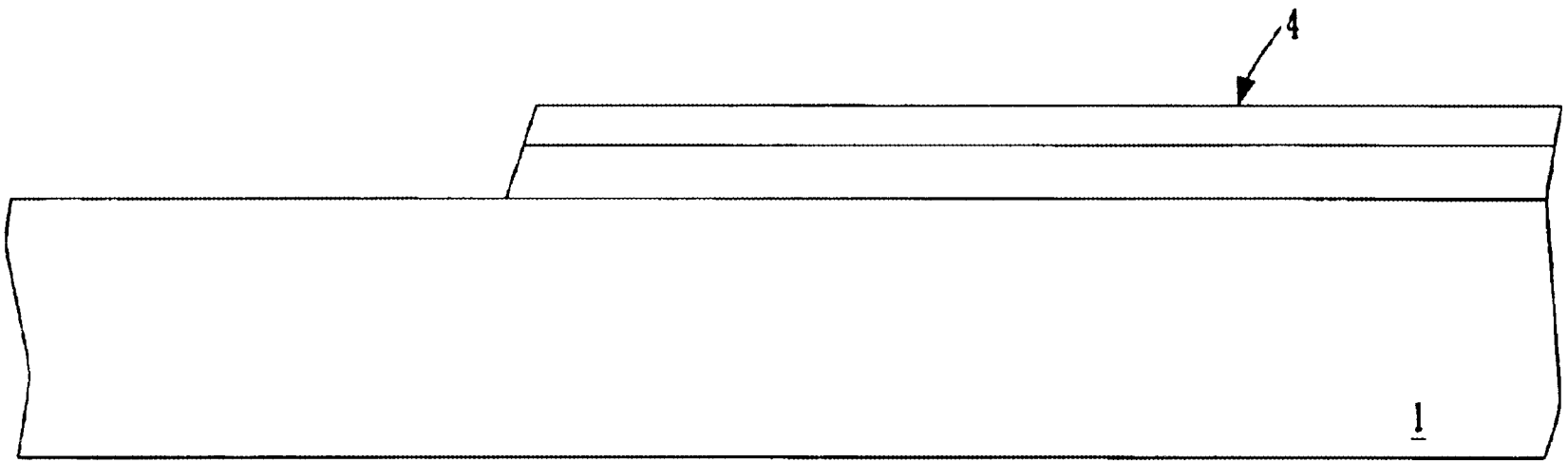
FIG. 4A is a side sectional view of a display device showing an expanded view of the structure of FIG. 3 after mask and etch steps have formed a lower electrode in accordance with one embodiment of the present claimed invention.
Figure 4B:
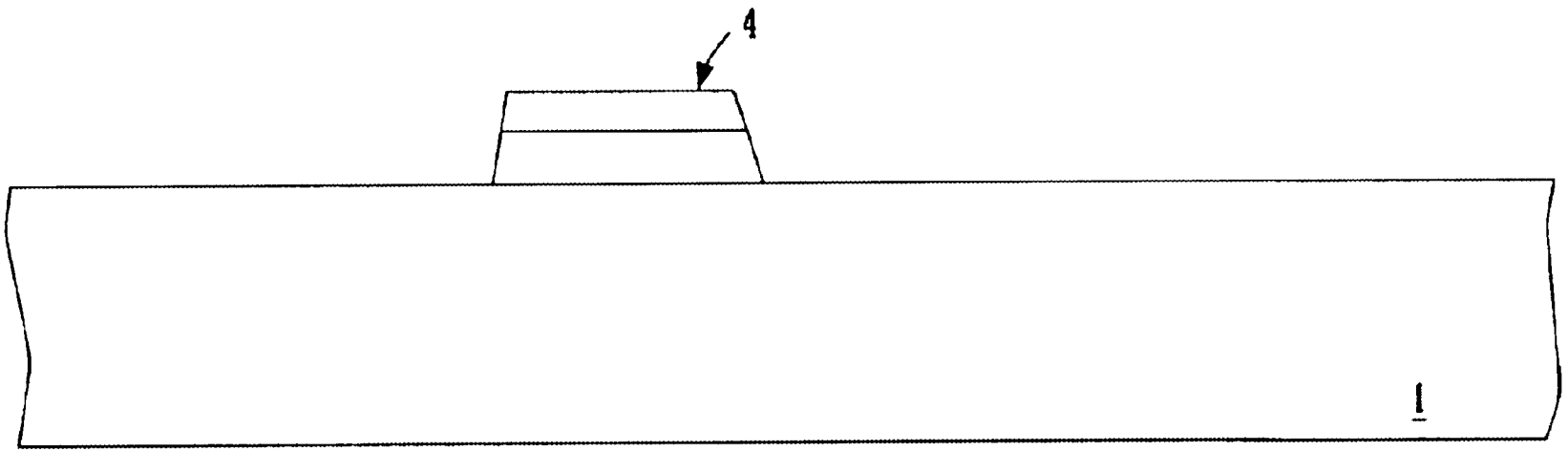
FIG. 4B is a side sectional view of a display device showing an expanded view of the structure of FIG. 3 after mask and etch steps have formed a lower electrode in accordance with one embodiment of the present claimed invention.

Referring back to FIG. 1, mask and etch steps are performed as shown by step 103. More particularly, in the present embodiment, photoresist is deposited over the backplate and is patterned. The backplate is then etched using a wet etch process to form the desired row electrodes. FIGS. 4A–4B show the structure of FIG. 3 after mask and etch steps have formed exemplary lower electrode 4.

The present invention requires a single patterning step and a single etch step in order to form row electrodes. Thus, the present invention does not require two separate patterning steps as are required in prior art processes. This results in significant cost savings as compared to prior art processes that require two separate patterning steps. In addition, because the present invention does not require two separate etch steps as are required in prior art processes that use a molybdenum cap, the present invention results in increased yield and throughput.

The present invention does not use a dry etch process for forming row electrodes. Thus, significant cost savings are realized because there is no need for complex and expensive capital equipment for performing the dry etch process. In addition, because the present invention does not use a dry etch process, there is no corrosion of an underlying aluminum layer and no damage (e.g. pinholes) to the glass backplate. Moreover, because the present invention does not use a dry etch process, there is no need to perform a polymer strip process. This results in further increases in throughput and yield as compared to prior art processes.

In one embodiment, the etching process forms angled edges. In the present embodiment, an etchant is used that includes nitric acid, phosphoric acid, ascetic acid and water. The use of this etchant performs a controlled lifting of the photoresist and results in angled edges on the sides of the lower electrode 4. The use of angled edges results in good conformity of overlying layers and reduces cracking in overlying layers.

Referring back to FIG. 1, a resistor layer is deposited as shown by step 104. In the embodiment shown in FIGS. 5A–5B, resistor layer 5 is shown to overlie lower electrode 4. In one embodiment, resistor layer 5 has a thickness of approximately 2000 angstroms. In the present embodiment, resistor layer 5 is silicon carbide (SiC)that is either deposited using a sputtering process or a chemical vapor deposition process.

Figure 5A:
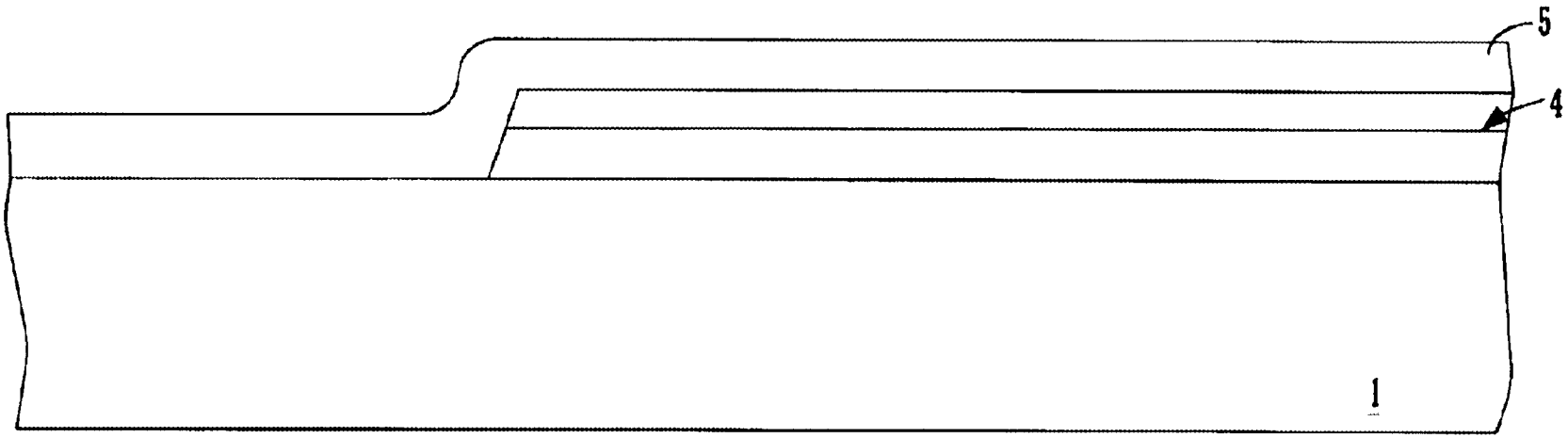
FIG. 5A is a side sectional view of a display device showing the structure of FIG. 4A after the deposition of a resistor layer in accordance with one embodiment of the present claimed invention.
Figure 5B:
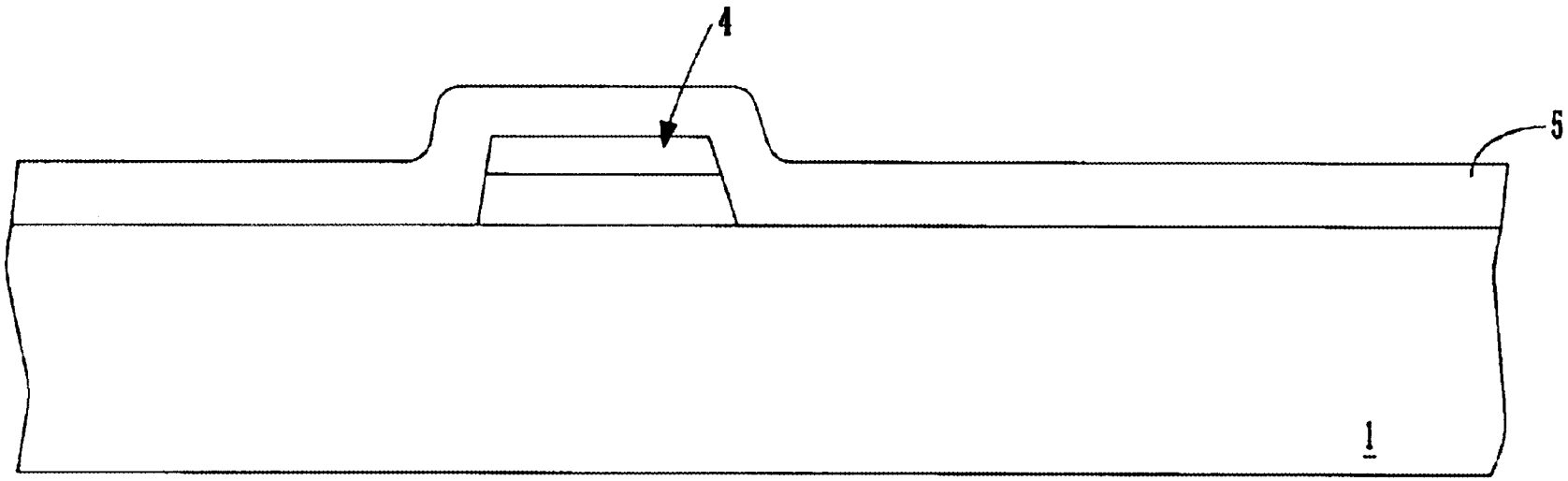
FIG. 5B is a side sectional view of a display device showing the structure of FIG. 4B after the deposition of a resistor layer in accordance with one embodiment of the present claimed invention.
Figure 6A:
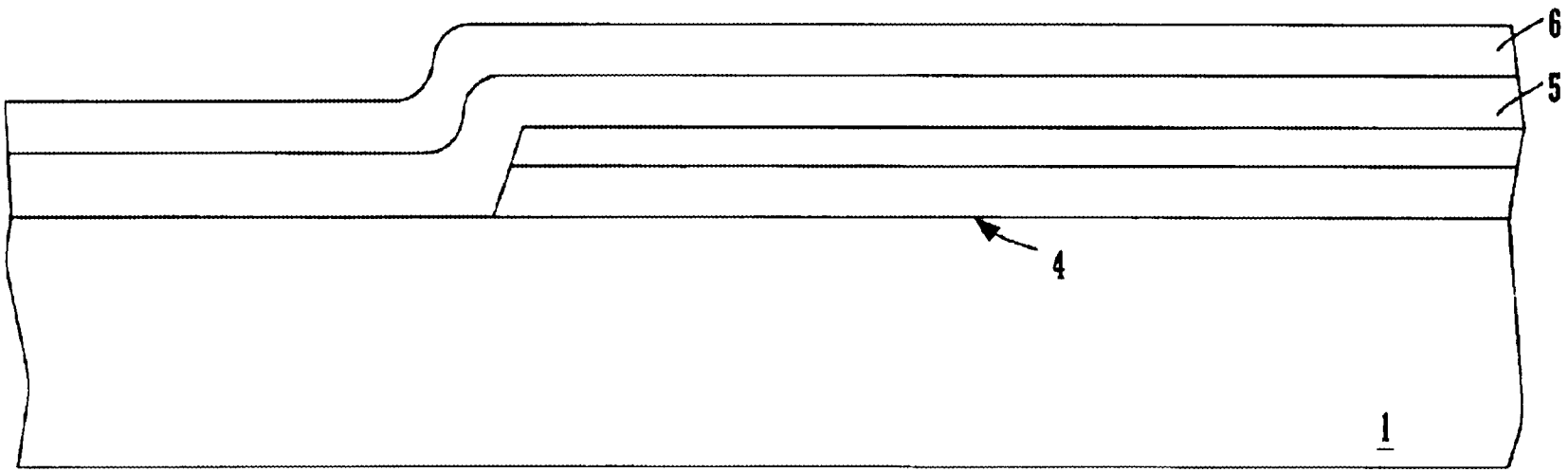
FIG. 6A is a side sectional view of a display device showing the structure of FIG. 5A after the deposition of a dielectric layer in accordance with one embodiment of the present claimed invention.
Figure 6B:
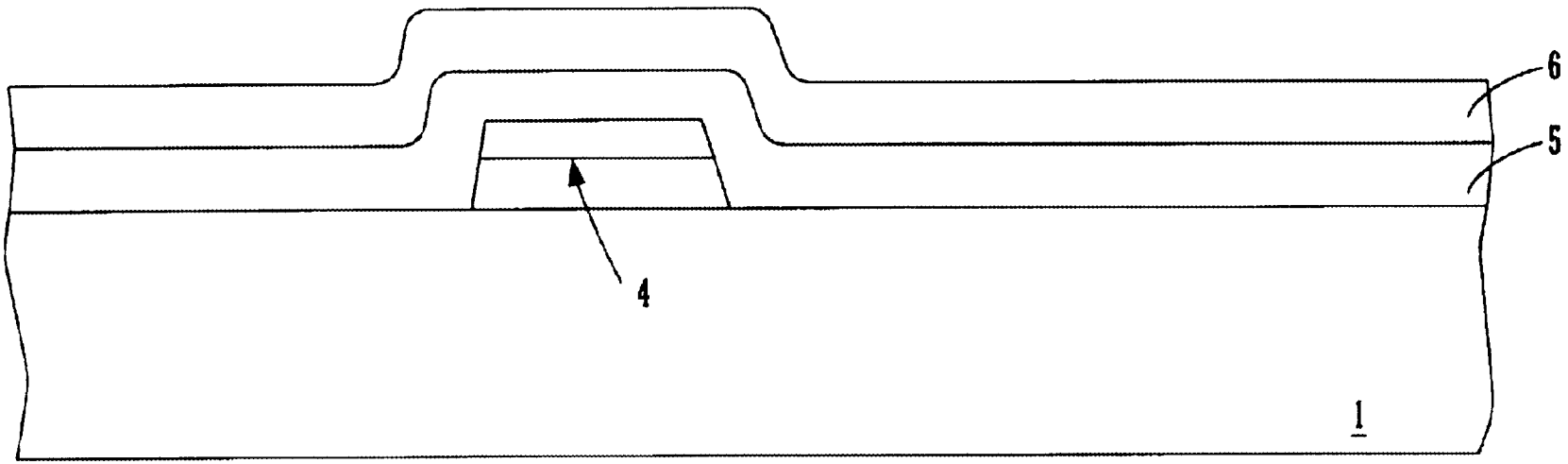
FIG. 6B is a side sectional view of a display device showing the structure of FIG. 5B after the deposition of a dielectric layer in accordance with one embodiment of the present claimed invention.

A layer of dielectric is then deposited as shown by step 105 of FIG. 1. In one embodiment silicon dioxide ($SiO_2$) is used as a dielectric. In the present embodiment, a plasma enhanced chemical vapor deposition process is used to deposit the silicon dioxide layer. Referring now to FIGS. 6A–6B, the embodiment of FIGS. 5A–5B is shown after the deposit of dielectric layer 6.

Figure 7A:
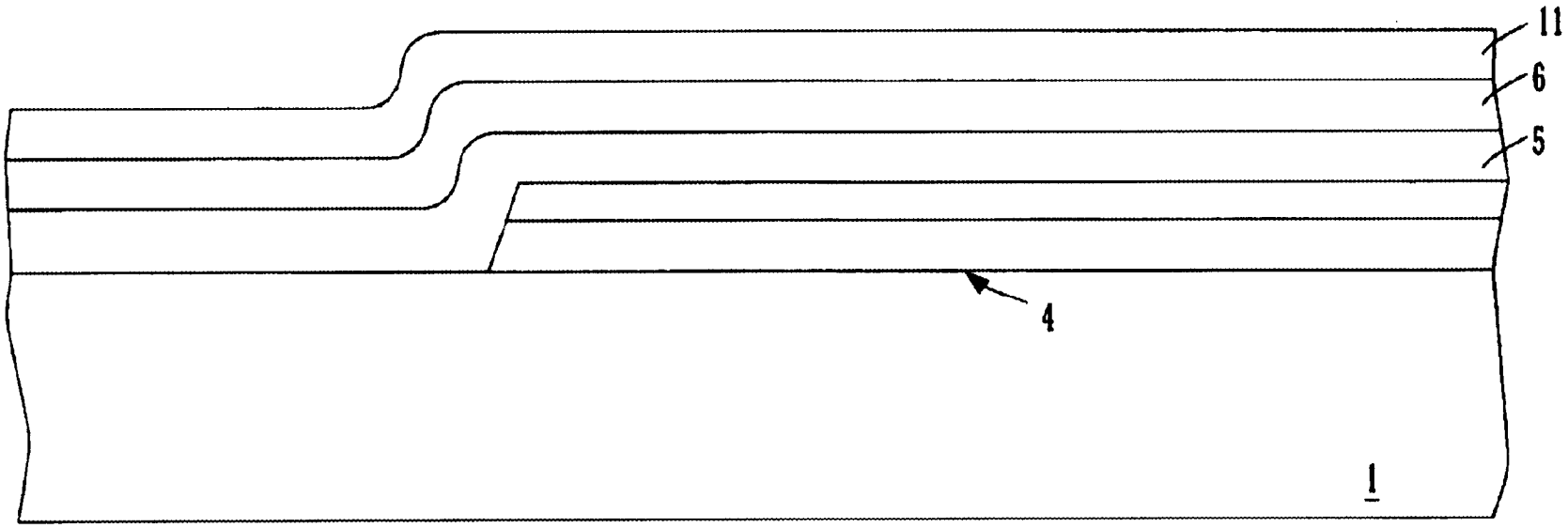
FIG. 7A is a side sectional view of a display device showing the structure of FIG. 6A after the deposition of a metal alloy layer in accordance with one embodiment of the present claimed invention.
Figure 7B:
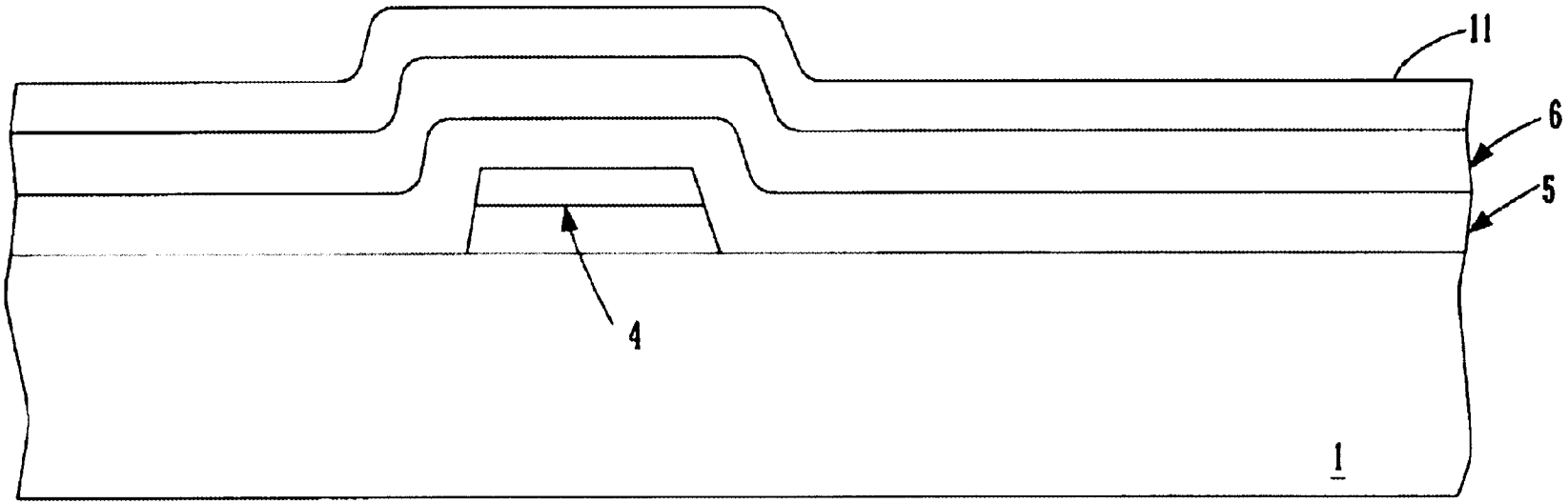
FIG. 7B is a side sectional view of a display device showing the structure of FIG. 6B after the deposition of a metal alloy layer in accordance with one embodiment of the present claimed invention.

A metal alloy layer is then deposited as shown by step 106 of FIG. 1. In the present embodiment, the metal alloy layer has a thickness of approximately 500–5000 Angstroms. FIGS. 7A–7B show metal alloy layer 11 deposited over dielectric layer 6. In one embodiment, metal alloy layer 11 is an aluminum alloy. More particularly, in one specific embodiment, an aluminum alloy is used that includes aluminum and from 0.5 to 6 atomic percent neodymium and from 0 to 5 atomic percent titanium.

Alternatively, metal alloy layer 11 is a silver alloy. In one embodiment, metal alloy layer 11 includes silver and 0.5 to 2 atomic percent palladium and 0.5 to 2 atomic percent copper. In yet another embodiment, a silver alloy is used that includes 0.5 percent to 2 atomic percent palladium Pd and 0.0 to 2.0 atomic percent titanium.

When a silver alloy is used an adhesion layer can be used to promote adhesion to the gate structure. In one embodiment, a molybdenum adhesion layer is used that has a thickness of approximately 500–1000 angstroms is used.

Figure 8A:
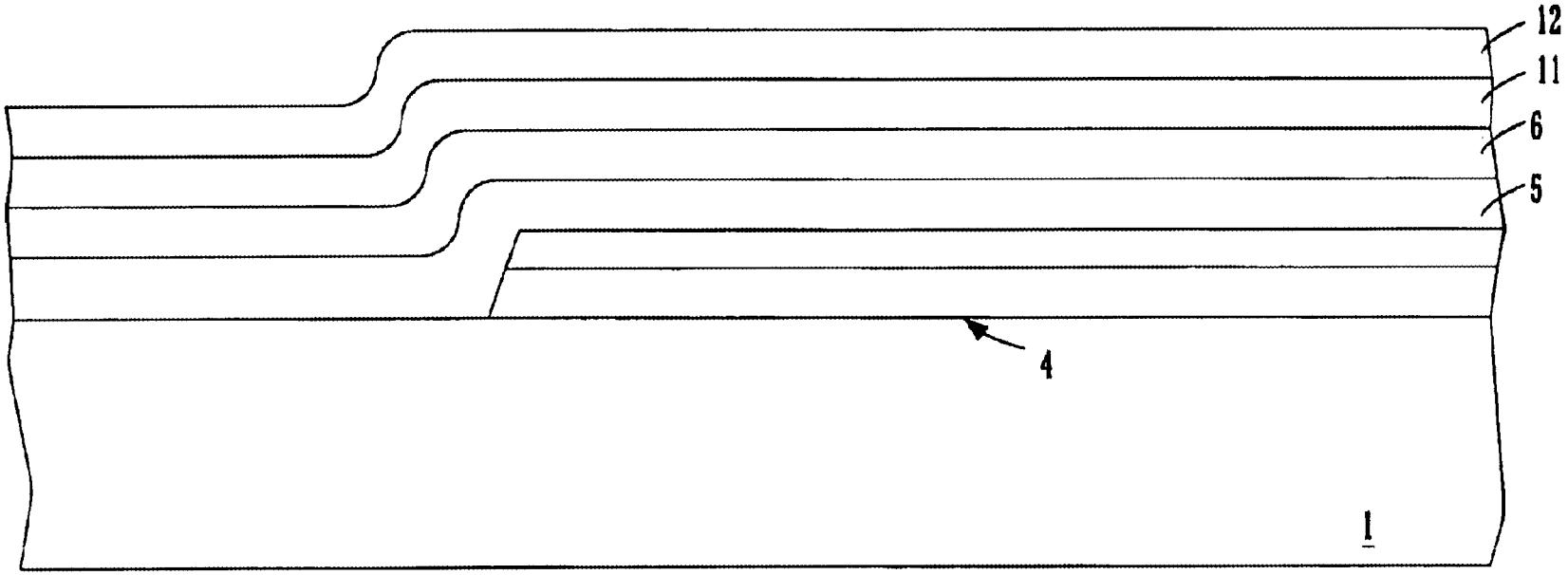
FIG. 8A is a side sectional view of a display device showing the structure of FIG. 7A after the deposition of a cladding layer in accordance with one embodiment of the present claimed invention.
Figure 8B:
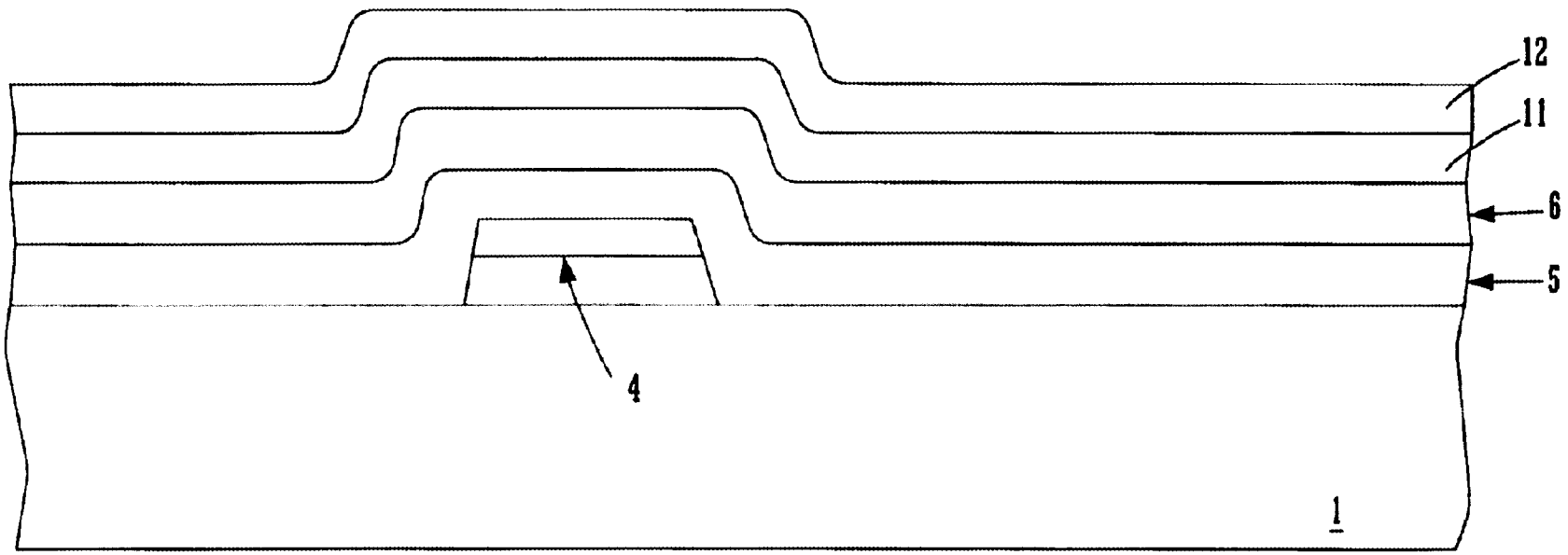
FIG. 8B is a side sectional view of a display device showing the structure of FIG. 7B after the deposition of a cladding layer in accordance with one embodiment of the present claimed invention.

Referring to FIG. 1, as shown by step 107, a cladding layer is then deposited. FIGS. 8A–8B shows the structure of FIGS. 7A–7B after cladding layer 12 has been deposited. It can be seen that cladding layer 12 directly overlies metal alloy layer 11.

In one embodiment, cladding layer 12 of FIG. 3 is a molybdenum tungsten alloy. In the present embodiment, cladding layer 12 has a thickness of approximately 500–4000 angstroms. The use of cladding layer 12 produces a contact pad that is reliable and that maintains good electrical contact. In addition, the use of cladding layer 12 further reduces hillock formation.

Though the present invention includes the deposition of cladding layer 12, the present invention is well adapted for use without cladding layer 12. That is, the use of aluminum alloy or silver alloy provides sufficient reduction in hillock formation and results in good conductivity as compared with prior art processes. In an embodiment that does not include cladding layer 12 but which uses a silver alloy, a diffusion barrier layer can be used. In one embodiment, the diffusion barrier layer is titanium or titanium nitride or titanium tungsten that is deposited over the silver alloy and that has a thickness of approximately 500–2000 Angstroms.

In one embodiment, the deposition of metal alloy layer 11 and cladding layer 12 is conducted using a single sputtering tool. This provides significant cost savings over prior art methods that require two separate sputtering process steps and results in increased throughput and yield.

Figure 9A:
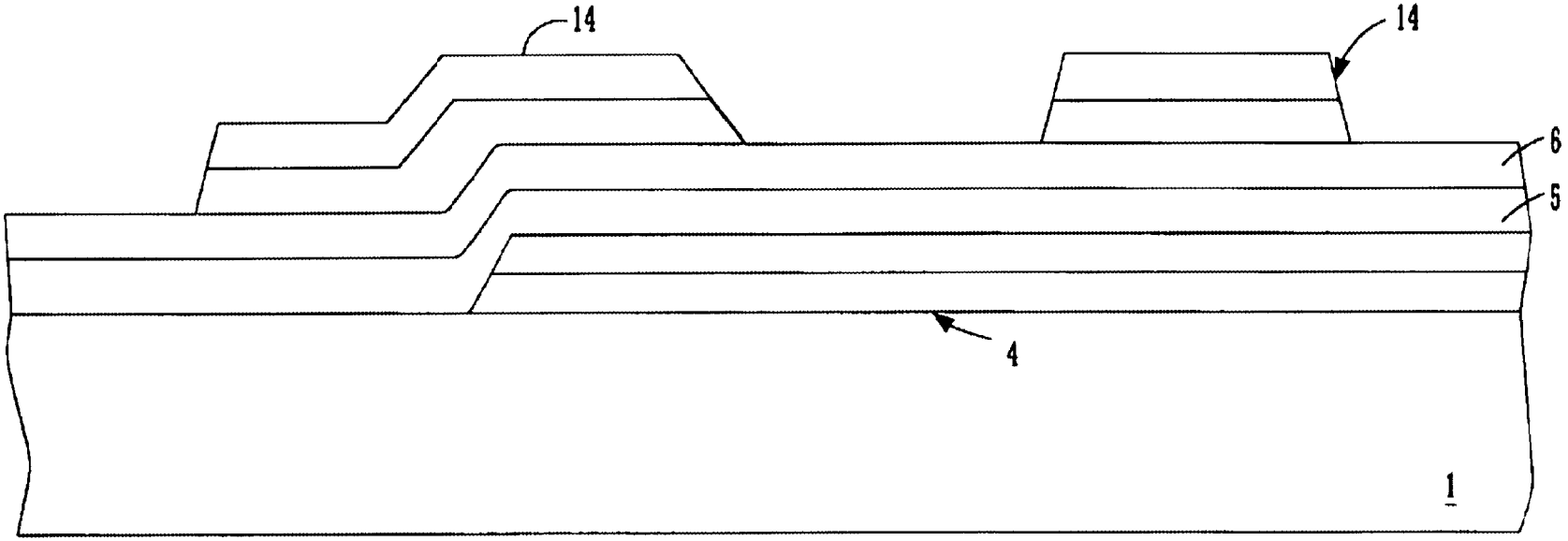
FIG. 9A is a side sectional view of a display device showing the structure of FIG. 8A after mask and etch steps have been performed in accordance with one embodiment of the present claimed invention.
Figure 9B:
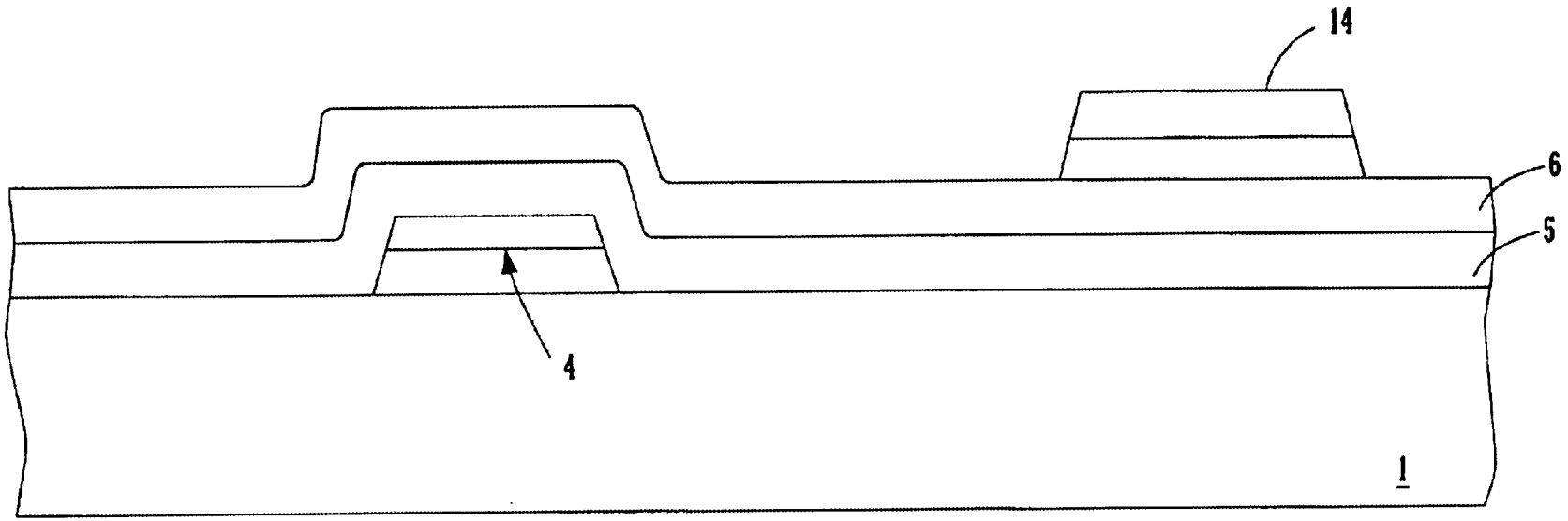
FIG. 9B is a side sectional view of a display device showing the structure of FIG. 8B after mask and etch steps have been performed in accordance with one embodiment of the present claimed invention.

Referring to step 108 of FIG. 1, mask and etch steps are performed for forming upper electrodes. In the present invention, a wet etch process is used. FIGS. 9A–9B show the structure of FIGS. 8A–8B after mask and etch steps have formed exemplary upper electrode 14. In one embodiment, an etchant is used that includes nitric acid, phosphoric acid, ascetic acid and water for forming angled edges on the sides of upper electrode 14. The use of an angled edges results in good conformity of overlying layers and reduces cracking in overlying layers.

The use of either an aluminum alloy or the use of a silver alloy in conjunction with a cladding layer provides good conductivity. The resulting conductivity is sufficient for fabrication of large flat panel displays. In addition, the present invention prevents hillock formation as occurs in prior art processes that use aluminum. Thus, shorts are prevented as compared with prior art processes that use aluminum and planarity of overlying layers is obtained. This results in increased yield as compared with prior art processes that use aluminum. Moreover, the present invention requires a single patterning step and a single etch step in order to form upper electrode 14. Thus, the present invention does not require two separate patterning steps and two separate etch steps as are required in prior art processes. This results in significant cost savings and increased yield and throughput. Also, the present invention does not use a dry etch process. This results in cost savings and increases in yield and throughput.

Figure 10A:
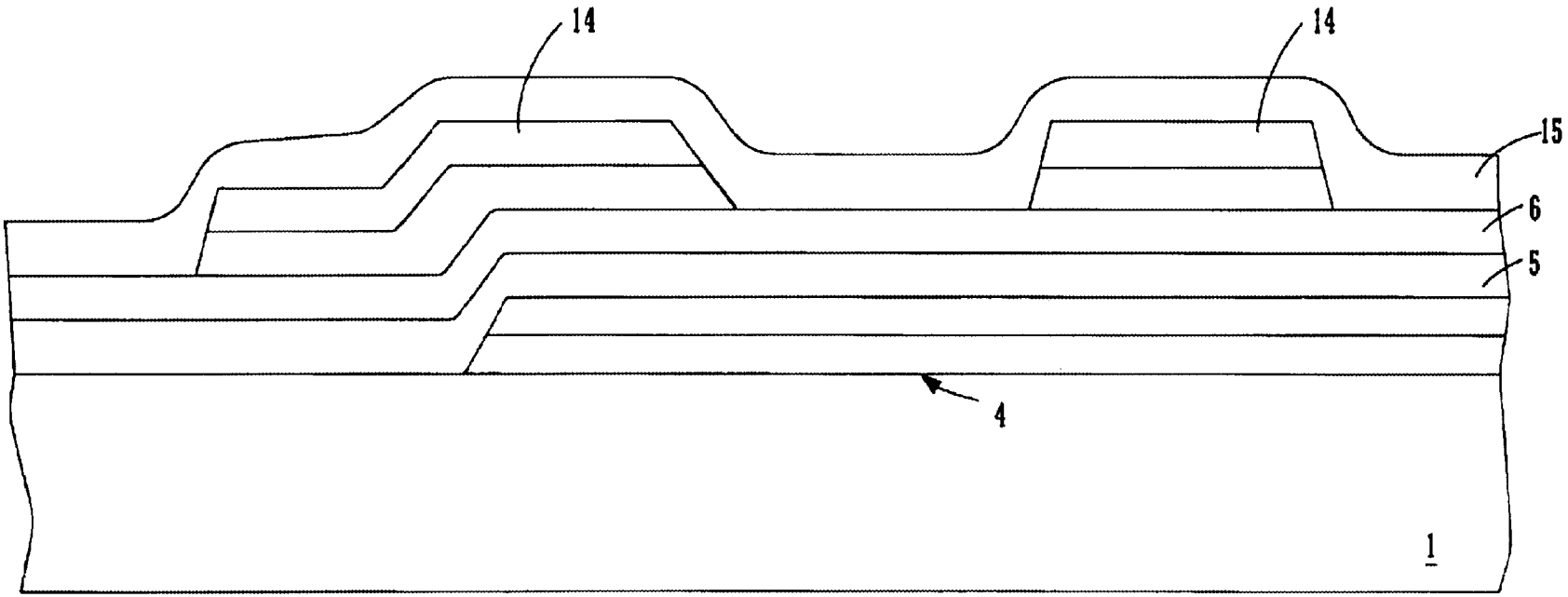
FIG. 10A is a side sectional view of a display device showing the structure of FIG. 9A after the deposition of a passivation layer in accordance with one embodiment of the present claimed invention.
Figure 10B:
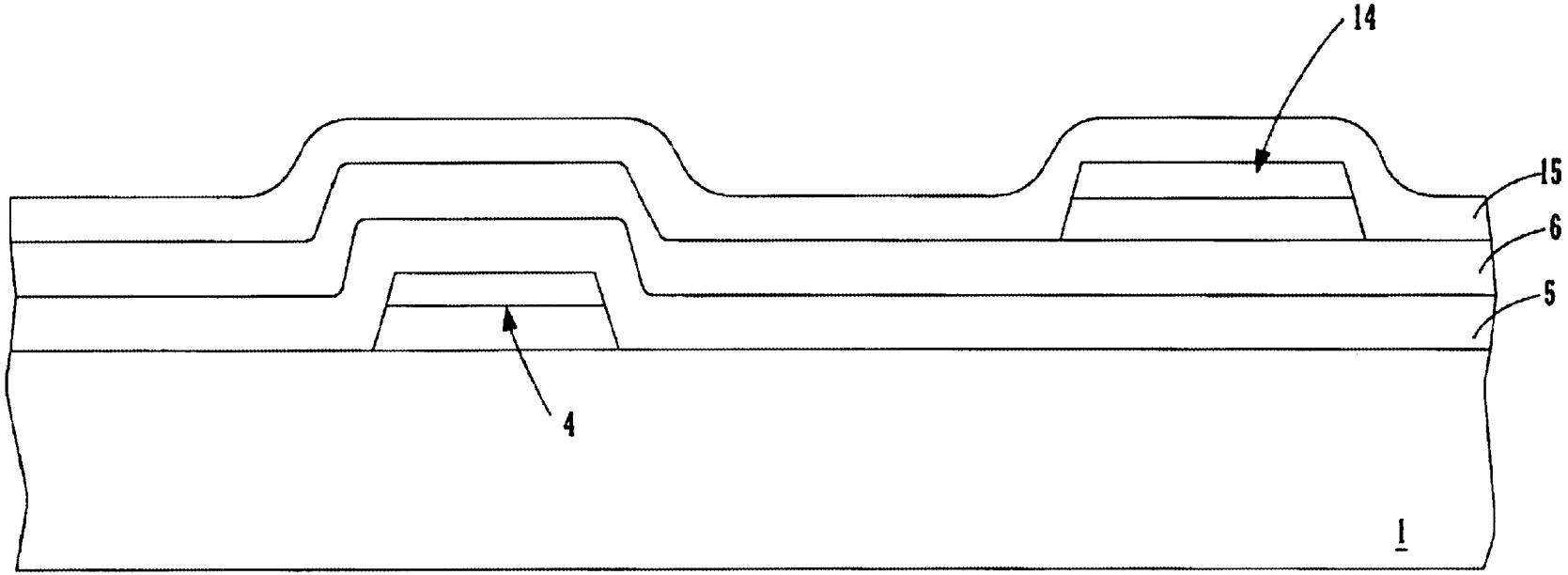
FIG. 10B is a side sectional view of a display device showing the structure of FIG. 9B after the deposition of a passivation layer in accordance with one embodiment of the present claimed invention.

Referring now to step 109 of FIG. 1, a passivation layer is deposited. In one embodiment, the passivation layer is silicon nitride deposited using a plasma enhanced chemical vapor deposition process. Referring now to FIGS. 10A–10B, the structure of FIGS. 9A–9B is shown after passivation layer 15 is deposited.

Figure 11A:
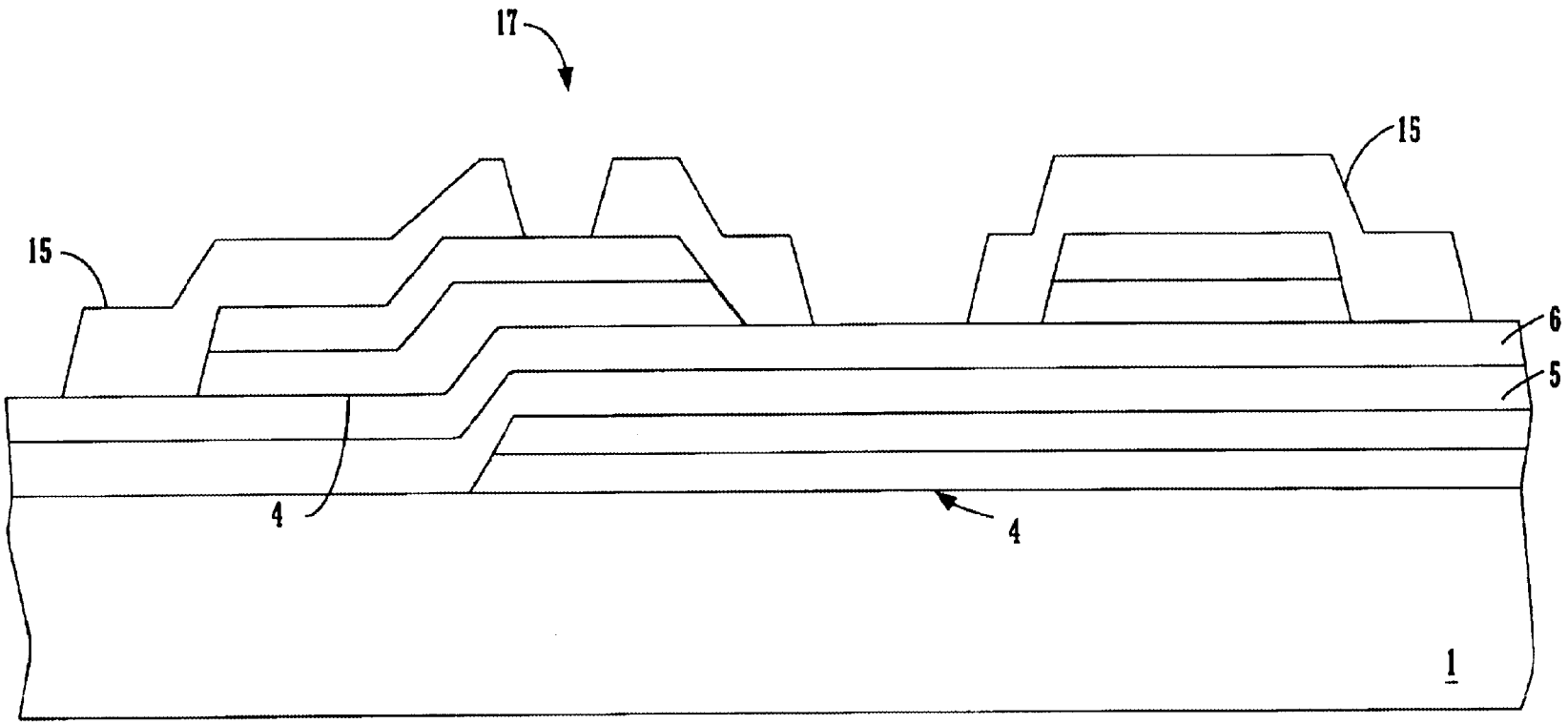
FIG. 11A is a side sectional view of a display device showing the structure of FIG. 10A after mask and etch steps have been performed in accordance with one embodiment of the present claimed invention.
Figure 11B:
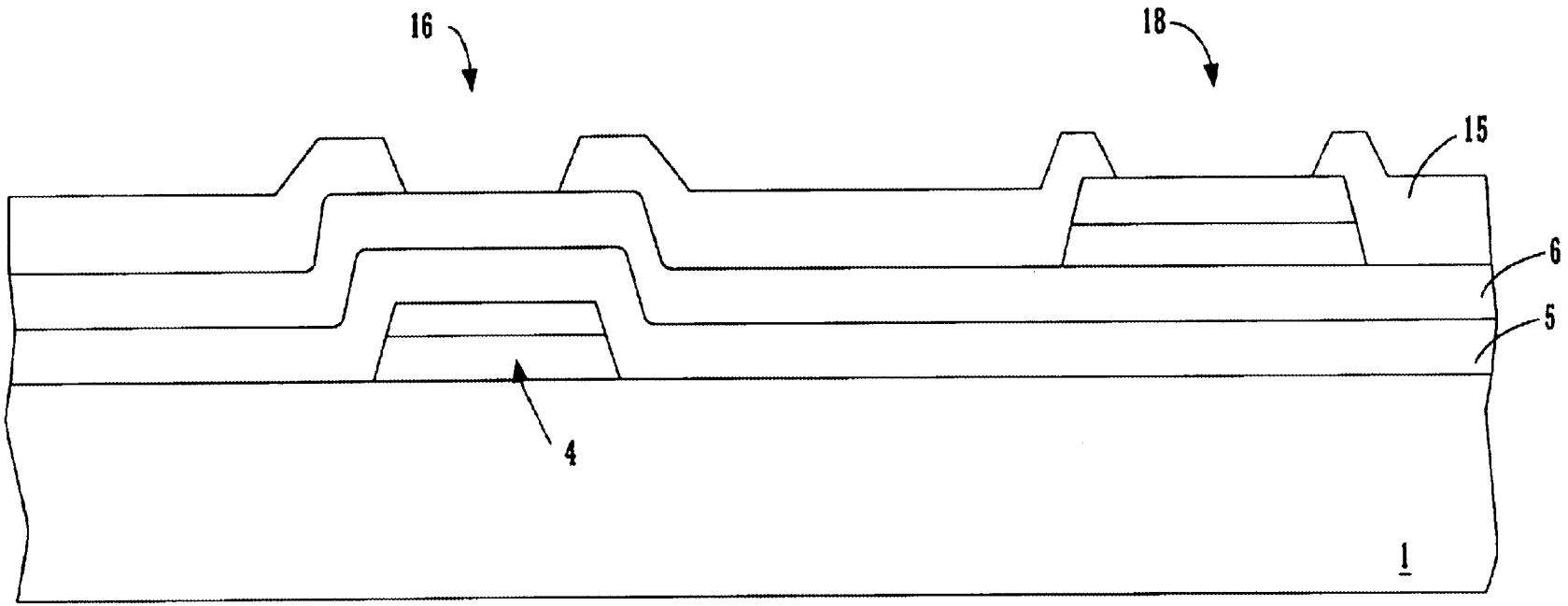
FIG. 11B is a side sectional view of a display device showing the structure of FIG. 10B after mask and etch steps have been performed in accordance with one embodiment of the present claimed invention.

Referring now to step 110 of FIG. 1, mask and etch steps are performed. FIGS. 11A–11B show the structure of FIGS. 10A–10B after mask and etch steps have formed openings 16–18. It can be seen that passivation layer 15 extends over upper electrode 14 except at openings 17–18.

Figure 12A:
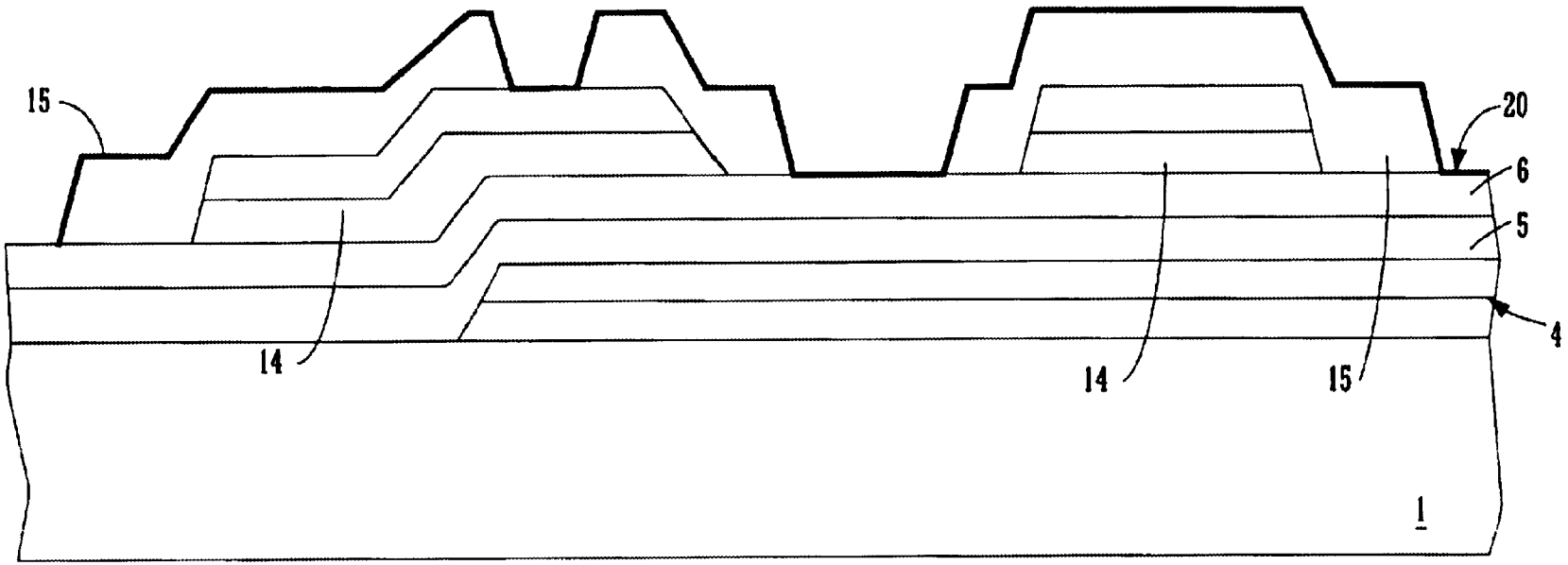
FIG. 12A is a side sectional view of a display device showing the structure of FIG. 11A after deposition of a gate metal layer in accordance with one embodiment of the present claimed invention.
Figure 12B:
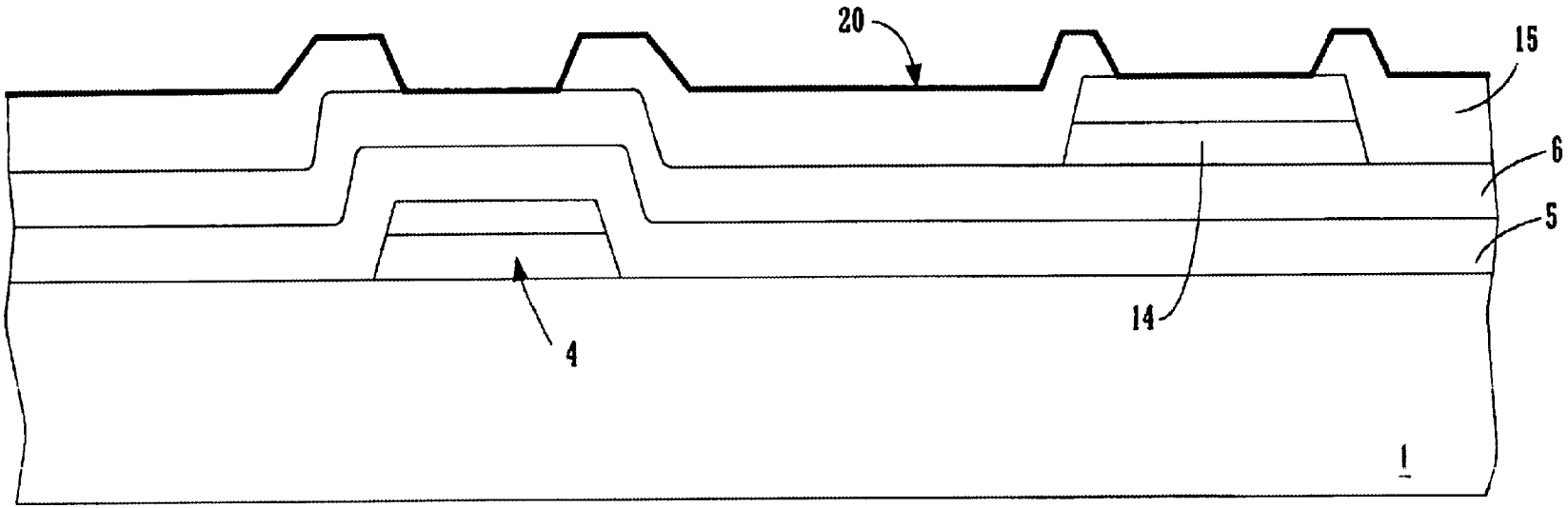
FIG. 12B is a side sectional view of a display device showing the structure of FIG. 11B after deposition of a gate metal layer in accordance with one embodiment of the present claimed invention.

Gate metal is then deposited as shown by step 111 of FIG. 1. In one embodiment, chromium is used as a gate metal. FIGS. 12A–12B show the structure of FIGS. 11A–11B after gate metal layer 20 has been deposited. In an alternate embodiment, gate metal layer 20 is formed by first depositing a tantalum layer and then depositing a chromium layer over the tantalum layer. Passivation layer 15 protects upper electrode 14 during the deposition of gate metal layer 20.

Figure 13A:
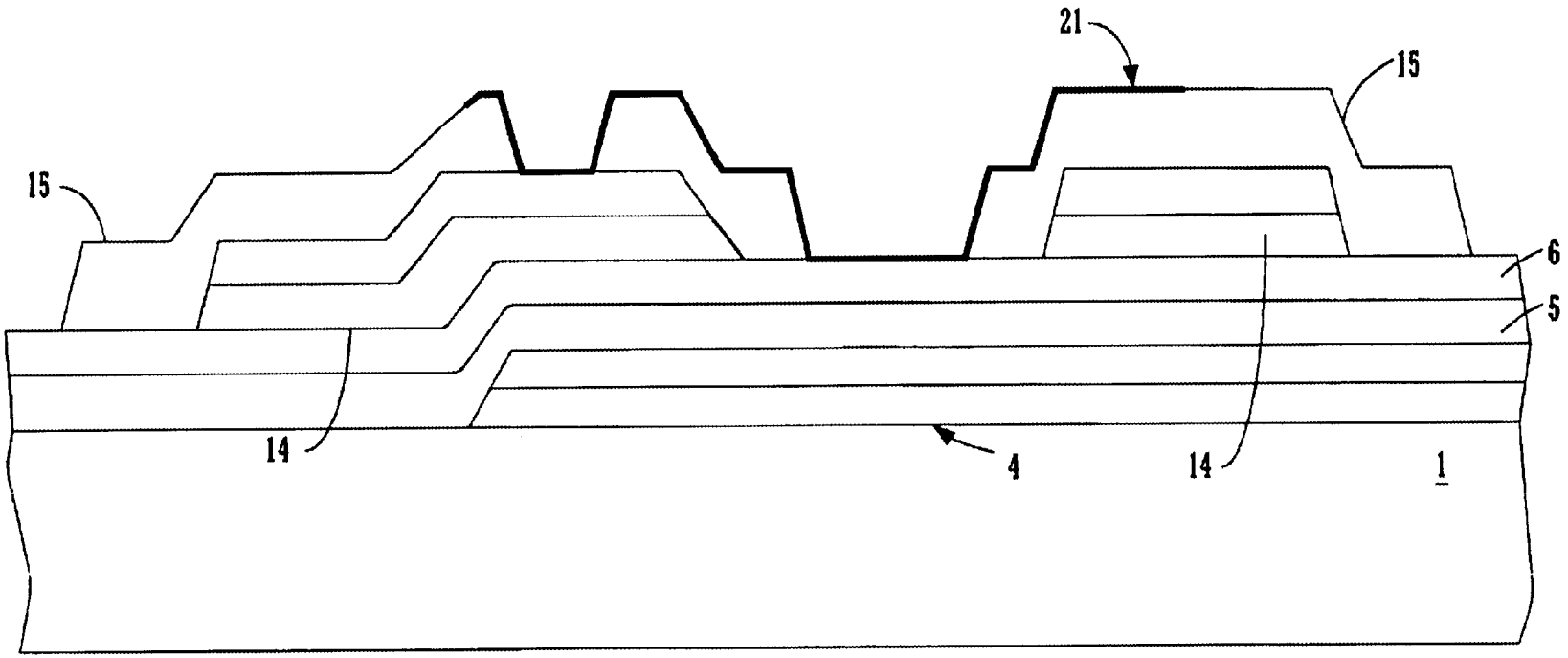
FIG. 13A is a side sectional view of a display device showing the structure of FIG. 12A after mask and etch steps have been performed in accordance with one embodiment of the present claimed invention.
Figure 13B:
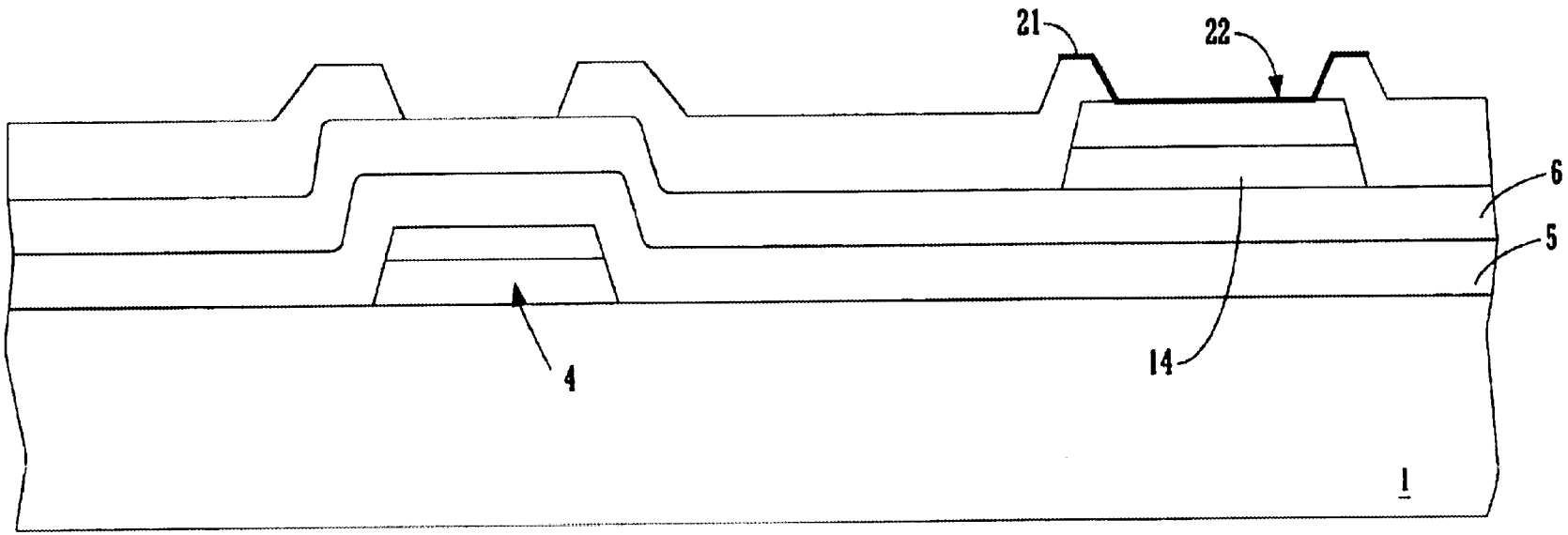
FIG. 13B is a side sectional view of a display device showing the structure of FIG. 12B after mask and etch steps have been performed in accordance with one embodiment of the present claimed invention.

Referring now to step 112 of FIG. 1, mask and etch steps are performed to form a gate structure. FIGS. 13A–13B show the structure of FIGS. 11A–11B after mask and etch steps have formed gate structure 21. In the present embodiment, column contact pad 22 allows for contact with upper electrode 14. Passivation layer 15 protects upper electrode 14 during mask and etch steps for forming gate metal structure 21.

Figure 14A:
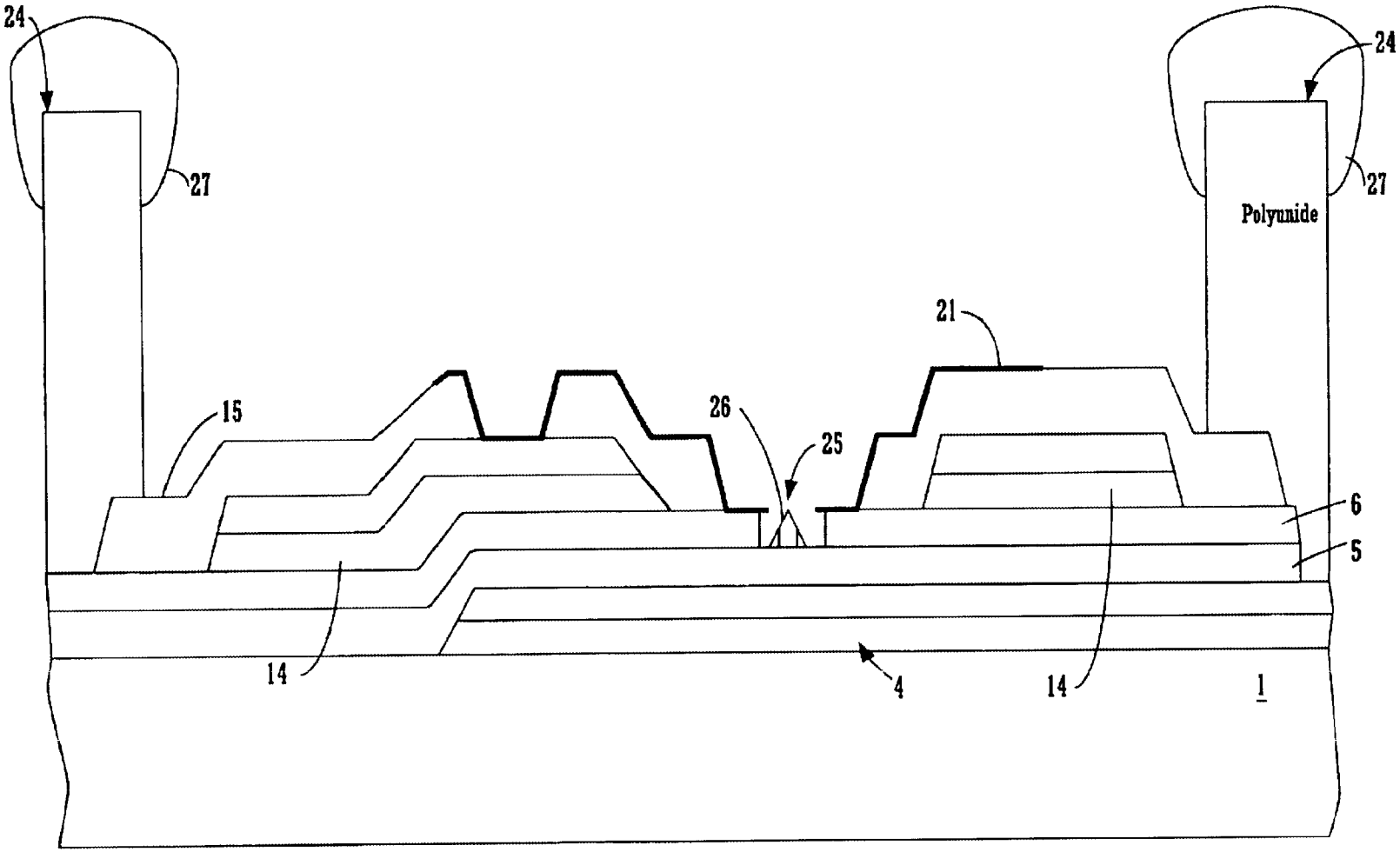
FIG. 14A is a side sectional view of a display device showing the structure of FIG. 13A after formation of emitters and focus structure in accordance with one embodiment of the present claimed invention.
Figure 14B:
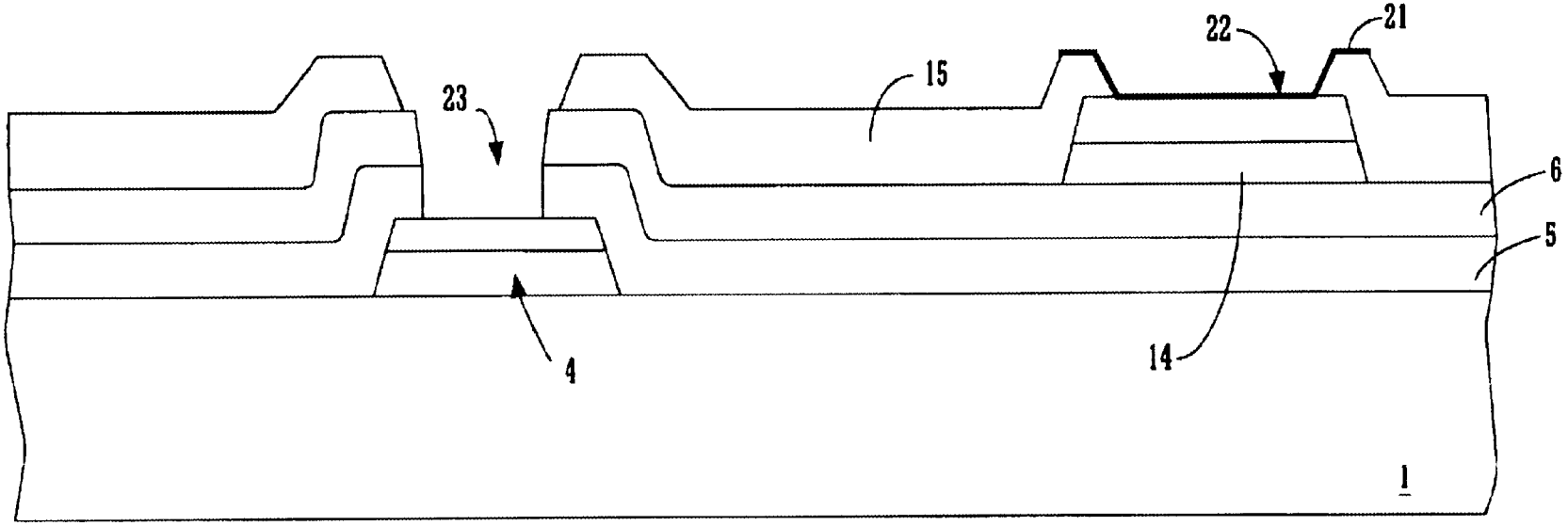
FIG. 14B is a side sectional view of a display device showing the structure of FIG. 13B after formation of emitters and focus structure in accordance with one embodiment of the present claimed invention.

Conventional process steps are then used to complete the cathode structure as shown by step 113 of FIG. 1. FIGS. 14A–14B show a completed cathode structure according to one embodiment of the present invention. In one embodiment of the present conventional process steps are used to form cavity 221 and to form exemplary emitter 26 within cavity 221. Mask and etch steps are used to extend opening 16 of FIG. 11B so as to expose row contact pad 23. Conventional process steps are also used to form focusing structure 24 and focus waffle metal 27. In one embodiment, focus waffle metal 27 is aluminum. In the present invention, these process steps include ion bombardment, cavity etch, cone deposition, dielectric deposition, masking and etching of the dielectric layer, polyimide deposition, etc.

During the process steps for completion of the cathode, upper electrode 14 is protected by passivation layer 15. This prevents damage to upper electrode 14 as typically occurs in prior art processes. By preventing damage to upper electrode 14, upper electrode shorts and opens are prevented. In addition, because upper electrode 14 is protected, column shorts in the frit seal region are eliminated. Also, because there is less exposed metal as compared with prior art processes, column to focus waffle shorts are decreased.

With reference now to FIGS. 15a–f, a second embodiment of a method for forming an electrode structure for a display device is shown. As shown by step 101 a metal alloy layer is deposited. As shown by step 102, a cladding layer is then deposited. Mask and etch steps are performed as shown by step 103 to form lower electrodes. A resistor layer is deposited as shown by step 104. A layer of dielectric is then deposited as shown by step 105. A metal alloy layer is then deposited as shown by step 106. As shown by step 107, a cladding layer is then deposited. Referring to step 108, mask and etch steps are performed for forming upper electrodes. In one embodiment, steps 101–108 are identical to steps 101–108 of FIG. 1, producing the structure shown in FIGS. 9A–9B.

Figure 15:
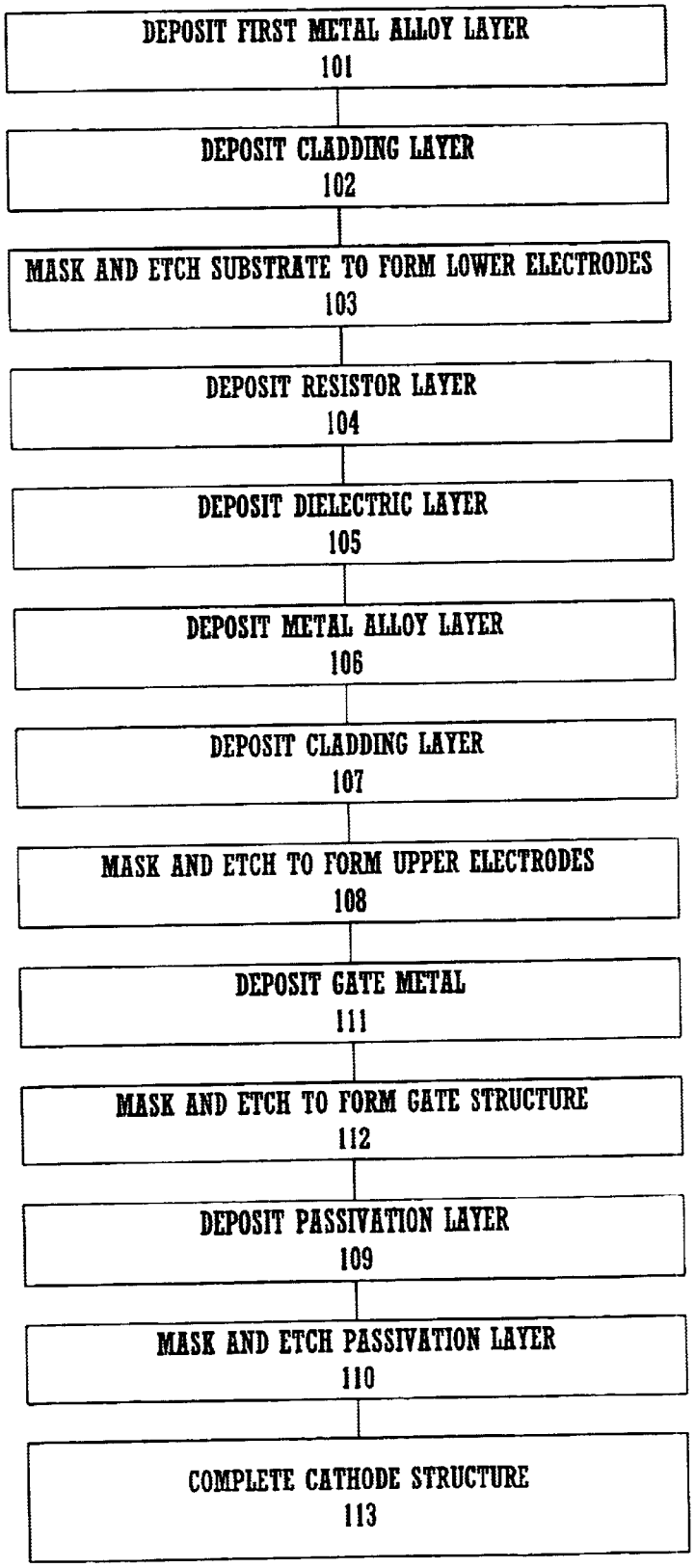
FIG. 15 is a diagram showing a method for forming an electrode structure of a display device in accordance with one embodiment of the present invention.
Figure 16A:
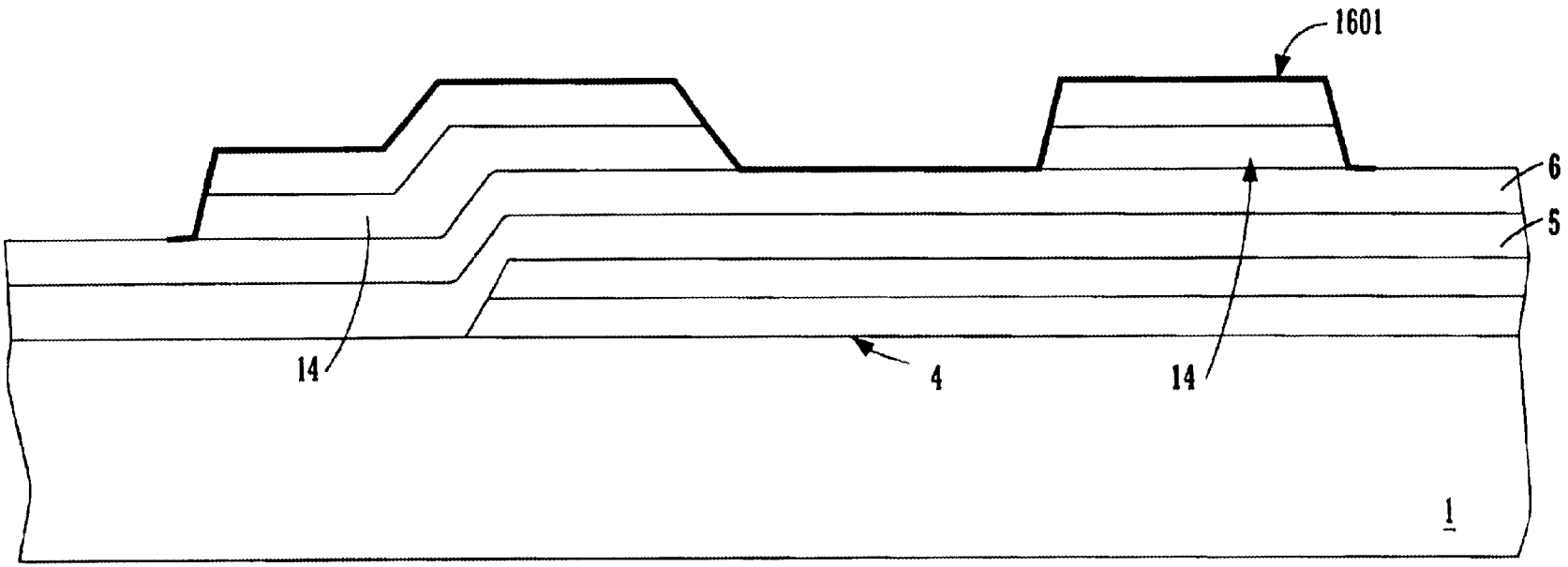
FIG. 16A is a side sectional view of a display device showing a backplate over which lower and upper electrodes are formed and having a resistor layer, a dielectric layer, and a gate structure in accordance with one embodiment of the present claimed invention.
Figure 16B:
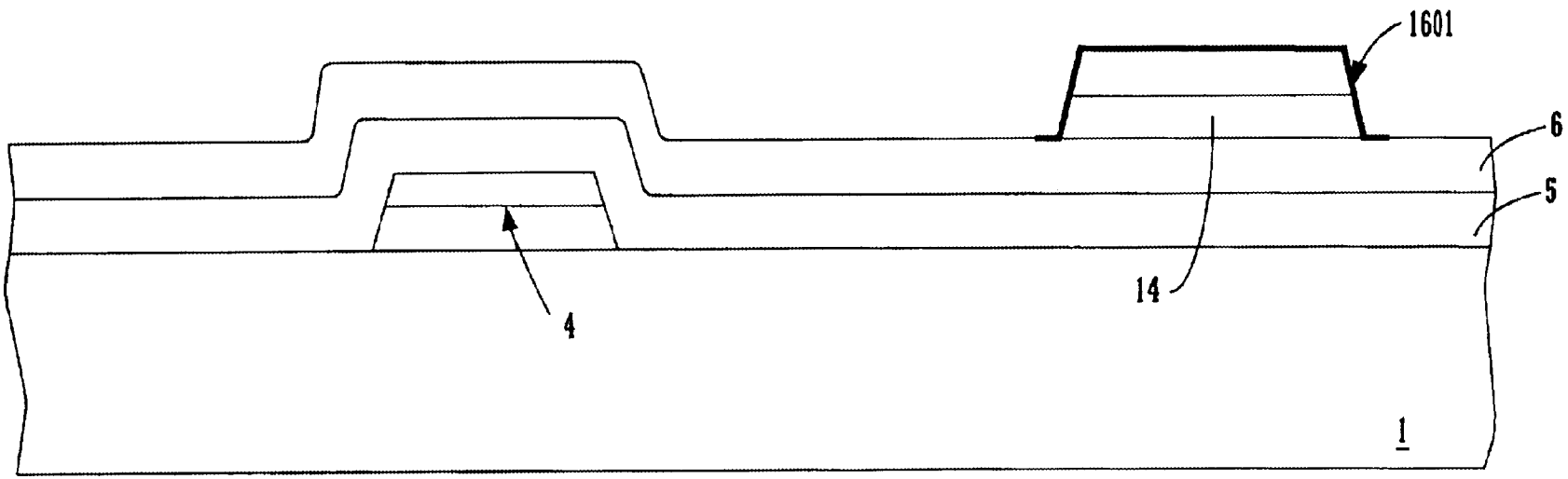
FIG. 16B is a side sectional view of a display device showing a backplate over which lower and upper electrodes are formed and having a resistor layer, a dielectric layer, and a gate structure in accordance with one embodiment of the present claimed invention.

Referring now to step 111 of FIG. 15, a gate metal layer is deposited. The gate metal layer is then masked and etched as shown by step 112. Referring now to FIGS. 16*a*–*b*, the structure of FIGS. 9*a*–9*b* is shown after steps 111–112 have been performed so as to form gate structure 1601. In one embodiment, gate structure 1601 is chromium. Alternatively, gate structure 1601 is a layer of chromium deposited over a layer of tantalum.

Figure 16C:
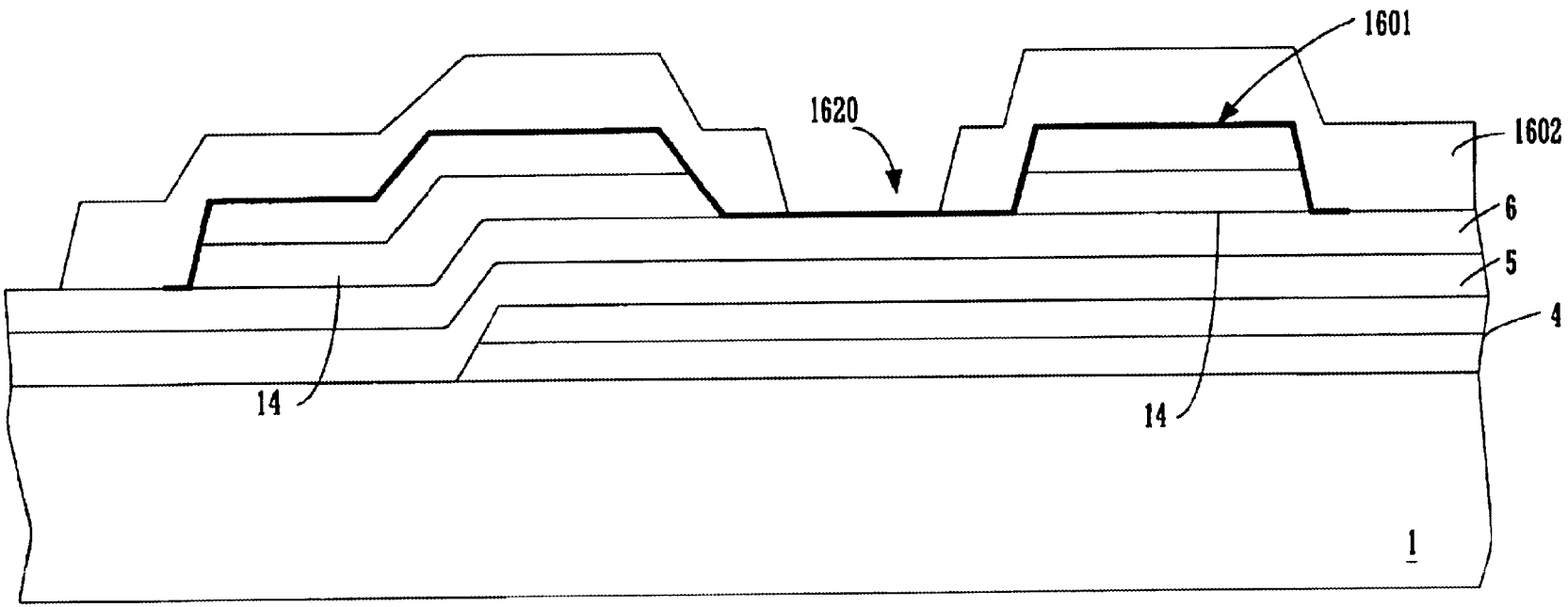
FIG. 16C is a side sectional view of a display device showing the structure of FIG. 9A after deposition, mask and etch have formed a passivation layer in accordance with one embodiment of the present claimed invention.
Figure 16D:
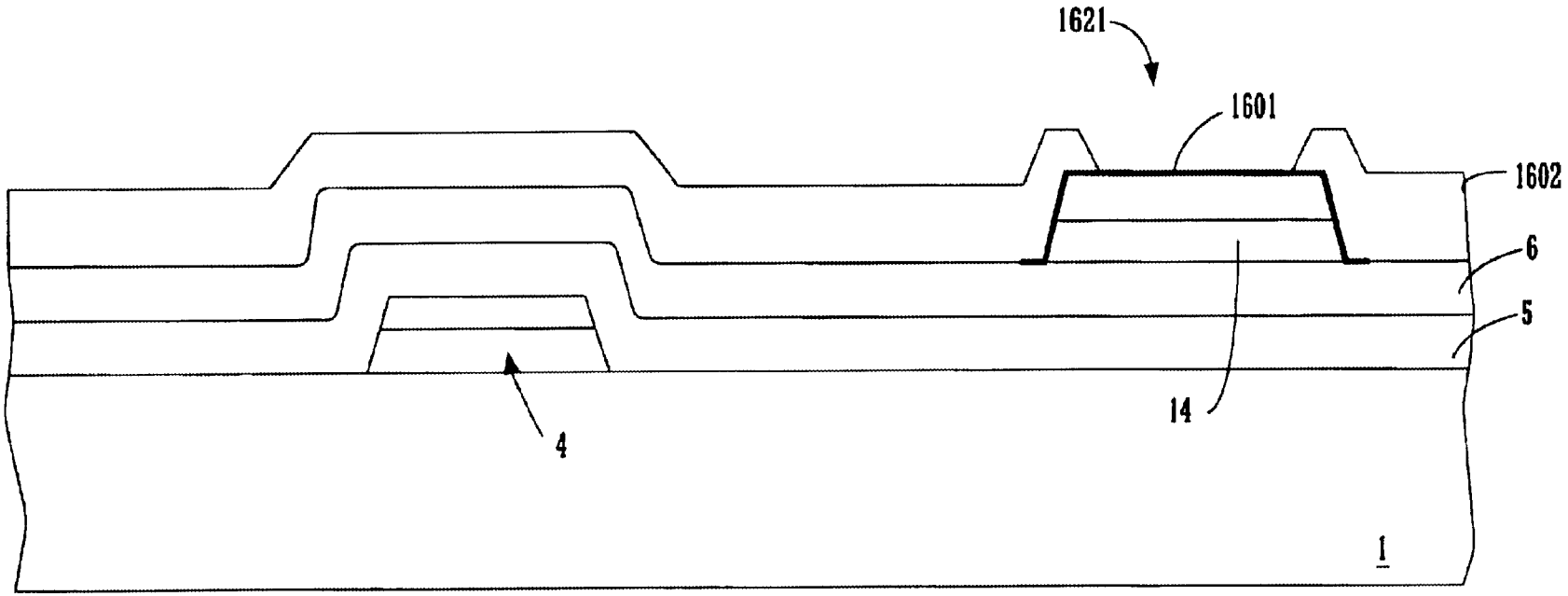
FIG. 16D is a side sectional view of a display device showing the structure of FIG. 9B after deposition, mask and etch have formed a passivation layer in accordance with one embodiment of the present claimed invention.

Continuing with FIG. 15, as shown by steps 109–110, a passivation layer is deposited, masked and etched. FIGS. 16*c*–16*d* show the structure of FIGS. 16*a*–16*b* after steps 109–110 have formed passivation layer 1602. In one embodiment, passivation layer 1602 is silicon nitride deposited using a plasma enhanced chemical vapor deposition process. Openings 1620–1621 extend through passivation layer 1602. It can be seen that passivation layer 1602 extends over gate structure 1601 except at openings 1620–1621.

Figure 16E:
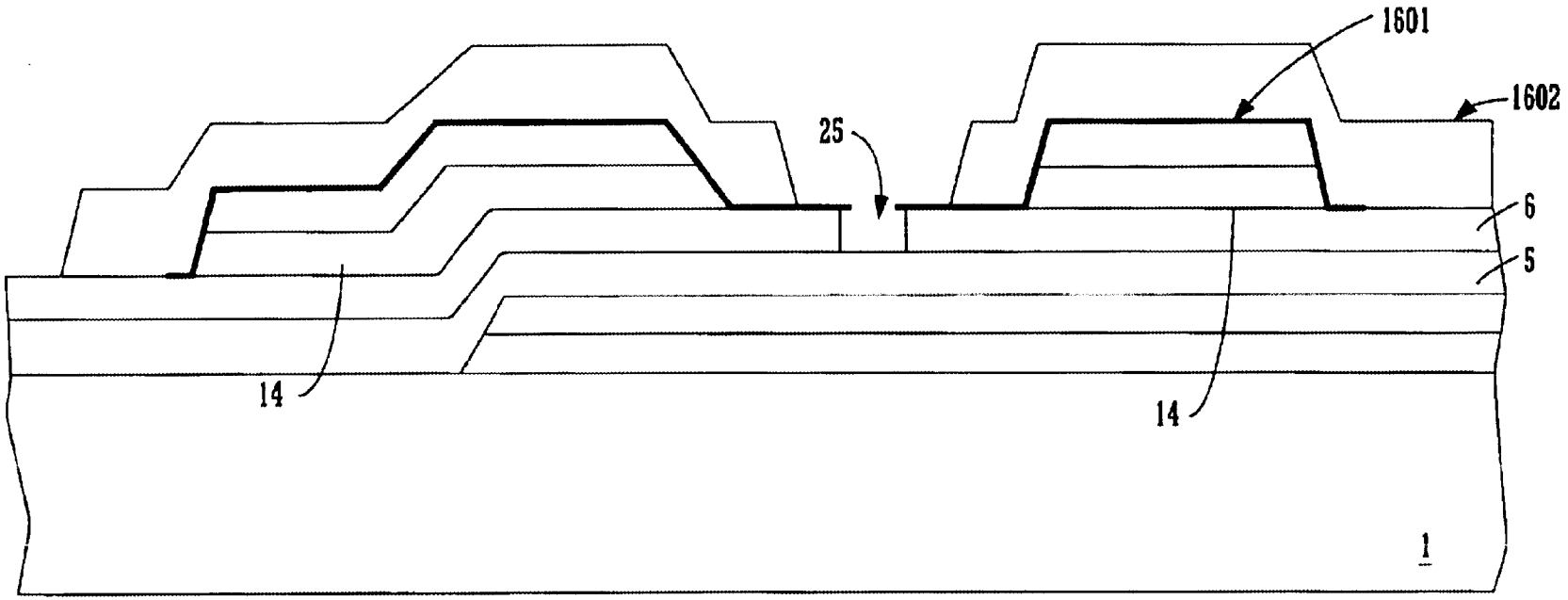
FIG. 16E is a side sectional view of a display device showing the structure of FIG. 16C after mask and etch steps have been performed in accordance with one embodiment of the present claimed invention.
Figure 16F:
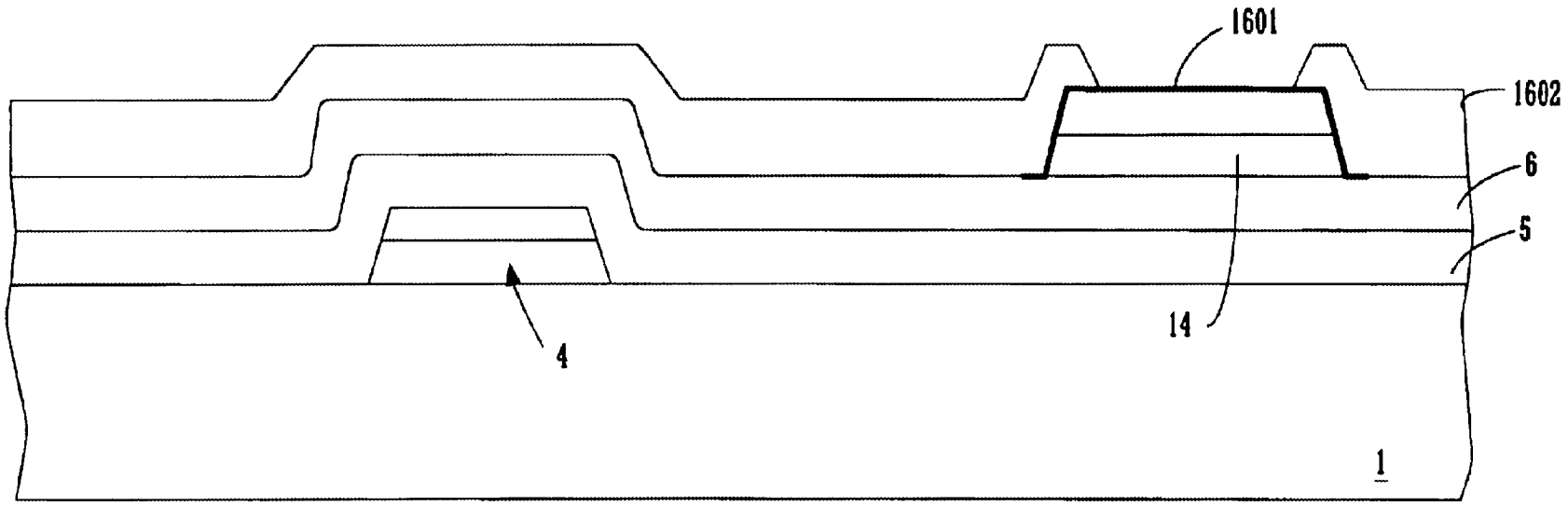
FIG. 16F is a side sectional view of a display device showing the structure of FIG. 16D after mask and etch steps have been performed in accordance with one embodiment of the present claimed invention.
Figure 16G:
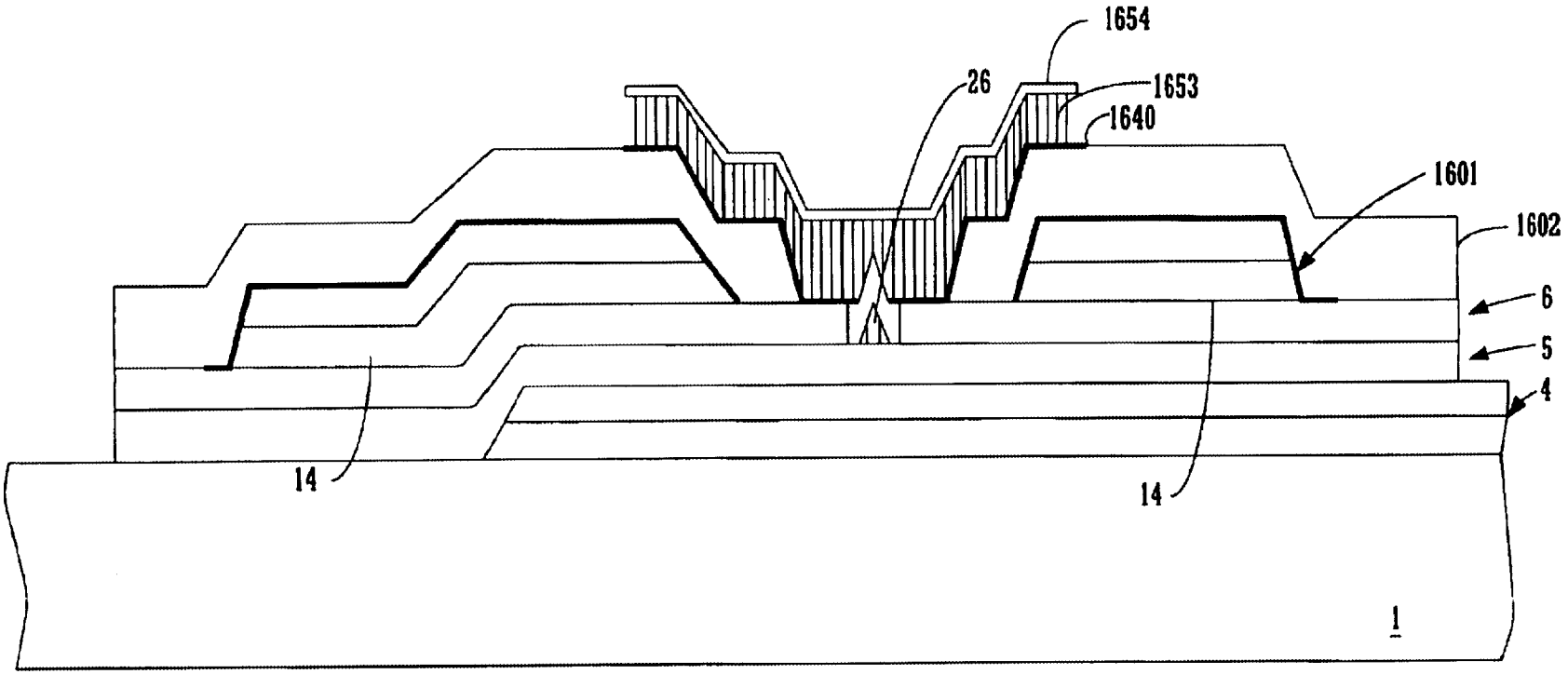
FIG. 16G is a side sectional view of a display device showing the structure of FIG. 16E after evaporation of a chromium layer and deposition of cone material, deposition of a layer of dielectric material, and mask and etch steps have been performed in accordance with one embodiment of the present claimed invention.
Figure 16H:
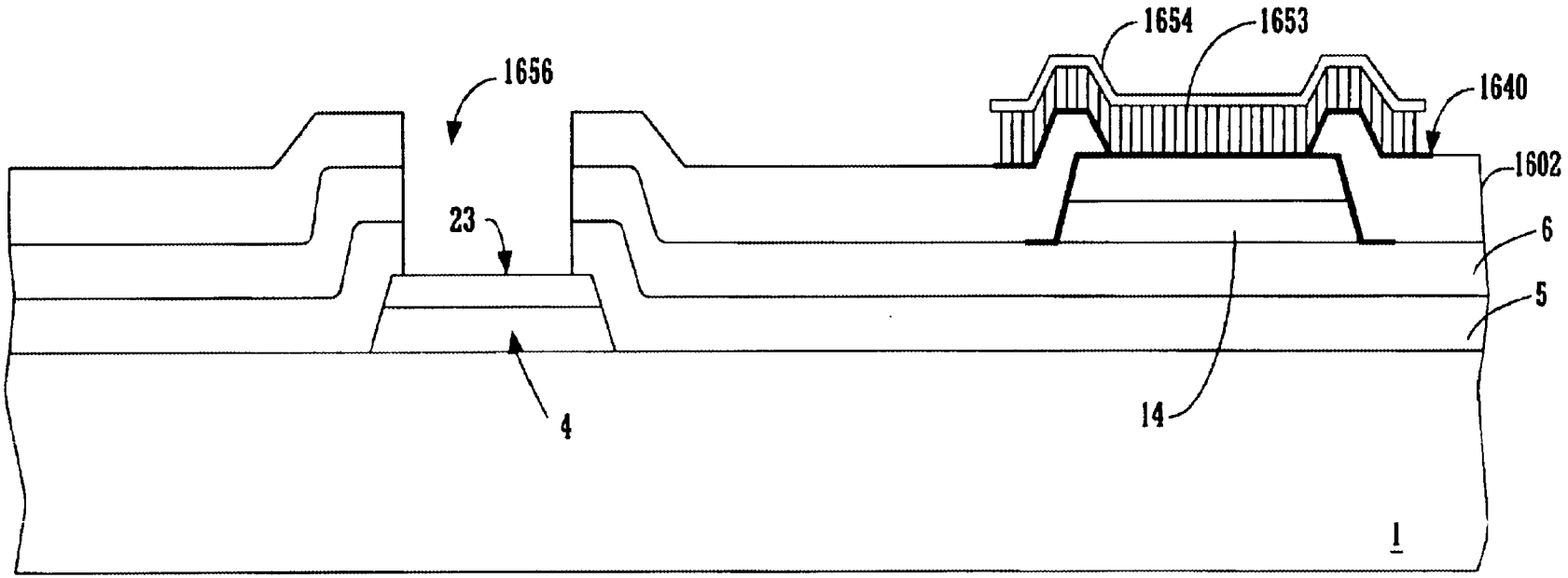
FIG. 16H is a side sectional view of a display device showing the structure of FIG. 16F after evaporation of a chromium layer and deposition of cone material, deposition of a layer of dielectric material, and mask and etch steps have been performed in accordance with one embodiment of the present claimed invention.
Figure 16I:
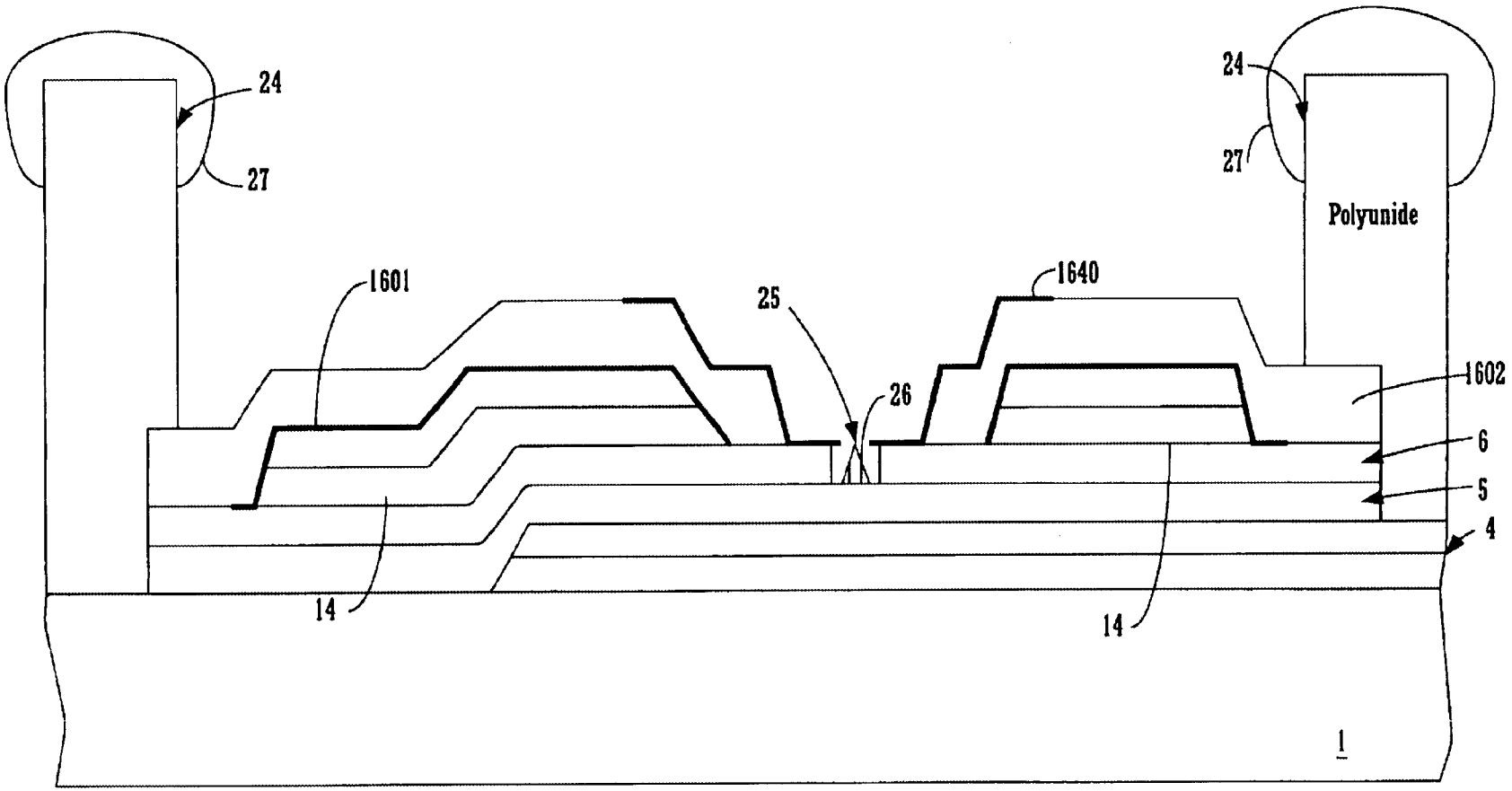
FIG. 16I is a side sectional view of a display device showing a completed cathode structure in accordance with one embodiment of the present claimed invention.
Figure 16J:
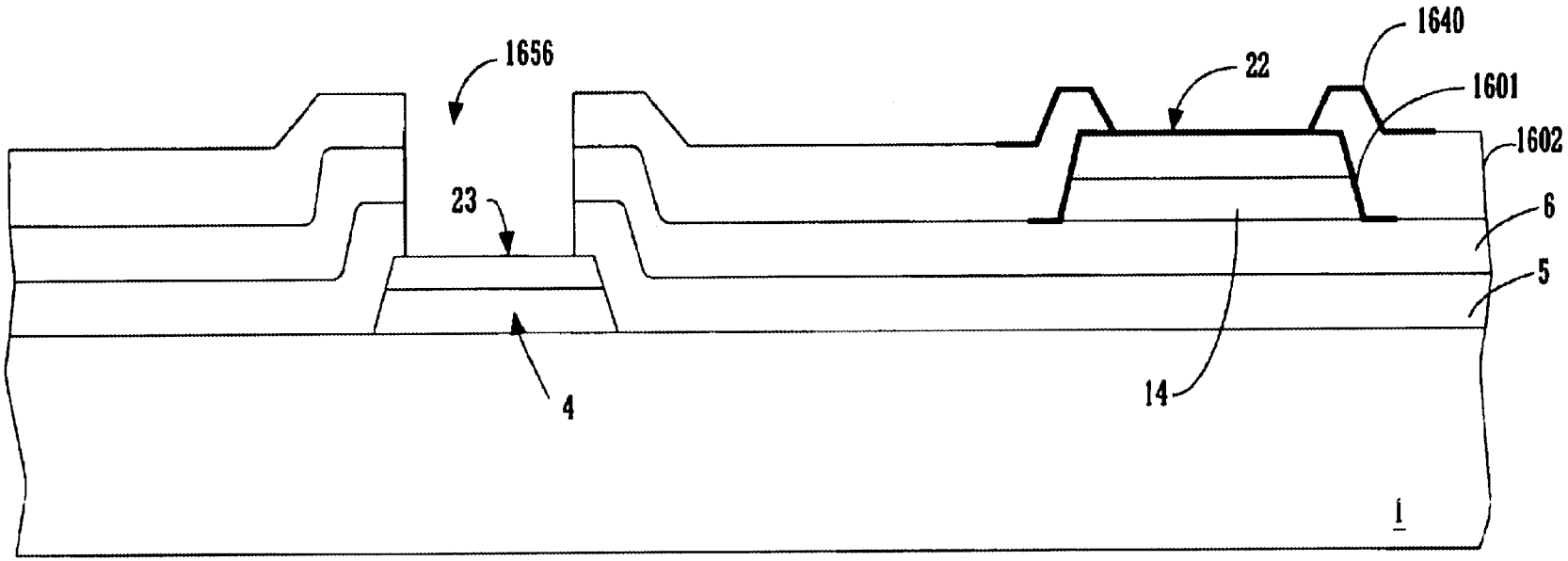
FIG. 16J is a side sectional view of a display device showing a completed cathode structure in accordance with one embodiment of the present claimed invention.

The cathode structure is then completed as shown by step 113 of FIG. 15. FIGS. 16E–16J illustrate an exemplary method for completing the cathode structure in accordance with one embodiment of the present invention. First an etch step is performed. FIGS. 16E–16F show the structure of FIGS. 16C–16D after the etch step has formed cavity 25. A layer of chromium is evaporated over the structure, followed by the deposition of cone material and the deposition of a dielectric layer. In one embodiment, the layer of chromium is thin, having a thickness of approximately 500 Angstroms. The resulting structure is then patterned and etched so as to produce the structure shown in FIGS. 16G–16H. The structure of FIGS. 16G–16H shows dielectric material 1654, cone 26, cone material 1653 and chromium 1640. In one embodiment, cone material 1653 is evaporated molybdenum. However, the present invention is well adapted for use of other materials for forming cone 26. Mask and etch steps form opening 1656 that exposes portions of lower electrode 4 so as to form lower contact pad 23. Dielectric removal steps and a halo etch are then performed, followed by formation of polyimide structures and focus waffle metal. FIGS. 16I–16J show a completed cathode structure that includes polyimide structures 24, focus waffle metal 27 and upper contact pad 22.

During the process steps for completion of the cathode, upper electrode 14 is protected by gate metal structure 1601 and by passivation layer 15. This prevents damage to upper electrode 14 as typically occurs in prior art processes. By preventing damage to upper electrode 14, upper electrode shorts and opens are prevented. In addition, because upper electrode 14 is protected, column shorts in the frit seal region are eliminated. Also, because there is less exposed metal as compared with prior art processes, column to focus waffle shorts are decreased.

Figure 17:
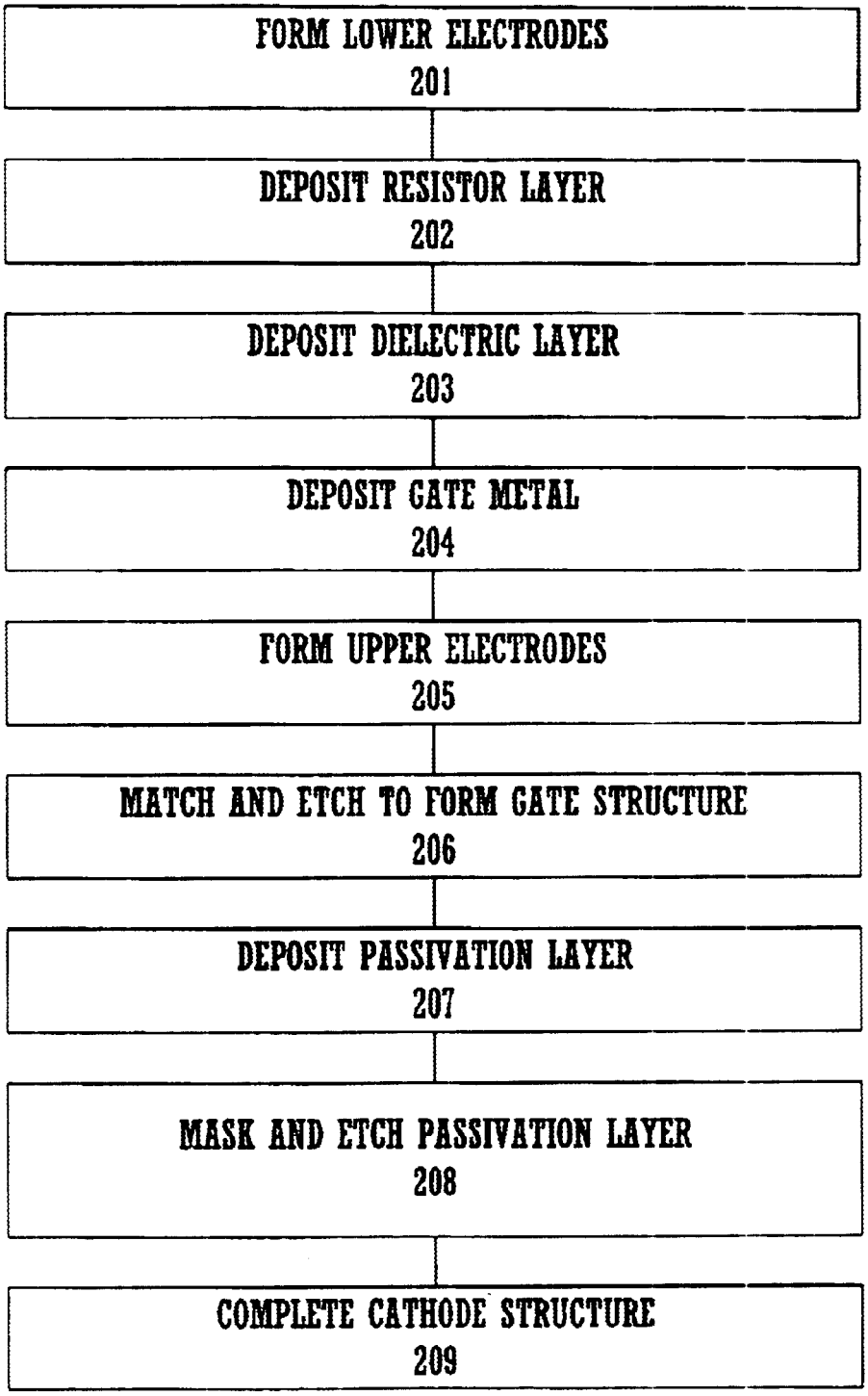
FIG. 17 is a diagram showing a method for forming an electrode structure of a display device in accordance with one embodiment of the present invention.

With reference now to FIG. 17, yet another method for forming an electrode structure for a display device is shown. As shown by step 201, lower electrodes are formed over a substrate. A resistor layer and a dielectric layer are then deposited over the lower electrodes as shown by steps 202–203. In one embodiment, steps 201–203 are identical to steps 101–105 of FIG. 1.

Continuing with FIG. 17, gate metal is deposited as is shown by step 204. In one embodiment, chromium is used as a gate metal.

Referring still to FIG. 17, upper electrodes are formed as shown by step 205. In the one embodiment, upper electrodes are formed in the same manner as shown in steps 106–108 of FIGS. 1 and 15. In the present embodiment, upper electrodes are formed by depositing a metal alloy layer that is an aluminum alloy and masking and etching the metal alloy layer. In one specific embodiment, a metal alloy layer is used that a thickness of 500–5000 Angstroms and that includes aluminum (Al) and Neodymium (Nd) with a concentration of from 0.5 to 6 atomic percent Nd. In another embodiment, an aluminum alloy is used that has a concentration of from 0.5 to 6 atomic percent Nd and from 0 to 5 atomic percent titanium (Ti).

Figure 18A:
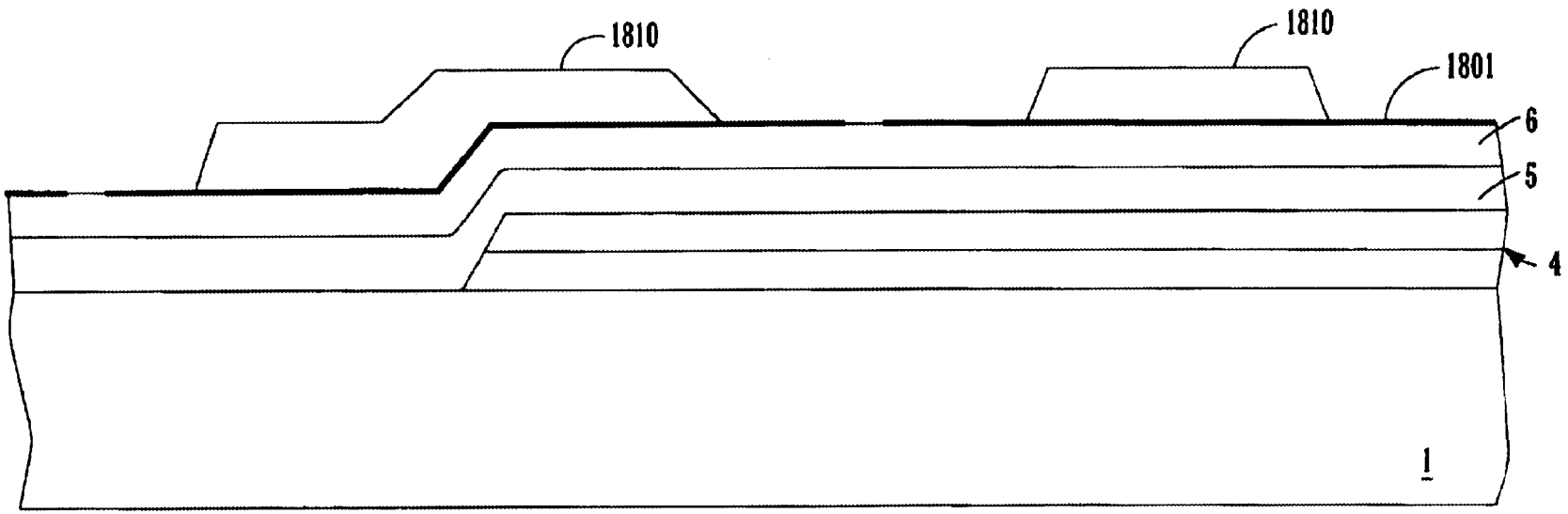
FIG. 18A is a side sectional view of a display device showing a backplate over which lower and upper electrodes are formed and having a resistor layer, a dielectric layer, and a gate layer in accordance with one embodiment of the present claimed invention.
Figure 18B:
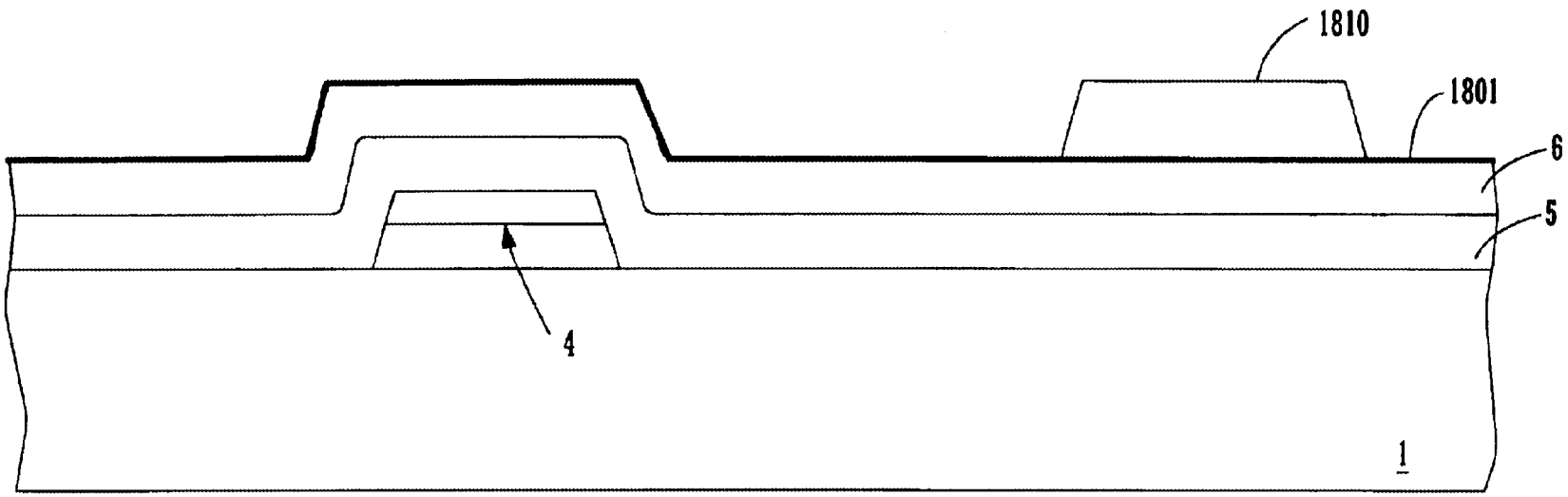
FIG. 18B is a side sectional view of a display device showing a backplate over which lower and upper electrodes are formed and having a resistor layer, a dielectric layer, and a gate layer in accordance with one embodiment of the present claimed invention.

FIGS. 18A–18B show substrate 1 after steps 201–205 have been performed, forming lower electrodes 4 over substrate 1, resistor layer 5, dielectric layer 6, gate metal layer 1801 and upper electrodes 1810.

Figure 18C:
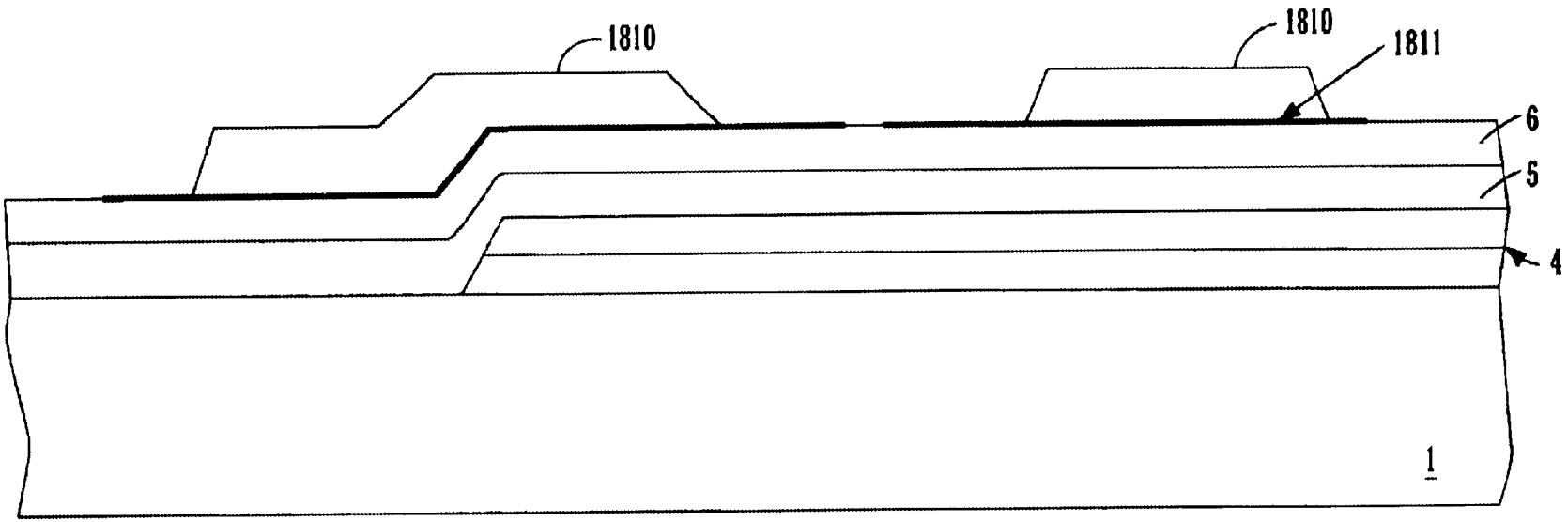
FIG. 18C is a side sectional view of a display device showing the structure of FIG. 18A after mask and etch steps have formed a gate structure in accordance with one embodiment of the present claimed invention.
Figure 18D:
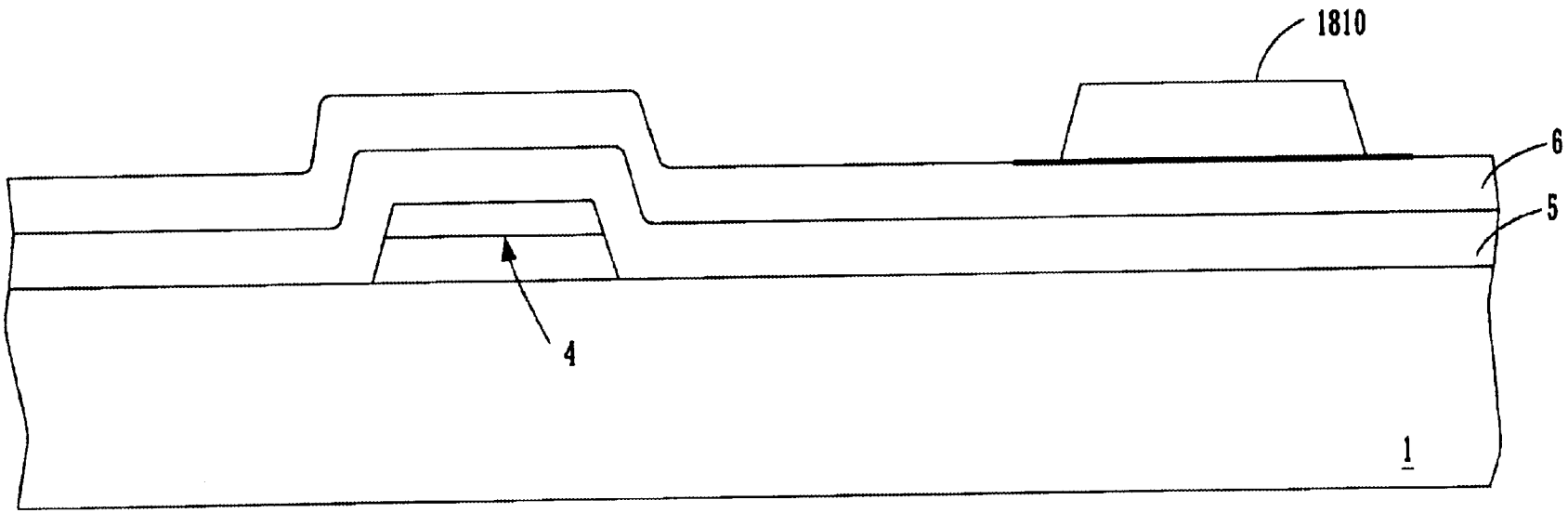
FIG. 18D is a side sectional view of a display device showing the structure of FIG. 18B after mask and etch steps have formed a gate structure in accordance with one embodiment of the present claimed invention.

Referring back to FIG. 17, as shown by step 206, mask and etch steps are then performed so as to selectively etch gate metal layer 1801 of FIGS. 18A–18B. More particularly, in the present embodiment, photoresist is deposited over the backplate and is patterned. The backplate is then etched using a wet etch process. FIGS. 18C–18D show the structure of FIGS. 18A–18B after mask and etch steps have formed gate metal structure 1811.

Referring now to step 207 of FIG. 17, a passivation layer is deposited. In one embodiment, the passivation layer is silicon nitride deposited using a plasma enhanced chemical vapor deposition process.

Figure 18E:
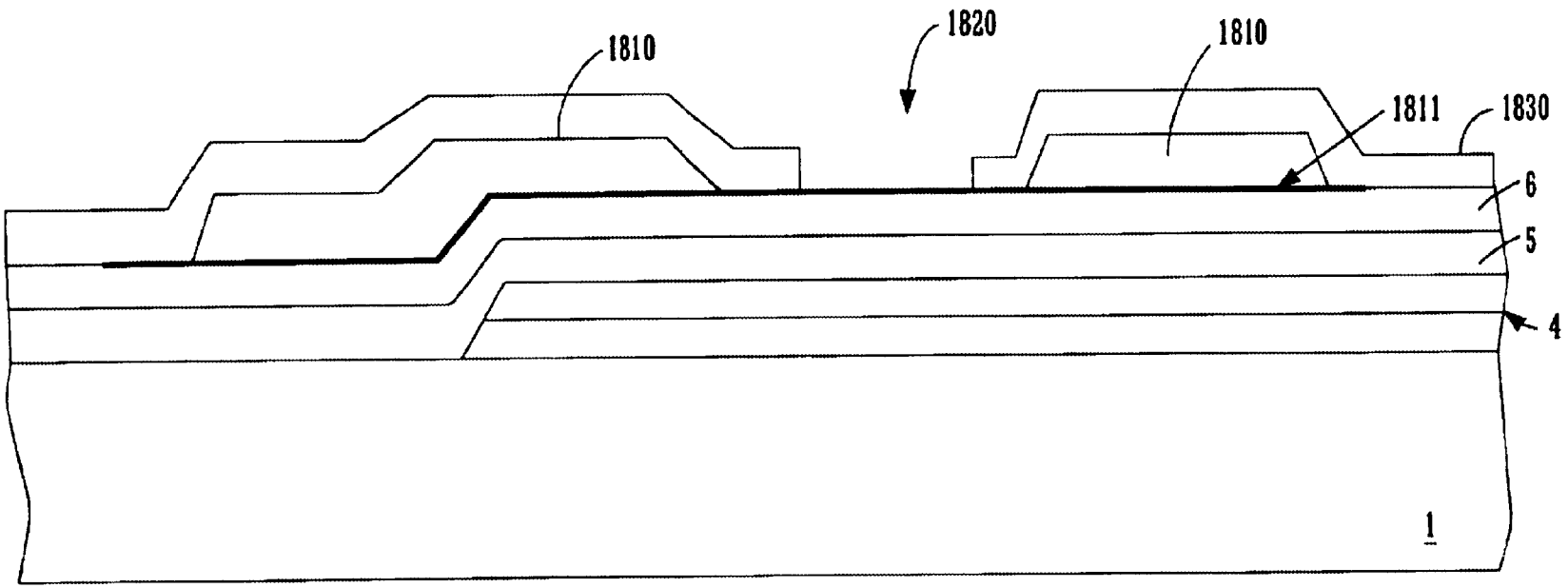
FIG. 18E is a side sectional view of a display device showing the structure of FIG. 18C after mask and etch steps have been performed in accordance with one embodiment of the present claimed invention.
Figure 18F:
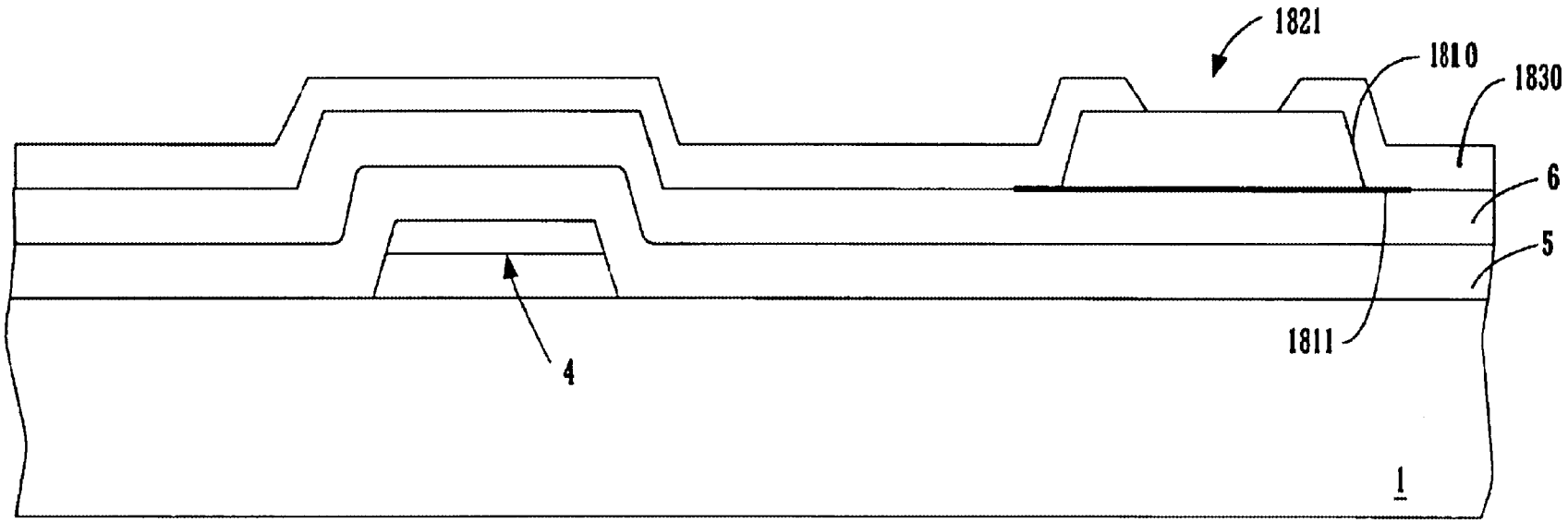
FIG. 18F is a side sectional view of a display device showing the structure of FIG. 18D after mask and etch steps have been performed in accordance with one embodiment of the present claimed invention.
Figure 18G:
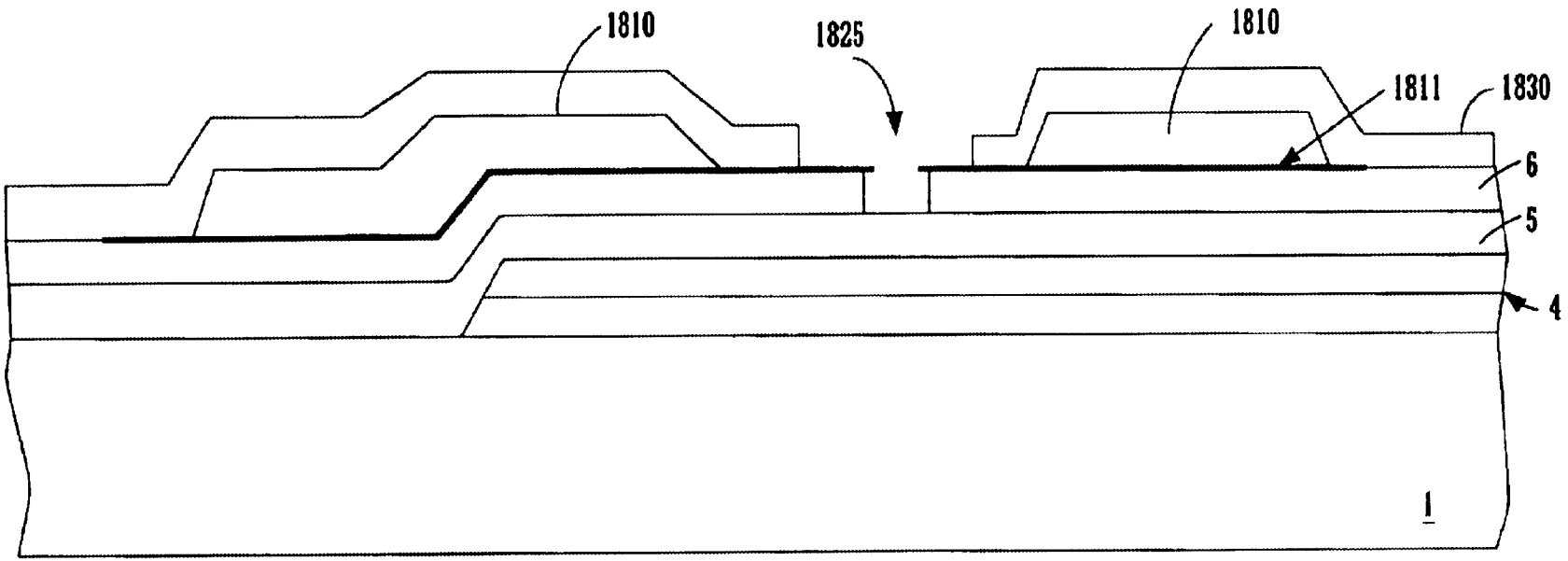
FIG. 18G is a side sectional view of a display device showing the structure of FIG. 18E after the deposition of a passivation layer and after mask and etch steps have been performed in accordance with one embodiment of the present claimed invention.
Figure 18H:
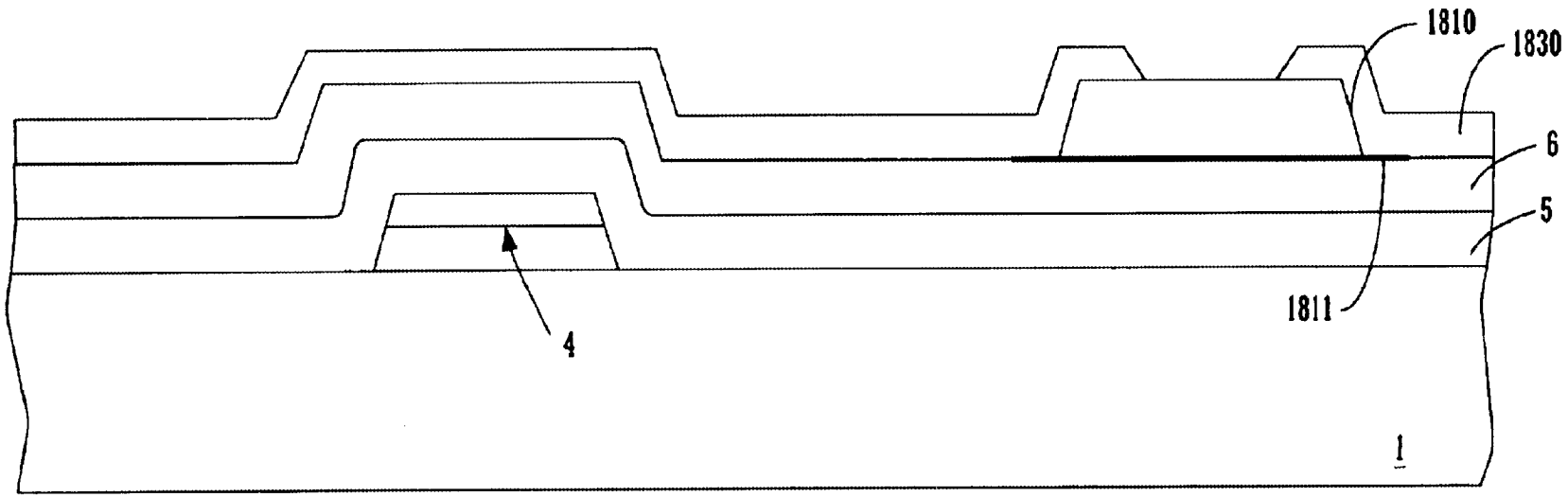
FIG. 18H is a side sectional view of a display device showing the structure of FIG. 18F after the deposition of a passivation layer and after mask and etch steps have been performed in accordance with one embodiment of the present claimed invention.
Figure 18I:
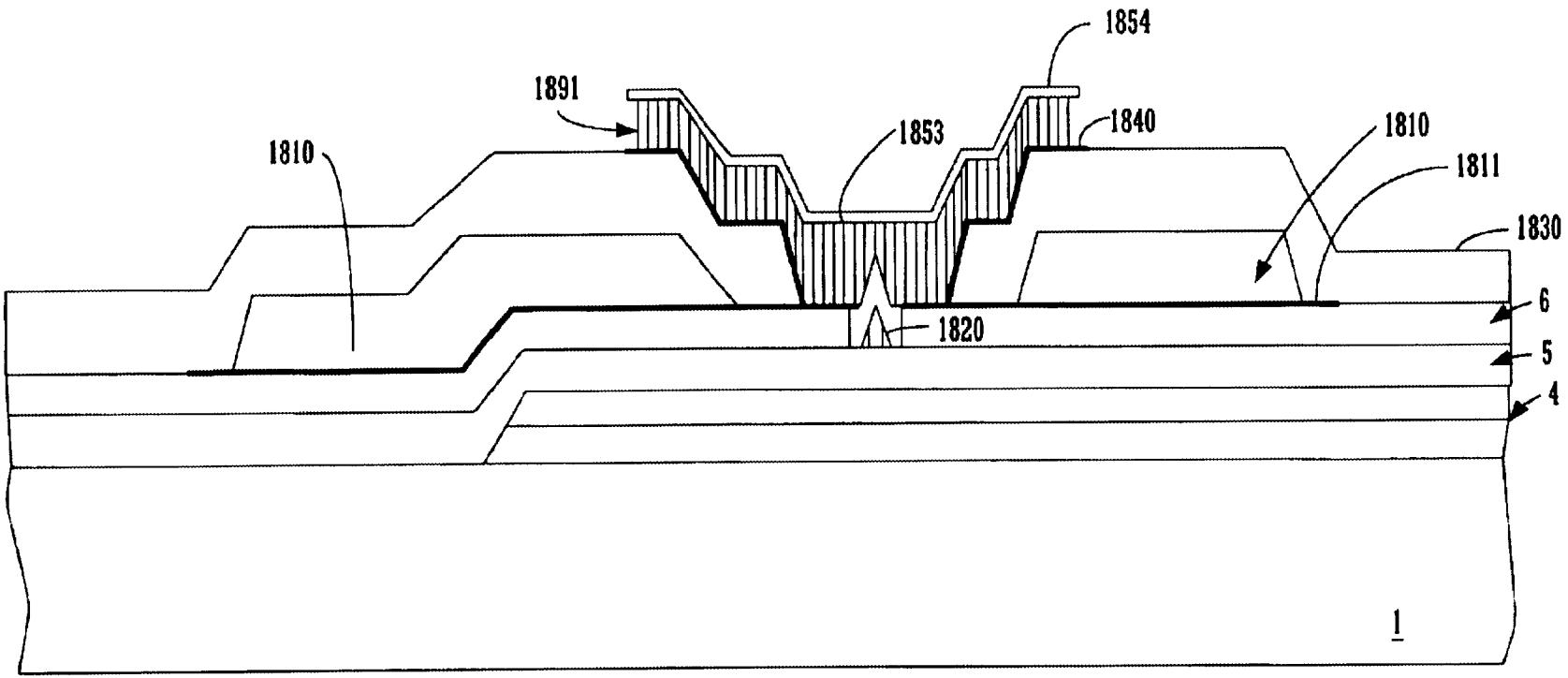
FIG. 18I is a side sectional view of a display device showing the structure of FIG. 18G after evaporation of a chromium layer and deposition of cone material, deposition of a layer of dielectric material, and mask and etch steps have been performed in accordance with one embodiment of the present claimed-invention.
Figure 18J:
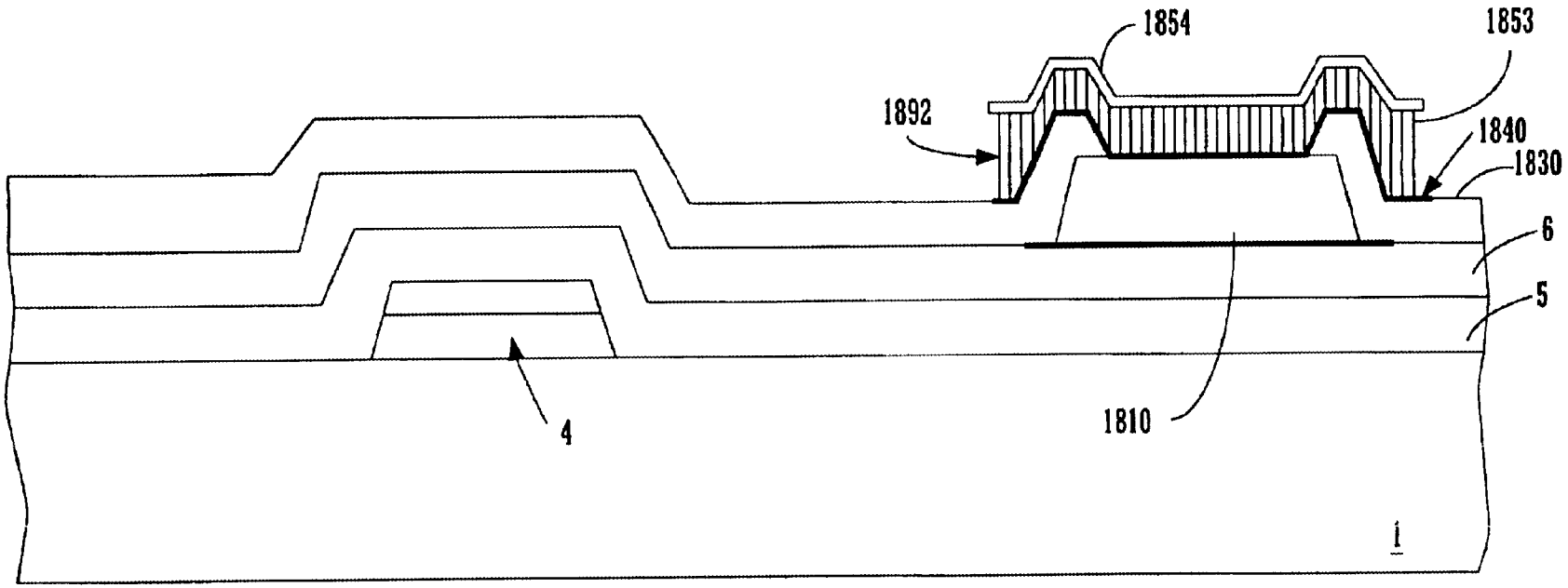
FIG. 18J is a side sectional view of a display device showing the structure of FIG. 18H after evaporation of a chromium layer and deposition of cone material, deposition of a layer of dielectric material, and mask and etch steps have been performed in accordance with one embodiment of the present claimed invention.

Referring now to step 208 of FIG. 17, mask and etch steps are performed. Referring now to FIGS. 18E–18F, the structure of FIGS. 18C–18D is shown after a passivation layer is deposited, masked and etched to form openings 1820 and 1821 that extend through passivation layer 1830. In one embodiment of the present invention, cavity 1825 is also formed using a HALO etch. It can be seen that passivation layer 1830 extends over upper electrode 1810 except at opening 1820.

Figure 18K:
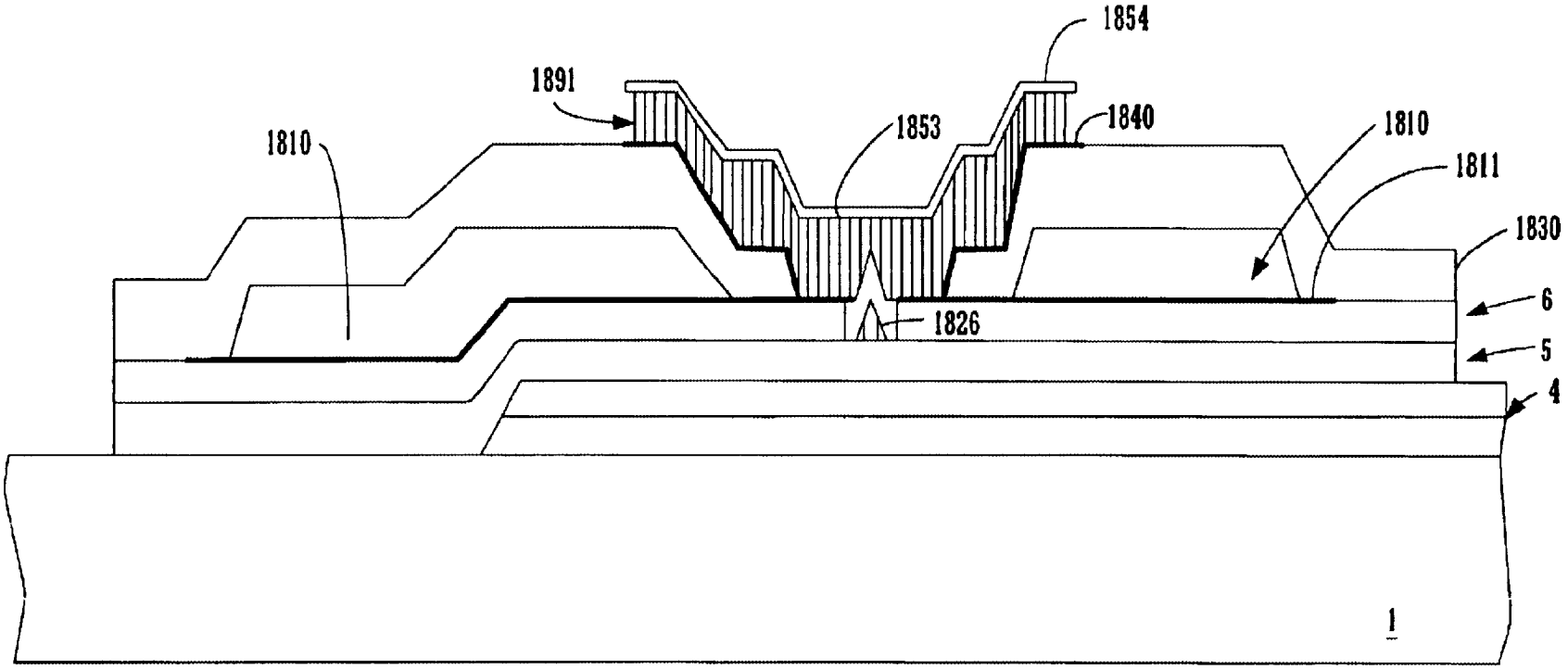
FIG. 18K is a side sectional view of a display device showing the structure of FIG. 18I after mask and etch steps have been performed in accordance with one embodiment of the present claimed invention.
Figure 18L:
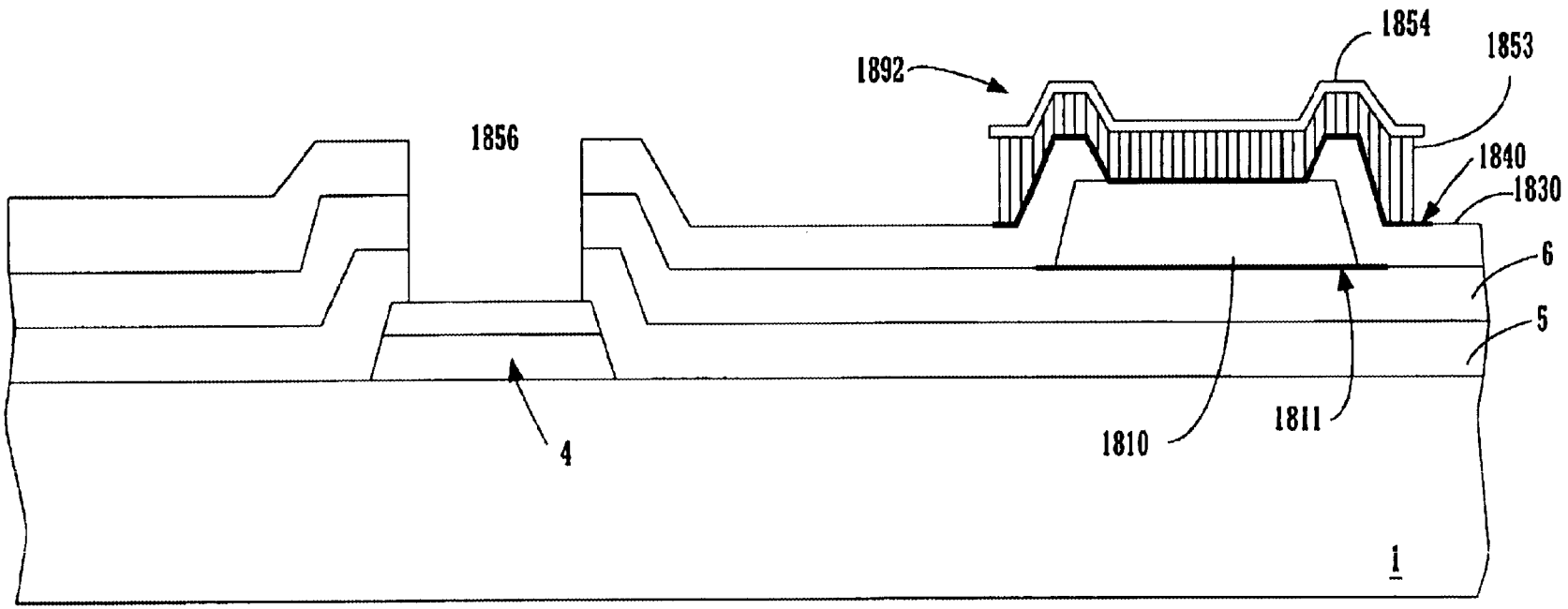
FIG. 18L is a side sectional view of a display device showing the structure of FIG. 18J after mask and etch steps have been performed in accordance with one embodiment of the present claimed invention.
Figure 18M:
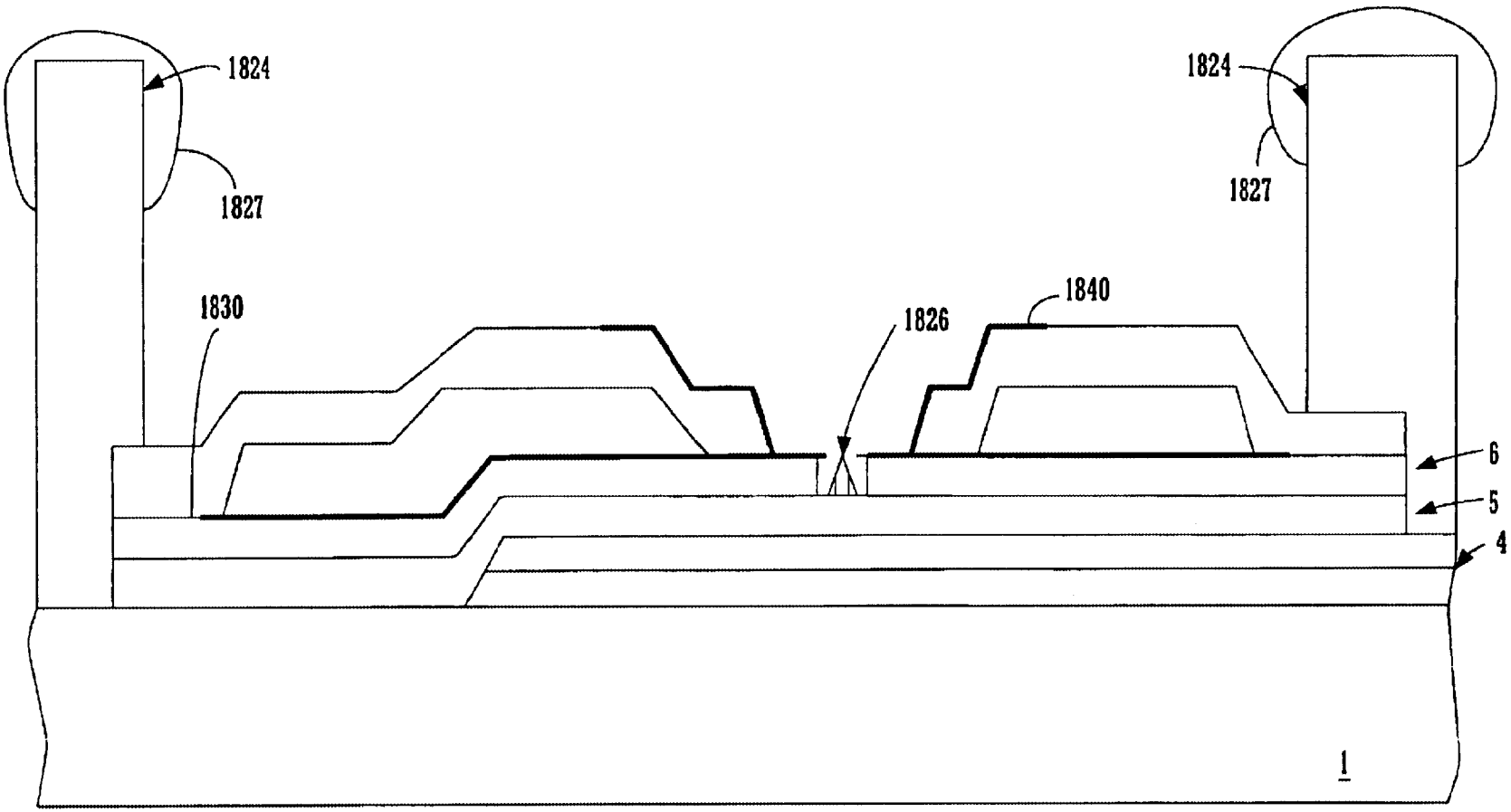
FIG. 18M is a side sectional view of a display device showing a completed cathode structure in accordance with one embodiment of the present claimed invention.
Figure 18N:
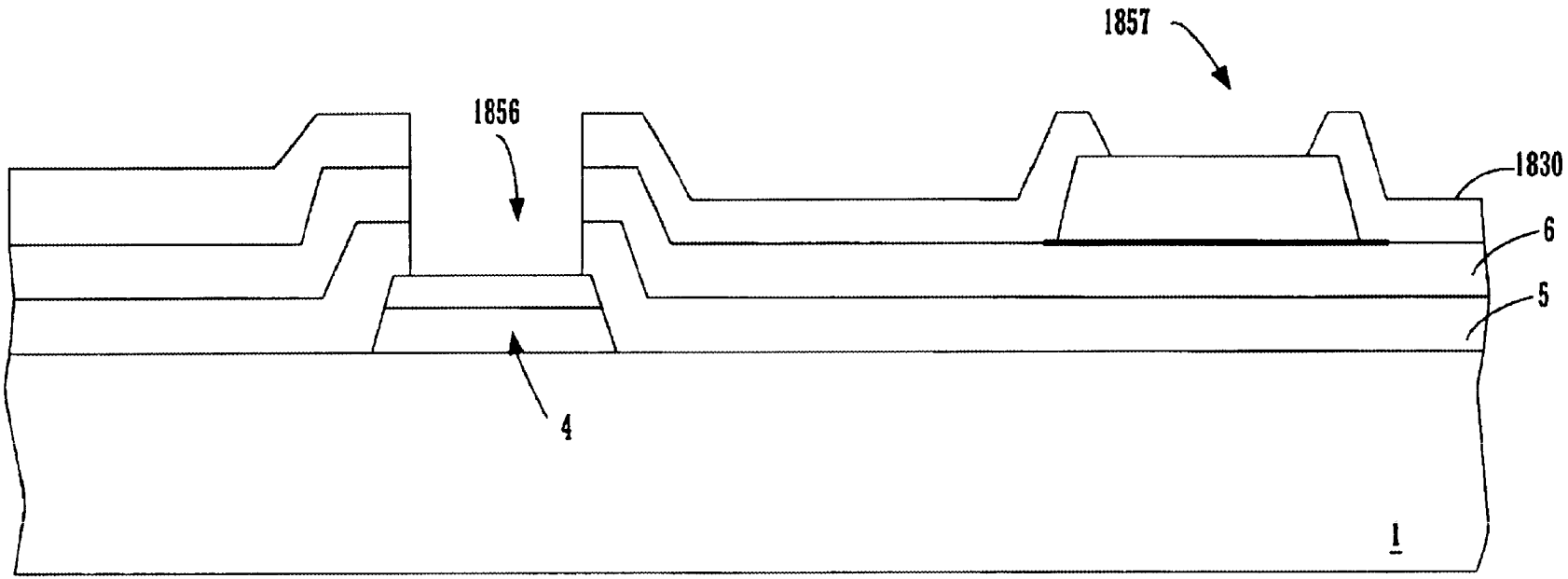
FIG. 18N is a side sectional view of a display device showing a completed cathode structure in accordance with one embodiment of the present claimed invention.

The cathode structure is then completed as shown by step 209 of FIG. 17. FIGS. 18G–18N illustrate an exemplary method for completing the cathode in accordance with one embodiment of the present invention. Mask and etch steps are performed to form a cavity, shown in FIG. 18G as cavity 1825. A layer of chromium is evaporated over the structure, followed by the deposition of cone material and the deposition of a dielectric layer. The resulting structure is then patterned and etched so as to produce the structure shown in FIGS. 18I–18J. More particularly, cone 1826 and structures 1891 and 1892 are formed. Structures 1891 and 1892 include cone material 1853, chromium material 1840 and dielectric material 1854. Mask and etch steps then form openings that expose portions of lower electrode 4 so as to form lower contact pad 1856 as shown in FIGS. 18K–18L. Dielectric removal steps and a halo etch are then performed, followed by formation of polyimide structures and focus waffle metal. FIGS. 18M–18N show a completed cathode structure that includes upper contact pad 1857, focusing structures 1824 and focus waffle metal 1827. In an alternate embodiment of the present invention (not shown) mask and etch steps do not form structure 1892. That is, only structure 1891 is formed.

During the process steps for completion of the cathode, upper electrode 1810 is protected by passivation layer 1830. This prevents damage to upper electrode 1810 as typically occurs in prior art processes. By preventing damage to upper electrode 1810, upper electrode shorts and opens are prevented. In addition, because upper electrode 1810 is protected, column shorts in the frit seal region are eliminated. Also, because there is less exposed metal as compared with prior art processes, column to focus waffle shorts are decreased.

Figure 19:
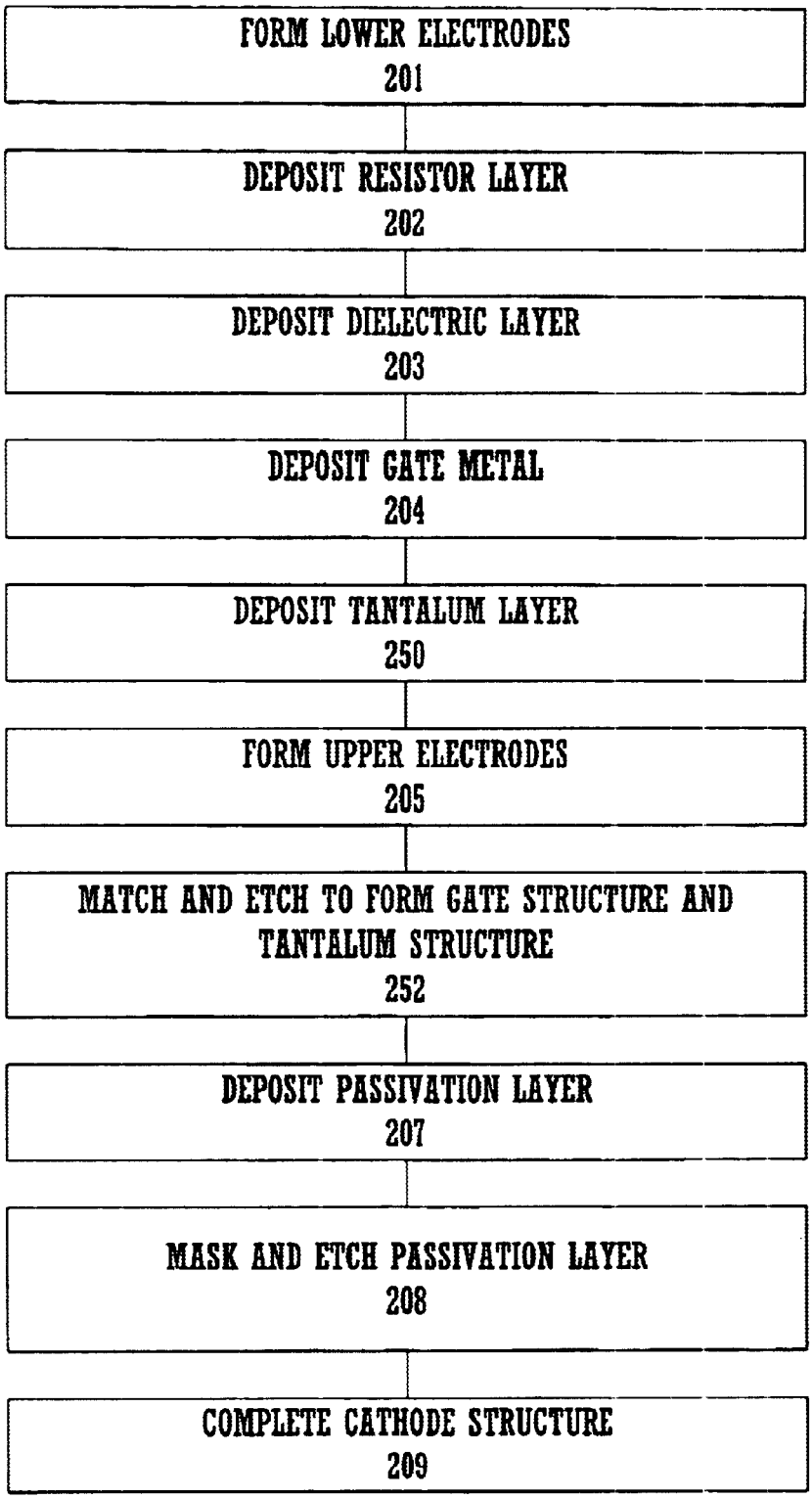
FIG. 19 is a diagram showing a method for forming an electrode structure of a display device in accordance with one embodiment of the present invention.

With reference now to FIG. 19, yet another method for forming an electrode structure for a display device is shown. As shown by step 201 lower electrodes are formed over a substrate. A resistor layer and a dielectric layer are then deposited over the lower electrodes as shown by steps 202–203.

Continuing with FIG. 19, gate metal is deposited as is shown by step 204. In one embodiment, chromium is used as a gate metal.

Referring still to FIG. 19, a tantalum layer is deposited as shown by step 250. Upper electrodes are then formed as shown by step 205. In the present embodiment, upper electrodes are formed using an aluminum alloy. In one embodiment, the metal alloy has a thickness of 500–5000 Angstroms. In one specific embodiment, an aluminum alloy is used that includes aluminum (Al) and Neodymium (Nd). In the present embodiment, the aluminum alloy has an concentration of from 0.5 to 6 atomic percent Nd. In another embodiment, an aluminum alloy is used that has a concentration of from 0.5 to 6 atomic percent Nd and from 0 to 5 atomic percent titanium (Ti).

FIGS. **18*a*–18*b* show substrate 1 after steps 201–205 and 250 have been performed, forming a gate metal layer 1801, a tantalum layer 1802, and upper electrodes 1810. In one embodiment, lower electrode 4 is a row electrode and upper electrode 1810 is a column electrode. However, alternatively, the present invention is well adapted to use of lower electrode 4 as a column electrode and upper electrode 1810** as a row electrode.

Figure 20A:
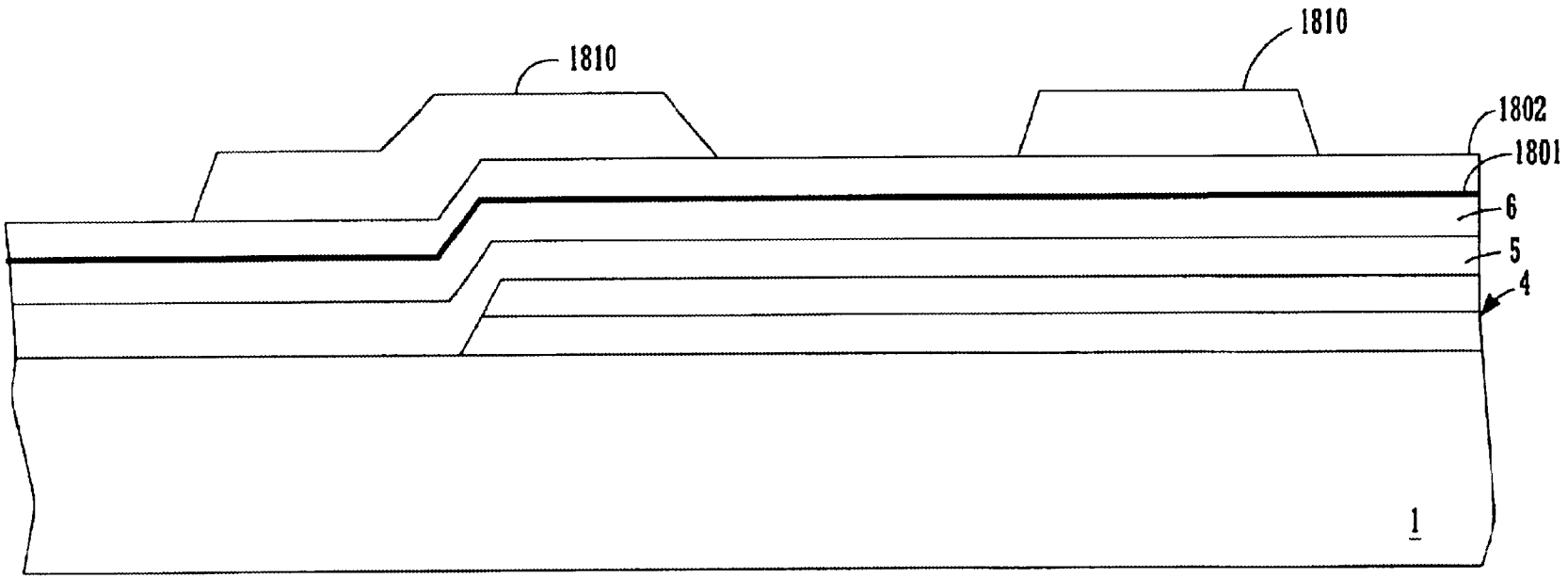
FIG. 20A is a side sectional view of a display device showing a backplate over which lower and upper electrodes are formed and having a resistor layer, a dielectric layer, a tantalum layer, and a gate layer in accordance with one embodiment of the present claimed invention.
Figure 20B:
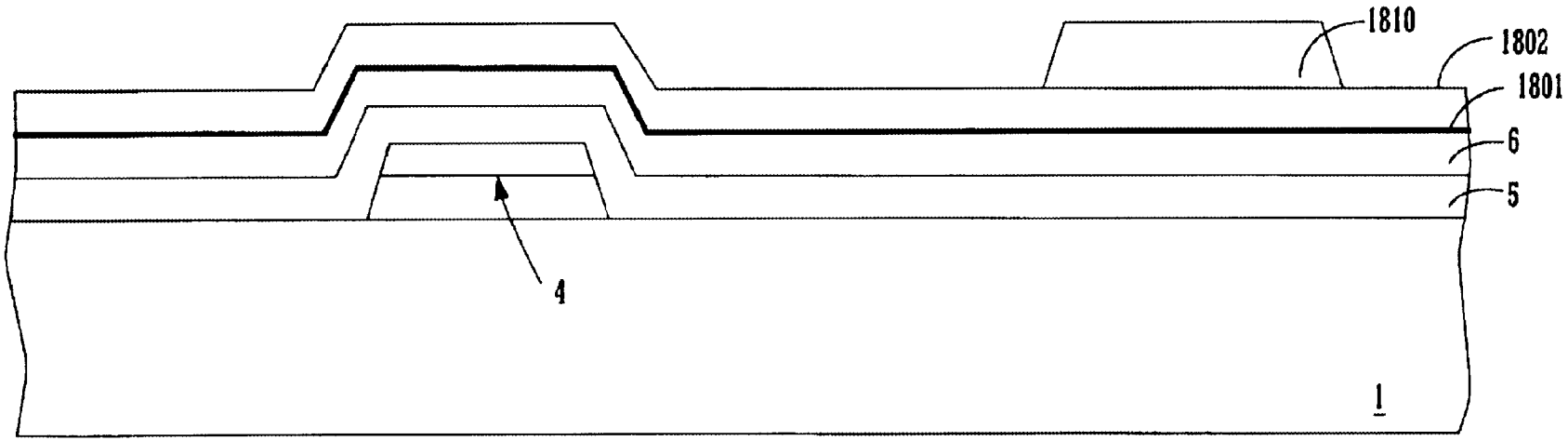
FIG. 20B is a side sectional view of a display device showing a backplate over which lower and upper electrodes are formed and having a resistor layer, a dielectric layer, a tantalum layer and a gate layer in accordance with one embodiment of the present claimed invention.
Figure 20C:
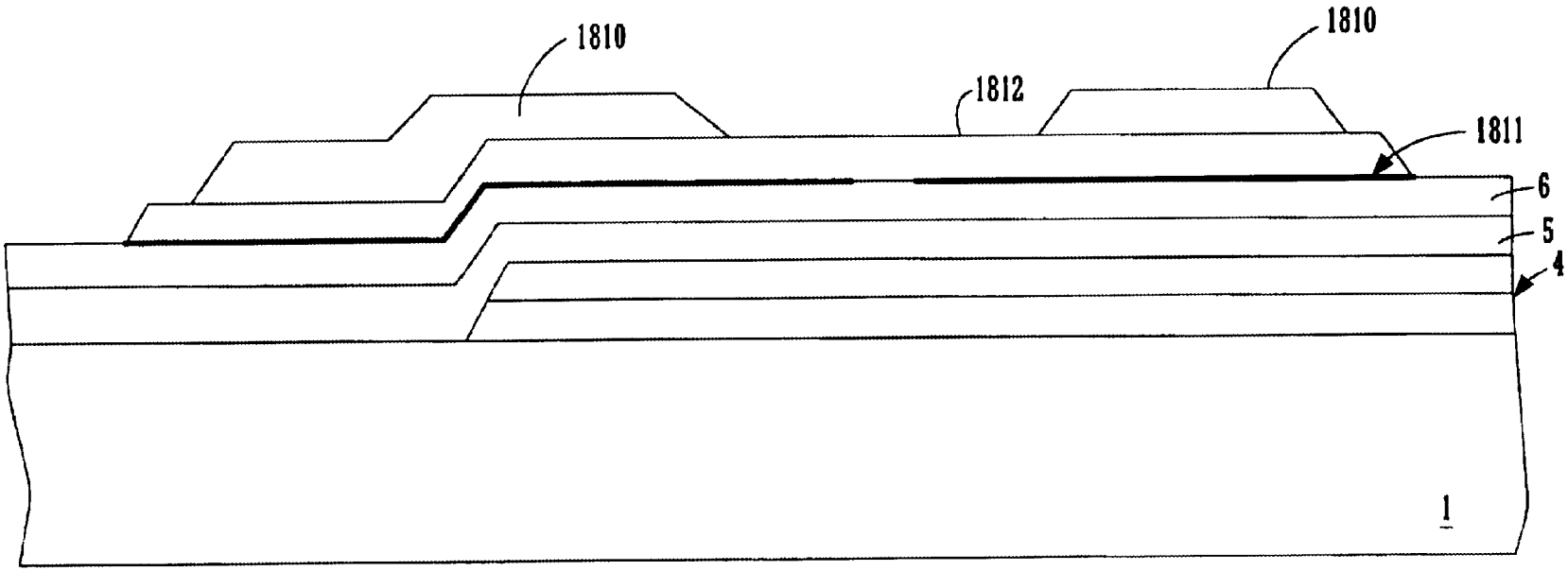
FIG. 20C is a side sectional view of a display device showing the structure of FIG. 20A after mask and etch steps have formed a tantalum structure and a gate structure in accordance with one embodiment of the present claimed invention.
Figure 20D:
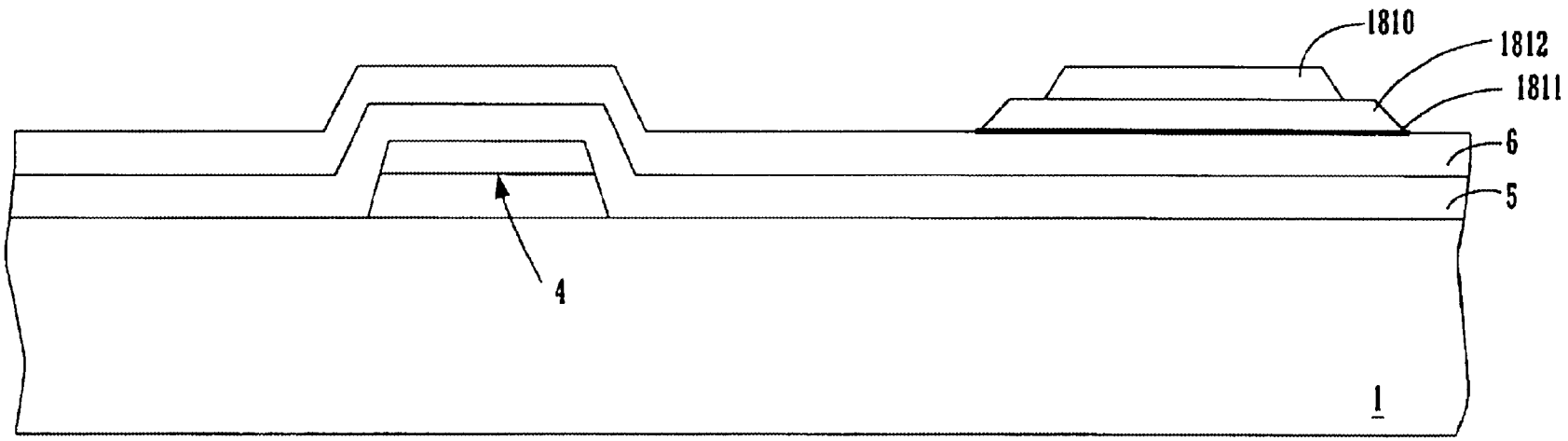
FIG. 20D is a side sectional view of a display device showing the structure of FIG. 20B after mask and etch steps have formed a tantalum structure and a gate structure in accordance with one embodiment of the present claimed invention.

Referring back to FIG. 19, as shown by step 252, mask and etch steps are then performed so as to selectively etch tantalum layer 1802 and gate metal layer 1801 of FIGS. 20A–20B. More particularly, in the present embodiment, photoresist is deposited over the backplate and is patterned. The backplate is then etched using a wet etch process. FIGS. 20C–20D show the structure of FIGS. 20A–20B after mask and etch steps have formed gate metal structure 1811 and tantalum structure 1812.

Referring now to step 207 of FIG. 19, a passivation layer is deposited. In one embodiment, the passivation layer is silicon nitride deposited using a plasma enhanced chemical vapor deposition process.

Figure 20E:
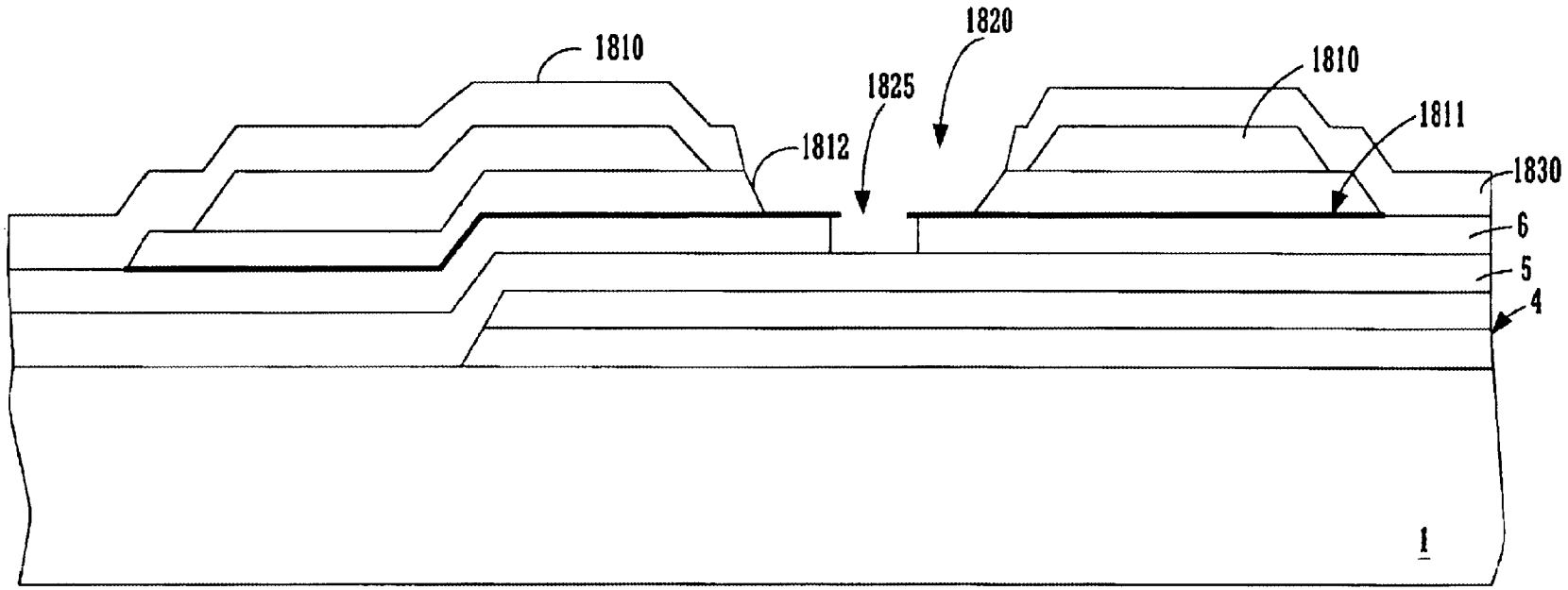
FIG. 20E is a side sectional view of a display device showing the structure of FIG. 20C after the deposition of a passivation layer and after mask and etch steps have been performed in accordance with one embodiment of the present claimed invention.
Figure 20F:
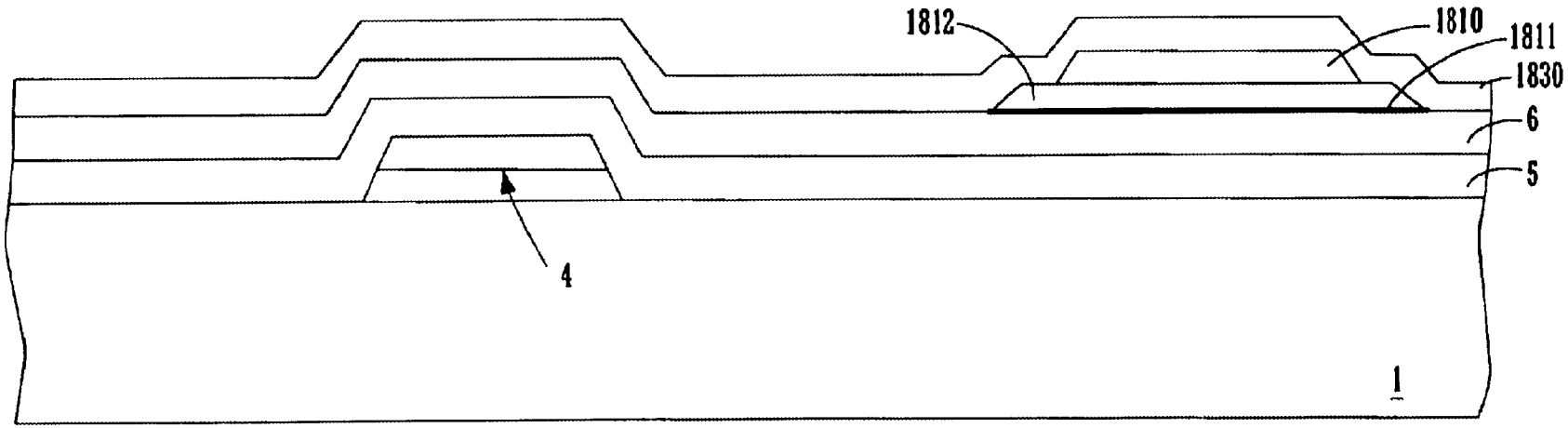
FIG. 20F is a side sectional view of a display device showing the structure of FIG. 20D after the deposition of a passivation layer and after mask and etch steps have been performed in accordance with one embodiment of the present claimed invention.
Figure 20G:
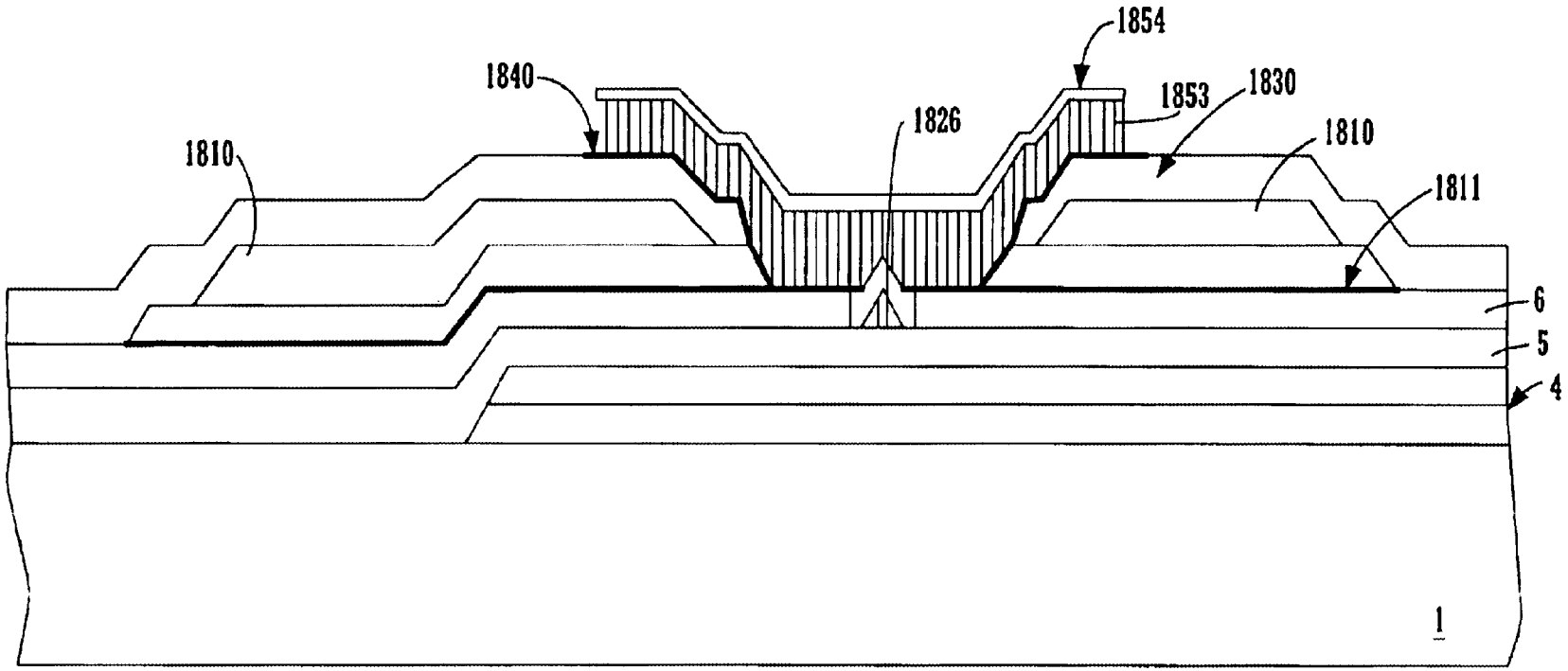
FIG. 20G is a side sectional view of a display device showing the structure of FIG. 20E after evaporation of a chromium layer and deposition of cone material, deposition of a layer of dielectric material, and mask and etch steps have been performed in accordance with one embodiment of the present claimed invention.
Figure 20H:
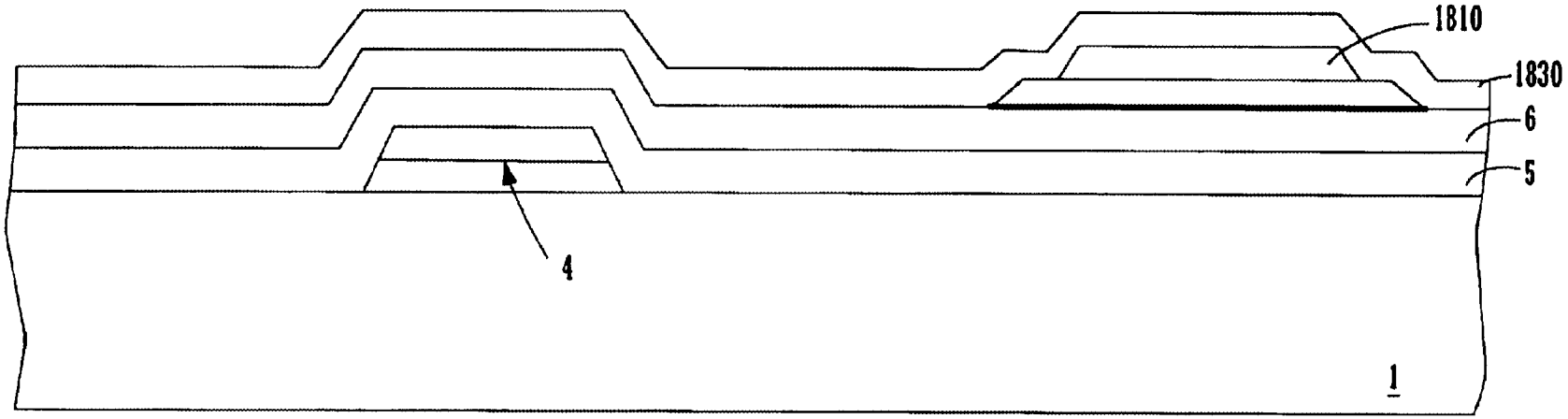
FIG. 20H is a side sectional view of a display device showing the structure of FIG. 20F after evaporation of a chromium layer and deposition of cone material, deposition of a layer of dielectric material, and mask and etch steps have been performed in accordance with one embodiment of the present claimed invention.

Referring now to step 208 of FIG. 19, mask and etch steps are performed. Referring now to FIGS. 20E–20F, the structure of FIGS. 20C–20D is shown after a passivation layer is deposited, masked and etched to formed opening 1820 that extends through passivation layer 1830 and tantalum structure 1812. In one embodiment of the present invention, a halo etch is also performed, forming cavity 1825. It can be seen that passivation layer 1830 extends over upper electrode 1810 except at opening 1820. Passivation layer 1830 protects upper electrode 1810 during subsequent process steps.

Figure 20I:
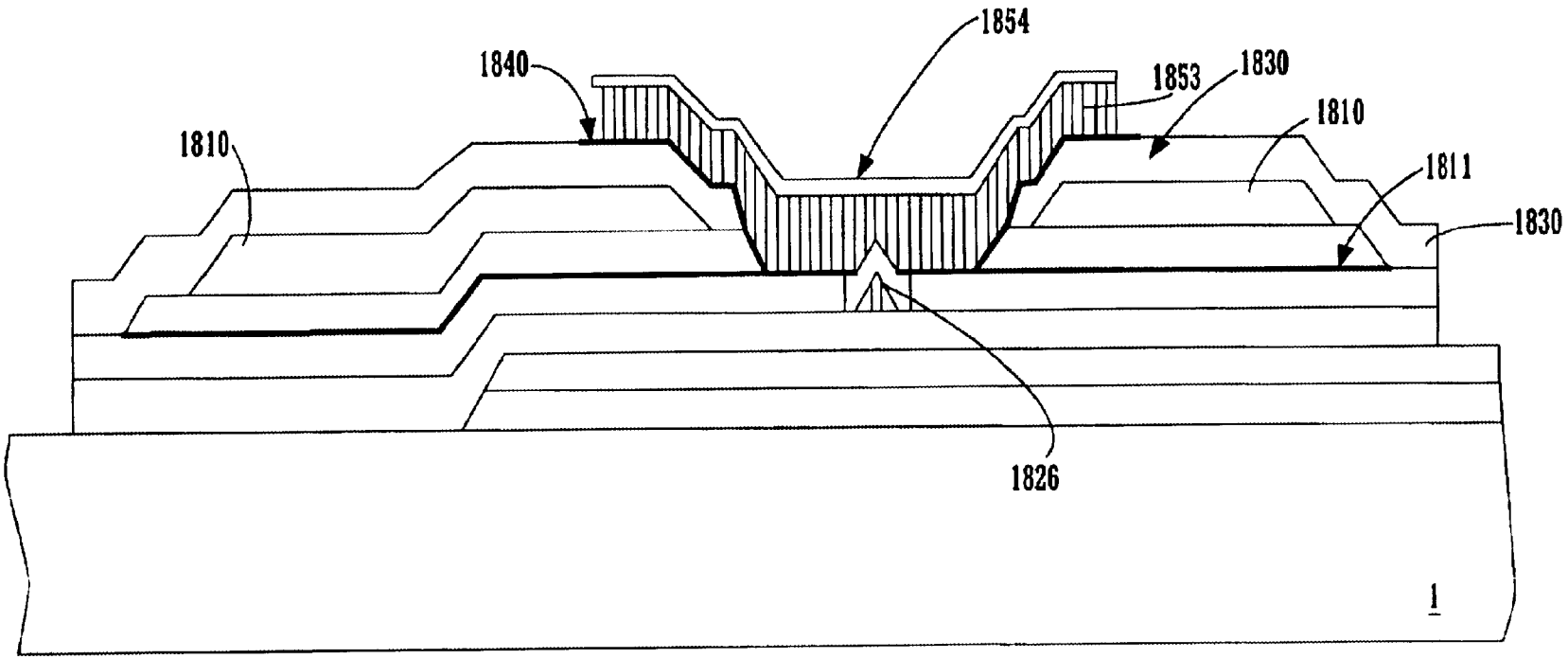
FIG. 20I is a side sectional view of a display device showing the structure of FIG. 20G after mask and etch steps have been performed in accordance with one embodiment of the present claimed invention.
Figure 20J:
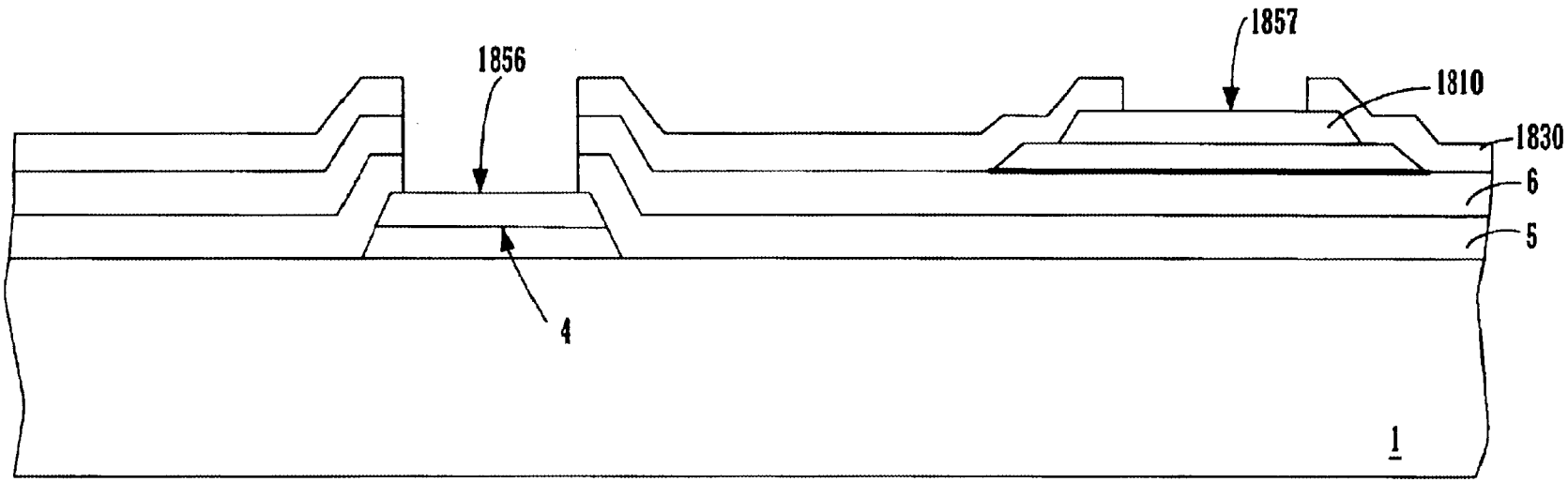
FIG. 20J is a side sectional view of a display device showing the structure of FIG. 20H after mask and etch steps have been performed in accordance with one embodiment of the present claimed invention.
Figure 20K:
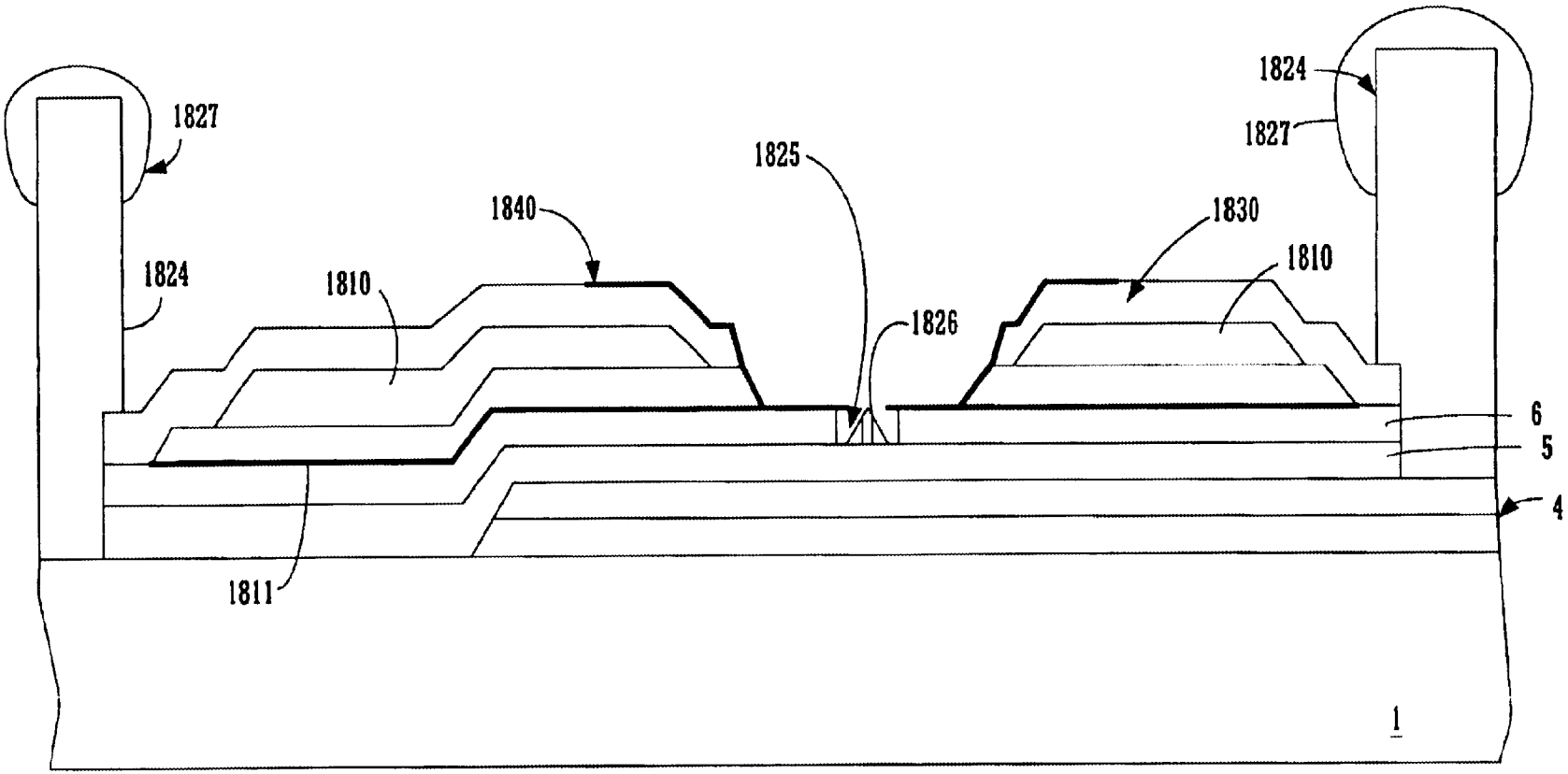
FIG. 20K is a side sectional view of a display device showing a completed cathode structure in accordance with one embodiment of the present claimed invention.
Figure 20L:
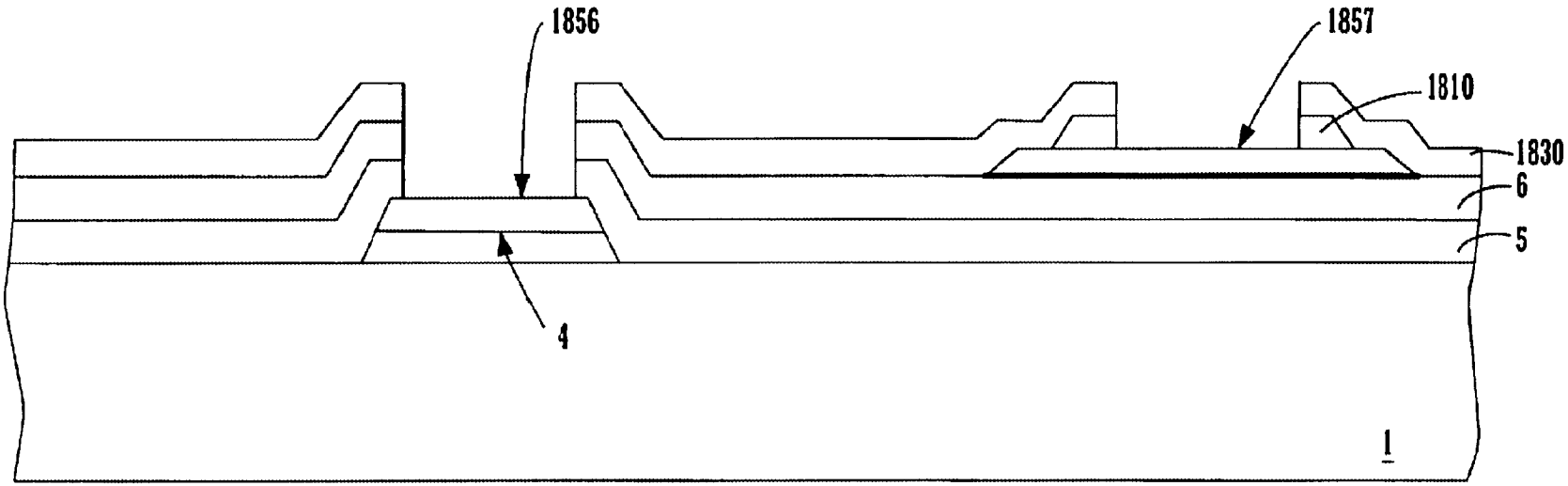
FIG. 20L is a side sectional view of a display device showing a completed cathode structure in accordance with one embodiment of the present claimed invention.

The cathode structure is then completed as shown by step 209 of FIG. 19. FIGS. 20G–20L illustrate an exemplary method for completing the cathode structure in accordance with one embodiment of the present invention. A layer of chromium is evaporated over the structure, followed by the deposition of cone material and the deposition of a dielectric layer. The resulting structure is then patterned and etched so as to produce the structure shown in FIGS. 20G–20H. The structure of FIGS. 20G–20H includes dielectric material 1854, cone 1826, cone material 1853 and chromium segment 1840. In one embodiment, cone material 1853 is evaporated molybdenum. However, the present invention is well adapted for use of other materials for forming cone 1826. Mask and etch steps then form openings 1856–1857 that expose portions of lower electrode 4 and upper electrode 1810 so as to form lower contact pad 1823 and upper contact pad 1822 as shown in FIGS. 20I–20J. Dielectric removal steps and a halo etch are then performed, followed by formation of polyimide structures and focus waffle metal. FIGS. 20K–20L show a completed cathode structure that includes polyimide structures 1824 and focus waffle metal 1827.

During the process steps for completion of the cathode, upper electrode 1810 is protected by passivation layer 1830. This prevents damage to upper electrode 1810 as typically occurs in prior art processes. By preventing damage to upper electrode 1810, upper electrode shorts and opens are prevented. In addition, because upper electrode 1810 is protected, column shorts in the frit seal region are eliminated. Also, because there is less exposed metal as compared with prior art processes, column to focus waffle shorts are decreased.

Figure 21:
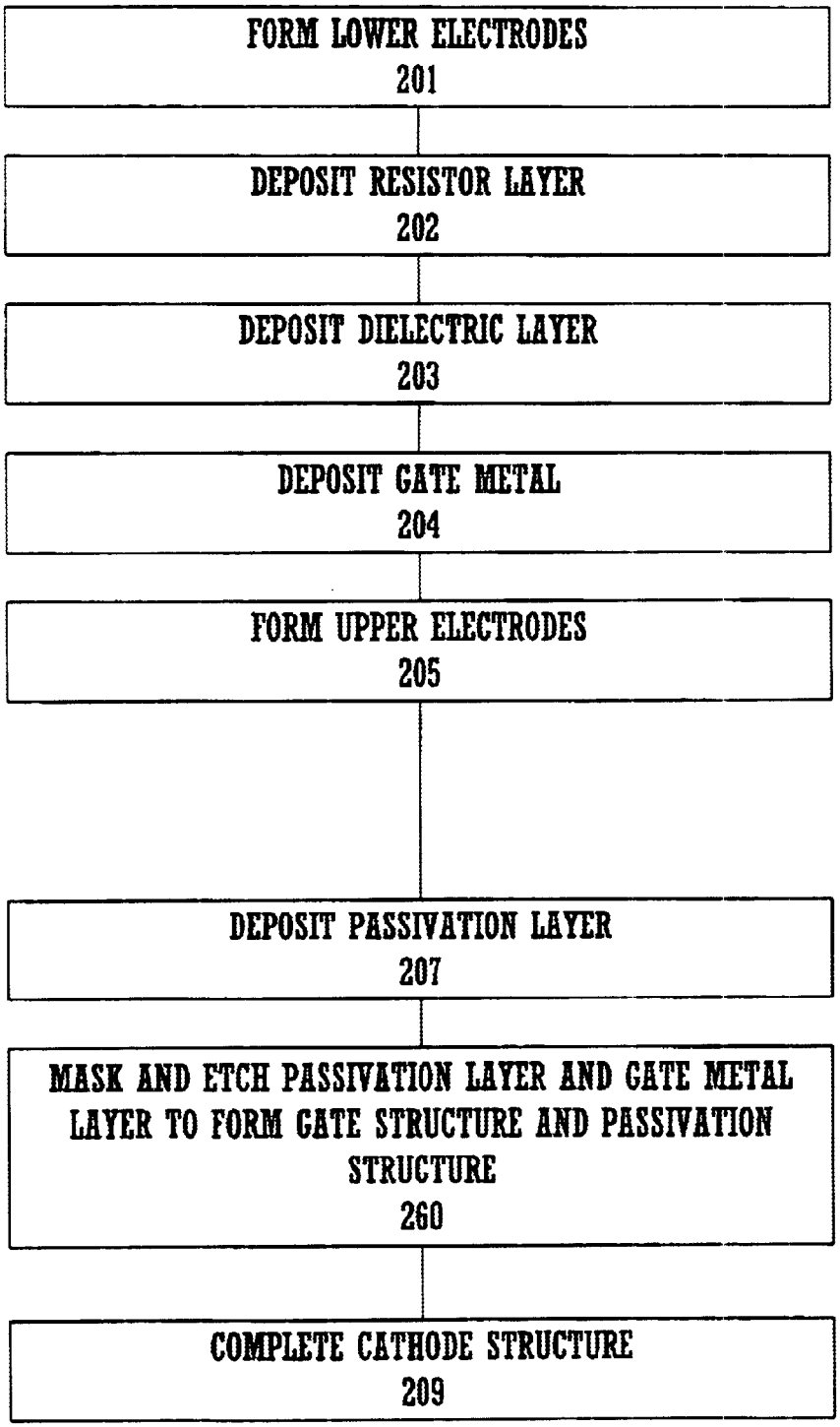
FIG. 21 is a diagram showing a method for forming an electrode structure of a display device in accordance with one embodiment of the present invention.

With reference now to FIG. 21, yet another method for forming an electrode structure for a display device is shown. As shown by steps 201, lower electrodes are formed over a substrate. A resistor layer and a dielectric layer are then deposited over the lower electrodes as shown by steps 202–203.

Continuing with FIG. 21, gate metal is deposited as is shown by step 204. In one embodiment, chromium is used as a gate metal. Upper electrodes are then formed as shown by step 205. In the present embodiment, upper electrodes are formed of an aluminum alloy. In one embodiment, steps 201–205 are identical to steps 201–205 of FIG. 17.

Figure 22A:
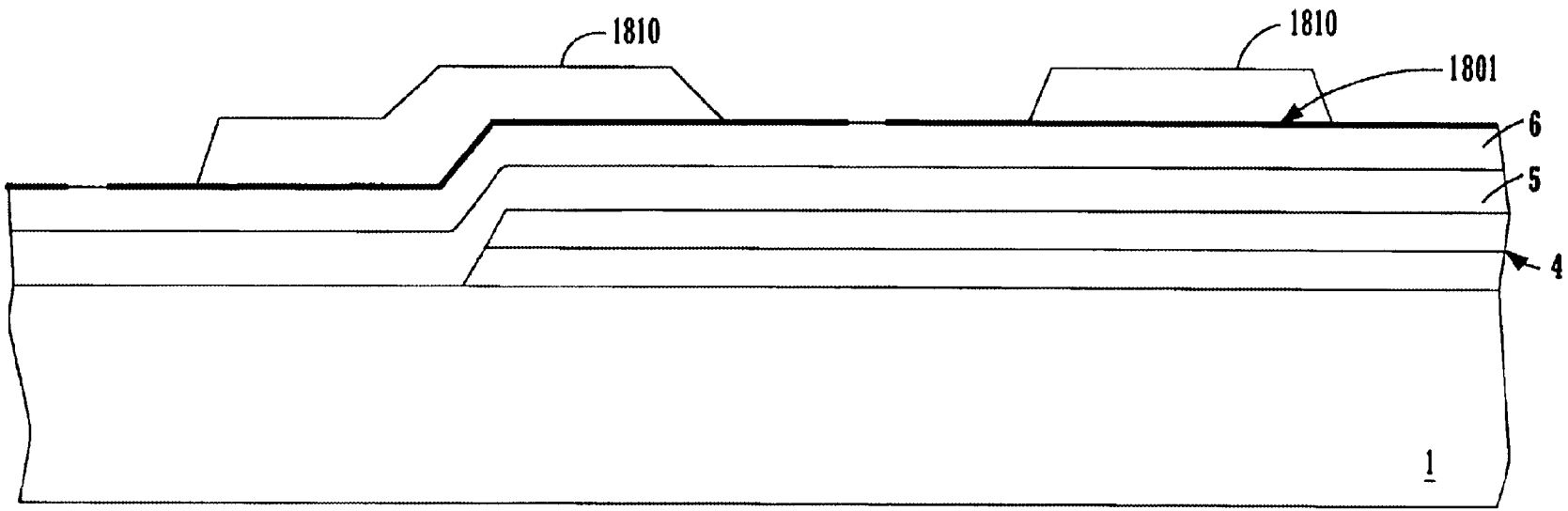
FIG. 22A is a side sectional view of a display device showing a backplate over which lower and upper electrodes are formed and having a resistor layer, a dielectric layer, and a gate layer in accordance with one embodiment of the present claimed invention.
Figure 22B:
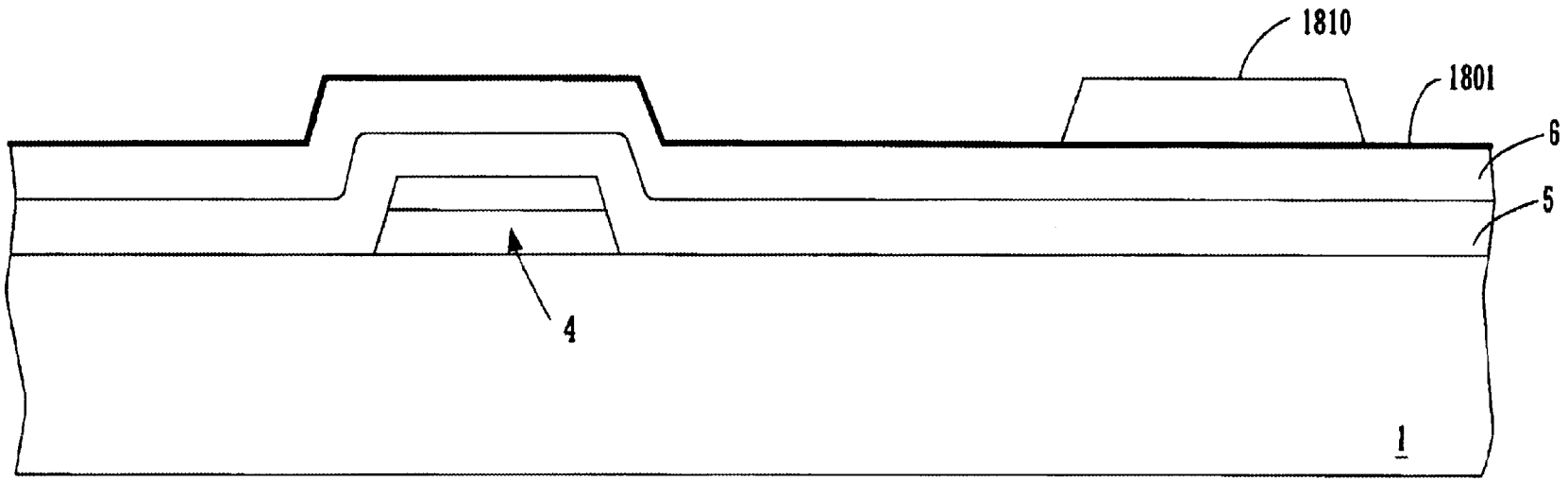
FIG. 22B is a side sectional view of a display device showing a backplate over which lower and upper electrodes are formed and having a resistor layer, a dielectric layer, and a gate layer in accordance with one embodiment of the present claimed invention.

Referring now to FIGS. 22A–22B, a substrate 1 is shown after steps 201–205 have formed a gate metal layer 1801 and upper electrodes 1810 that overlie dielectric layer 6, resistor layer 5 and lower electrode 4.

Referring now to step 207 of FIG. 21, a passivation layer is deposited. In one embodiment, the passivation layer is silicon nitride deposited using a plasma enhanced chemical vapor deposition process. Alternatively, a tantalum layer can be used.

Figure 22C:
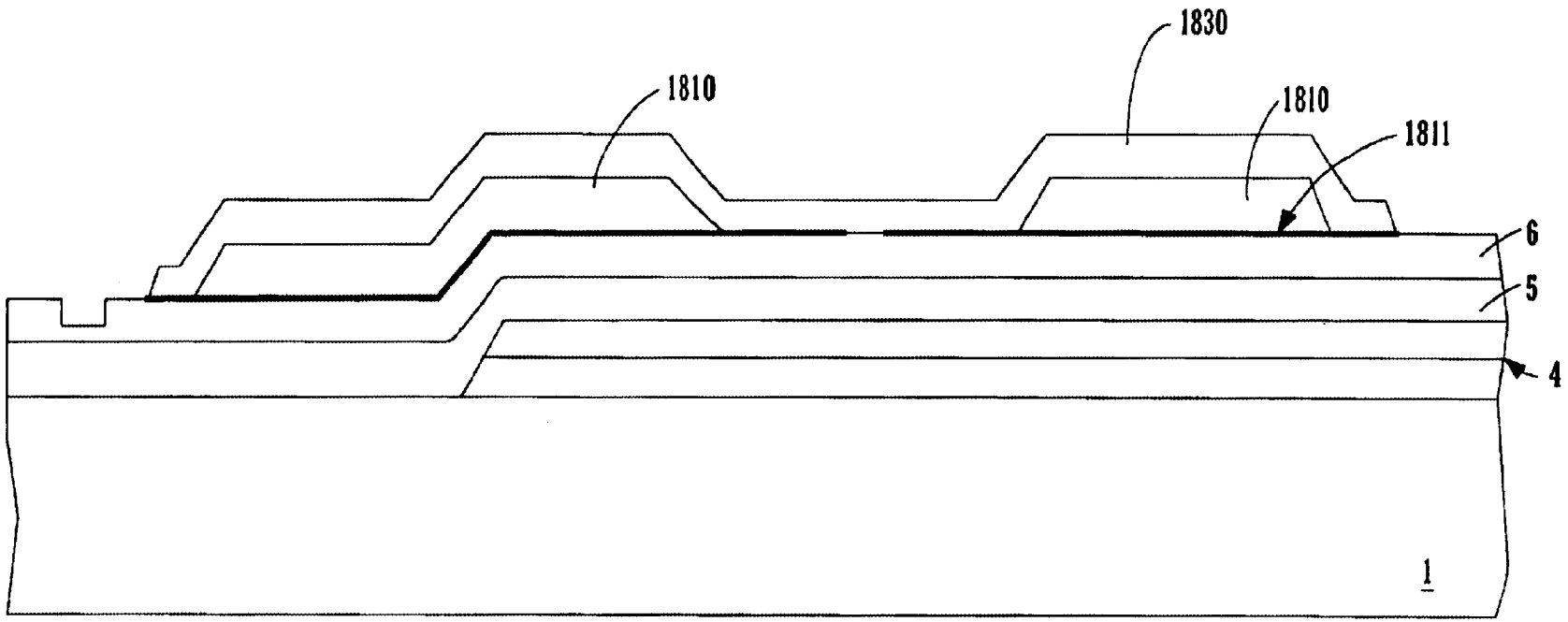
FIG. 22C is a side sectional view of a display device showing the structure of FIG. 22A after the deposition of a passivation layer and after mask and etch steps have been performed in accordance with one embodiment of the present claimed invention.
Figure 22D:
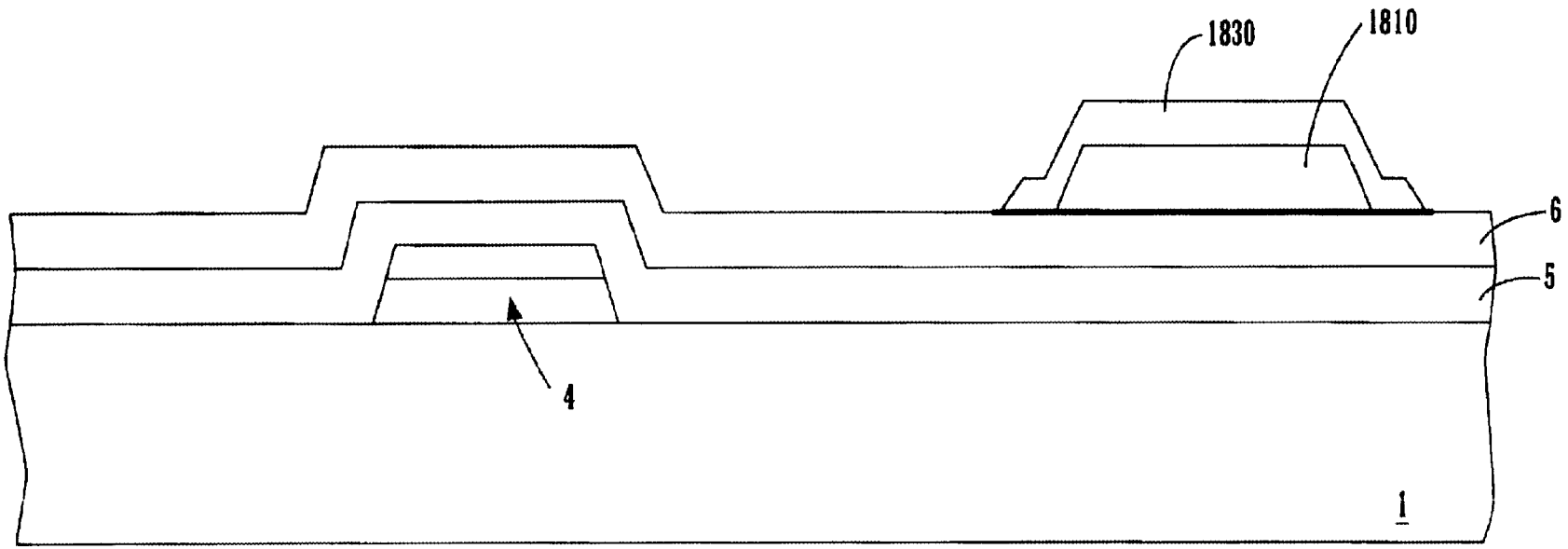
FIG. 22D is a side sectional view of a display device showing the structure of FIG. 22B after the deposition of a passivation layer and after mask and etch steps have been performed in accordance with one embodiment of the present claimed invention.
Figure 22E:
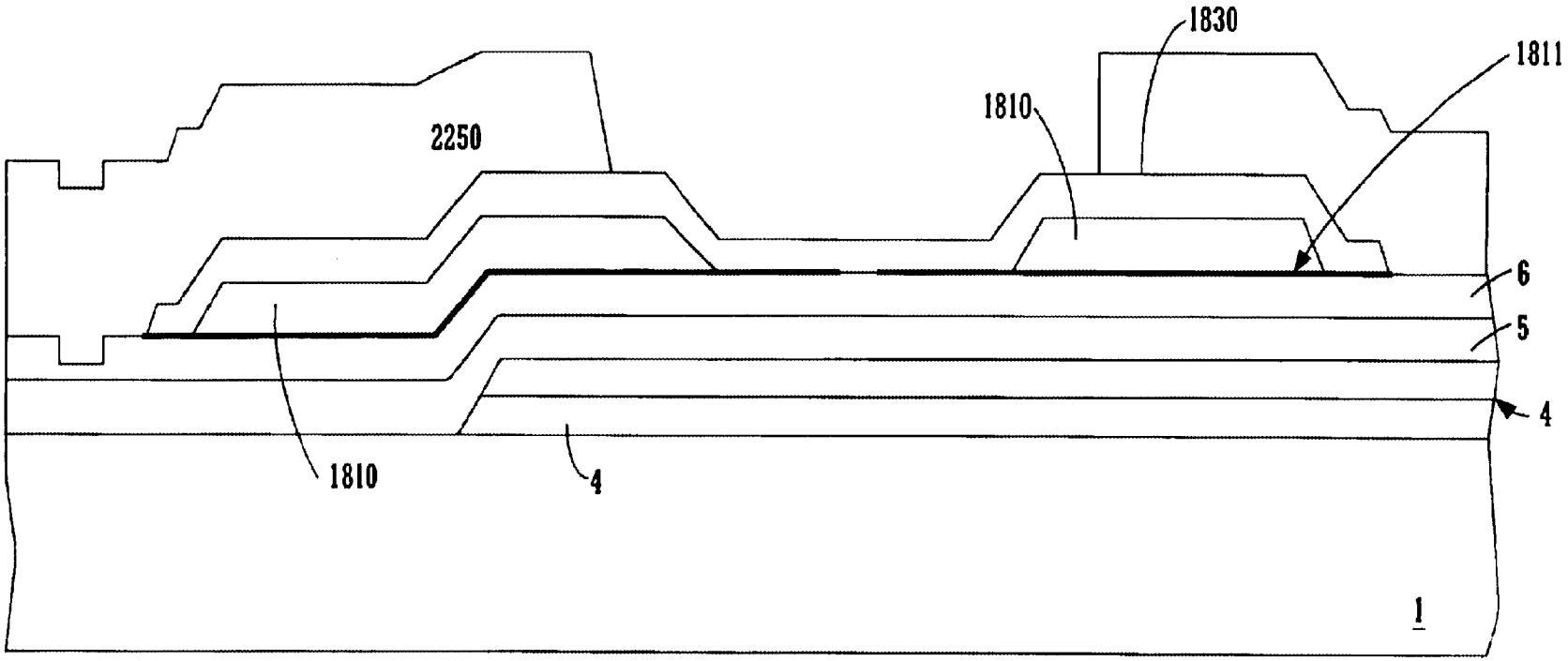
FIG. 22E is a side sectional view of a display device showing the structure of FIG. 22C after the deposition, mask and etch of a dielectric layer in accordance with one embodiment of the present claimed invention.
Figure 22F:
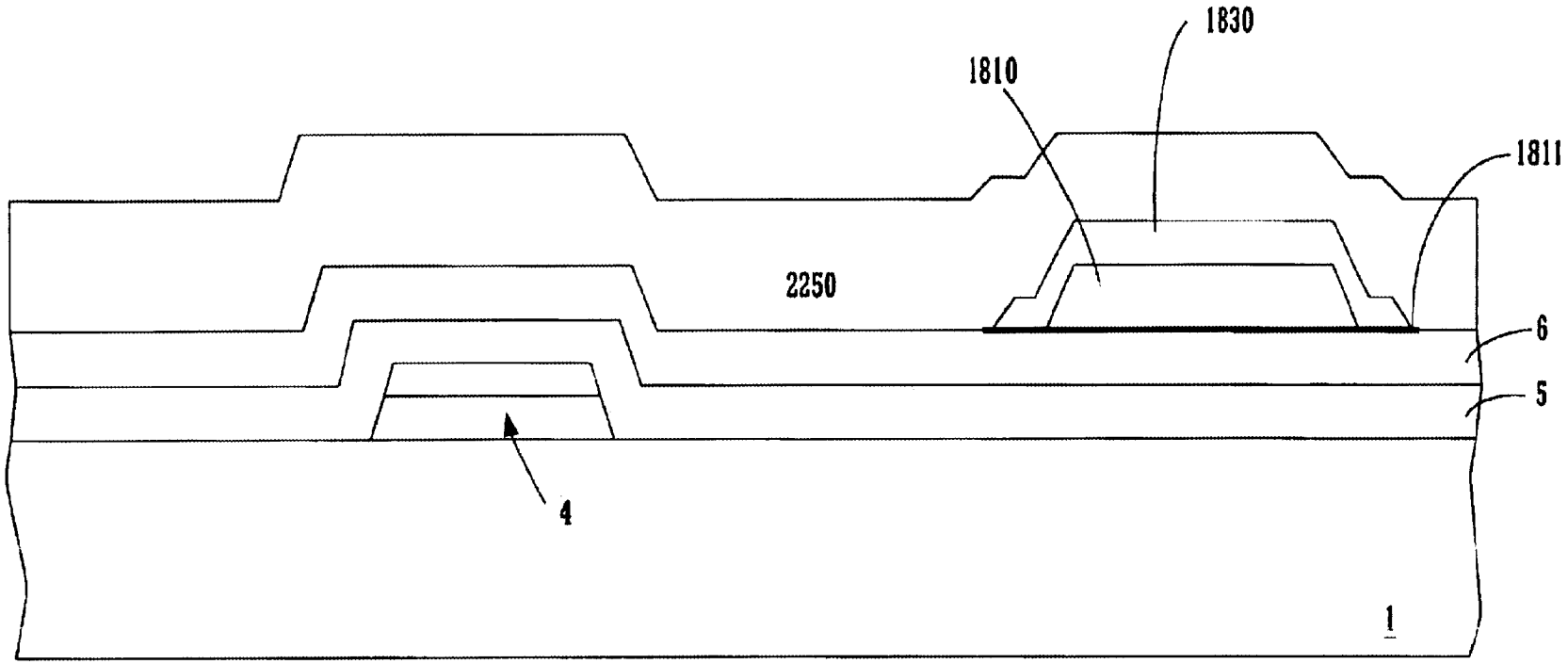
FIG. 22F is a side sectional view of a display device showing the structure of FIG. 22D after the deposition, mask and etch of a dielectric layer in accordance with one embodiment of the present claimed invention.

Referring back to FIG. 21, as shown by step 260, mask and etch steps are then performed. In one embodiment, a two step etch process is used whereby the passivation layer is etched using a first etch step and the gate metal layer is etched in a second etch step. The first mask and etch step etches through the passivation layer and etches through the gate metal layer. FIGS. 22C–22D show the structure of FIGS. 22A–22B after mask and etch steps have formed gate metal structure 1811 and passivation layer 1830.

Figure 22G:
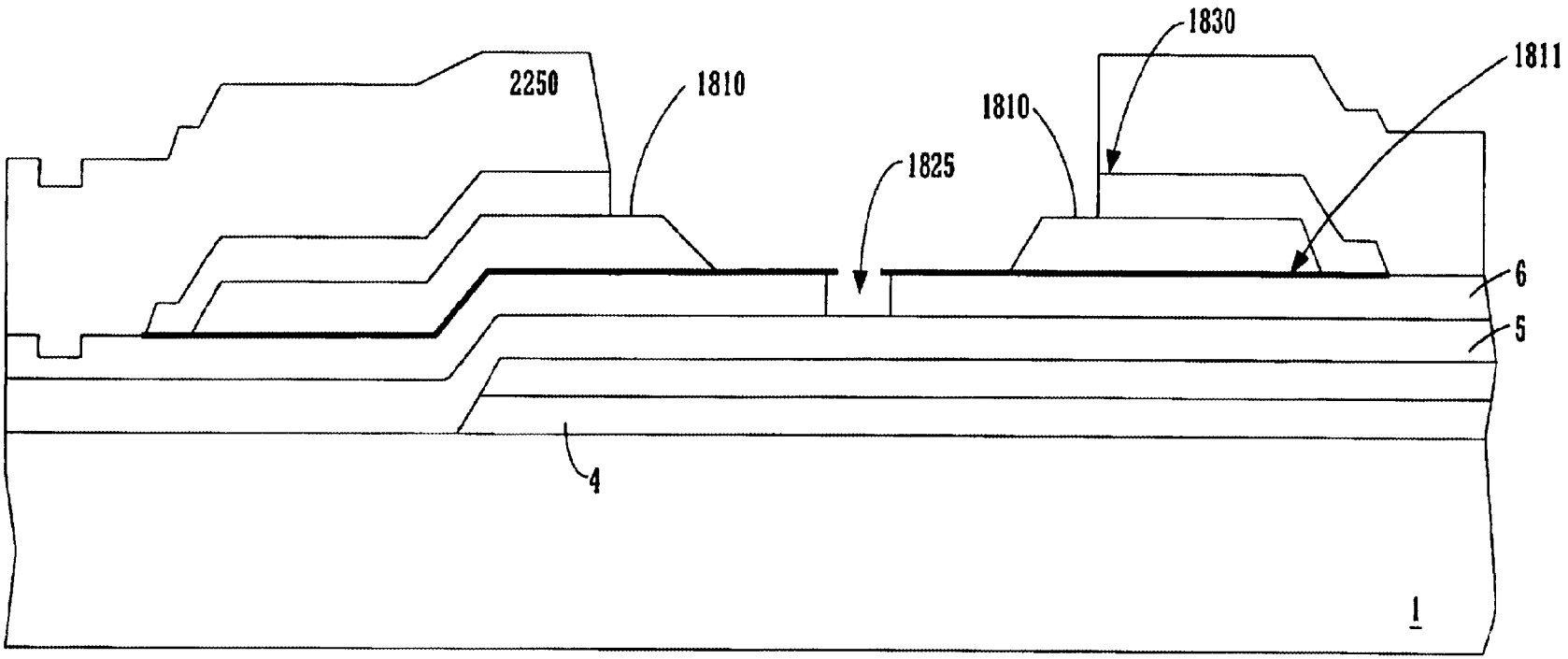
FIG. 22G is a side sectional view of a display device showing the structure of FIG. 22E after an etch step has been performed so as to form a cavity in accordance with one embodiment of the present claimed invention.
Figure 22H:
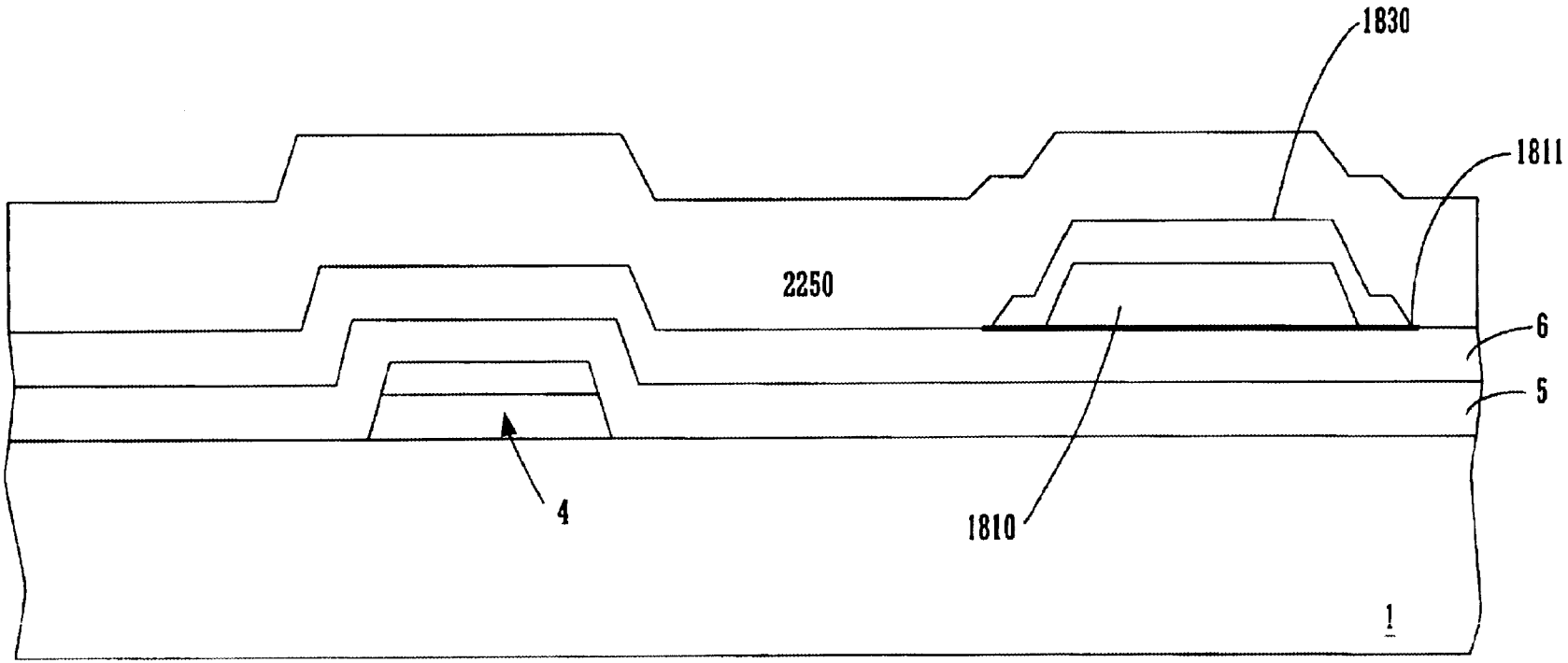
FIG. 22H is a side sectional view of a display device showing the structure of FIG. 22F after an etch step has been performed so as to form a cavity in accordance with one embodiment of the present claimed invention.
Figure 22I:
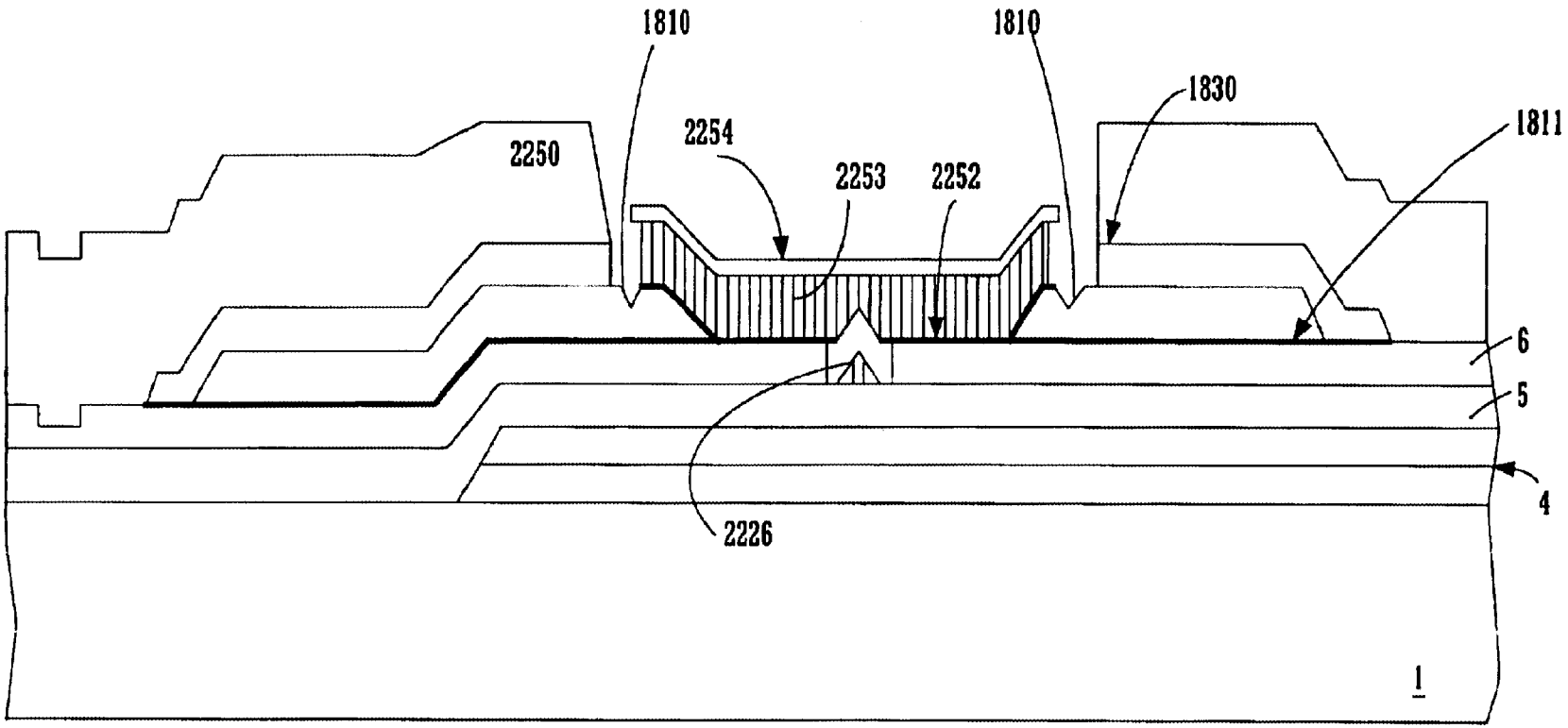
FIG. 22I is a side sectional view of a display device showing the structure of FIG. 22G after evaporation of a chromium layer and deposition of cone material, deposition of a layer of dielectric material, and mask and etch steps have been performed in accordance with one embodiment of the present claimed invention.
Figure 22J:
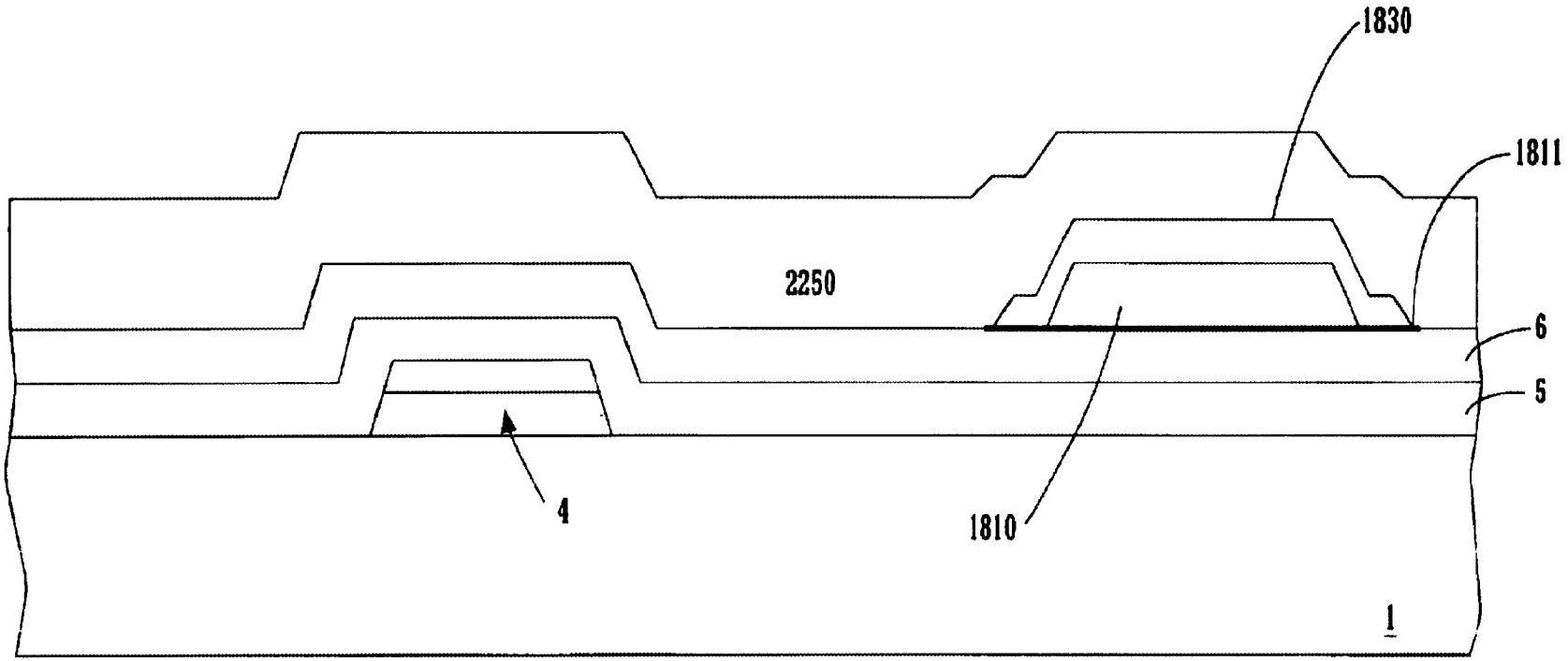
FIG. 22J is a side sectional view of a display device showing the structure of FIG. 22H after evaporation of a chromium layer and deposition of cone material, deposition of a layer of dielectric material, and mask and etch steps have been performed in accordance with one embodiment of the present claimed invention.
Figure 22K:
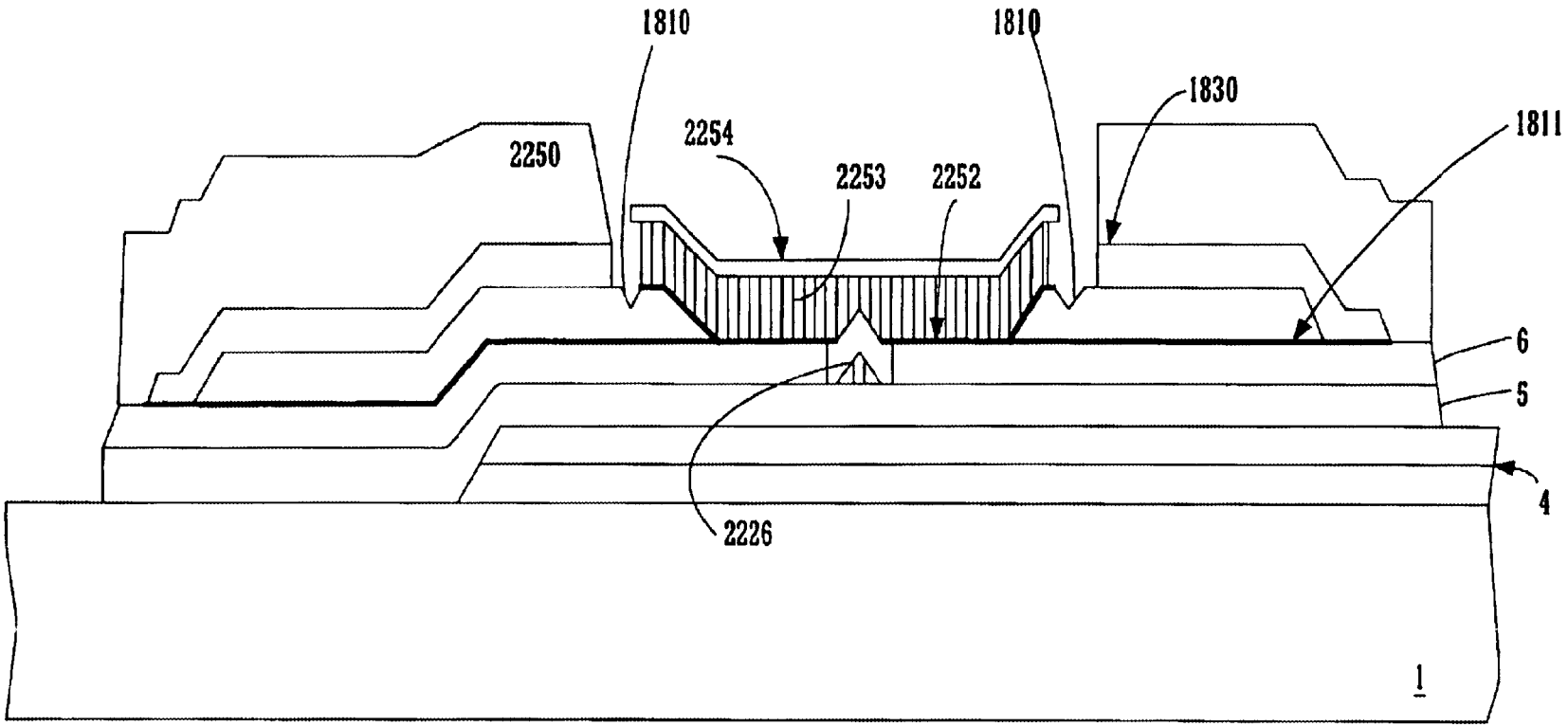
FIG. 22K is a side sectional view of a display device showing the structure of FIG. 22I after mask and etch steps have been performed in accordance with one embodiment of the present claimed invention.
Figure 22L:
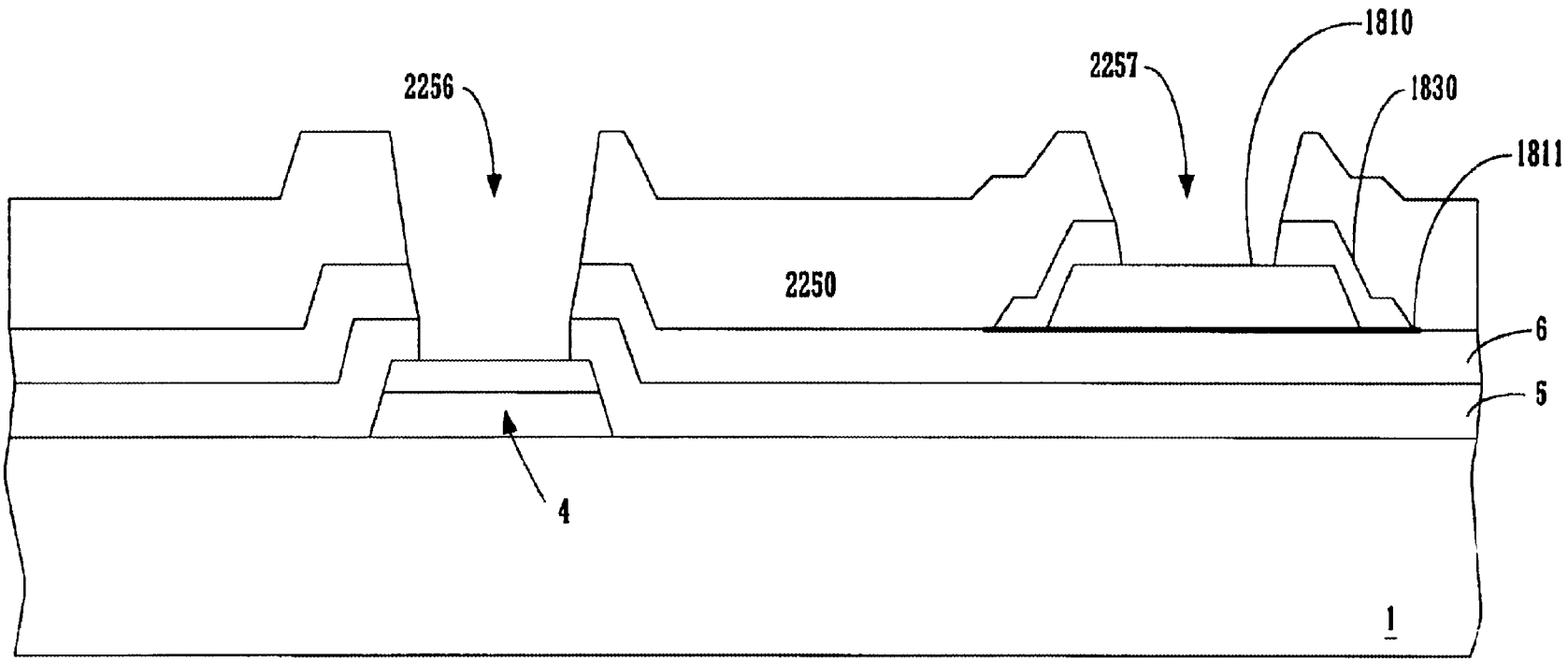
FIG. 22L is a side sectional view of a display device showing the structure of FIG. 22J after mask and etch steps have been performed in accordance with one embodiment of the present claimed invention.

The cathode structure is then completed as shown by step 209 of FIG. 21. FIGS. 22E–22N illustrate an exemplary method for completing the cathode in accordance with one embodiment of the present invention. A dielectric layer is deposited over the structure of FIGS. 22C–22D. The dielectric layer 2250 is then patterned and etched to form the structure shown in FIGS. 22E–22F. During the etch process, passivation layer 1830 acts as an etch stop. A cavity etch is then performed. FIGS. 22G–22H show the structure of FIGS. 22E–22F after the cavity etch has formed cavity 1825.

Figure 22M:
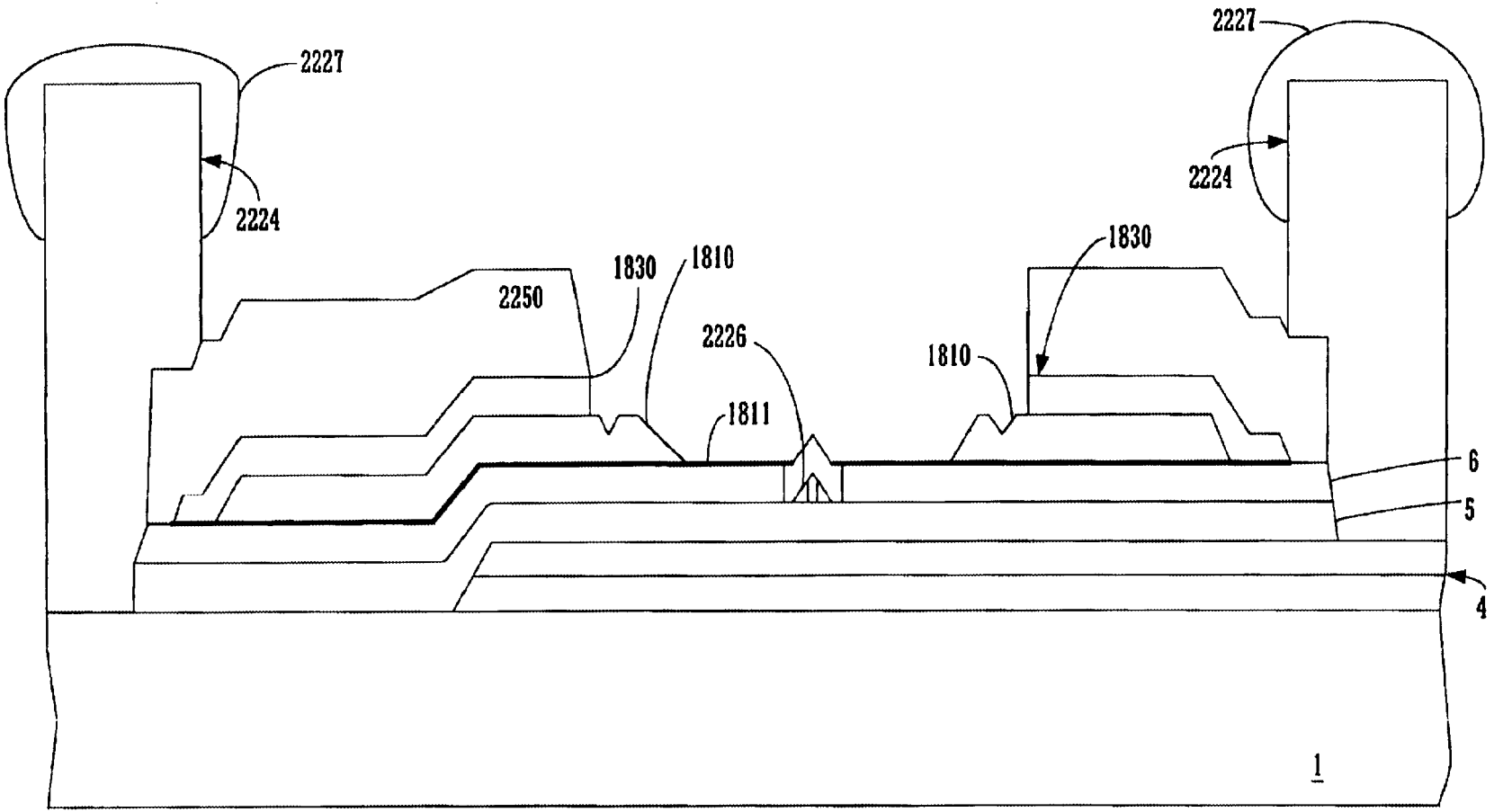
FIG. 22M is a side sectional view of a display device showing a completed cathode structure in accordance with one embodiment of the present claimed invention.
Figure 22N:
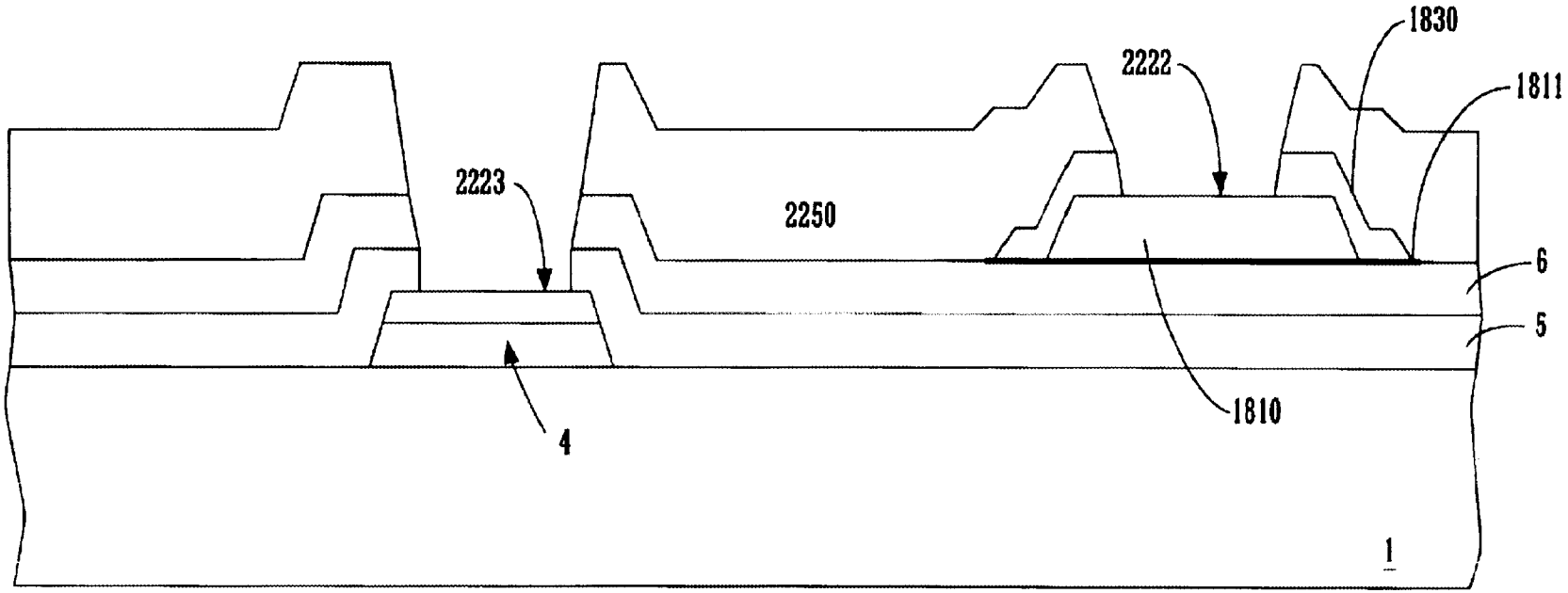
FIG. 22N is a side sectional view of a display device showing a completed cathode structure in accordance with one embodiment of the present claimed invention.

A layer of Molybdenum is then deposited, using a sputter deposition process. A layer of cone material is then deposited over the layer of Molybdenum. In one embodiment, a cone material that is evaporated molybdenum is used. However, the present invention is well adapted for use of other materials for forming a cone. A layer of dielectric is then deposited. The resulting structure is then patterned and etched so as to produce the structure shown in FIGS. 22I–22J. The structure of FIGS. 22I–22J includes Molybdenum structure 2252, cone 2226, cone material 2253 and dielectric layer 2254. Mask and etch steps then form openings 2256–2257 shown in FIGS. 22K–22L. Referring now to FIGS. 22M–22N, dielectric removal steps and a halo etch are then performed, producing contact pads 2222 and 2223, followed by formation of polyimide focusing structures 2224 and focus waffle metal 2227.

During the process steps for completion of the cathode, upper electrode 1810 is protected by passivation layer 1830. This prevents damage to upper electrode 1810 as typically occurs in prior art processes. By preventing damage to upper electrode 1810, upper electrode shorts and opens are prevented. In addition, because upper electrode 1810 is protected, column shorts in the frit seal region are eliminated. Also, because there is less exposed metal as compared with prior art processes, upper electrode to focus waffle shorts are decreased.

Figure 23:
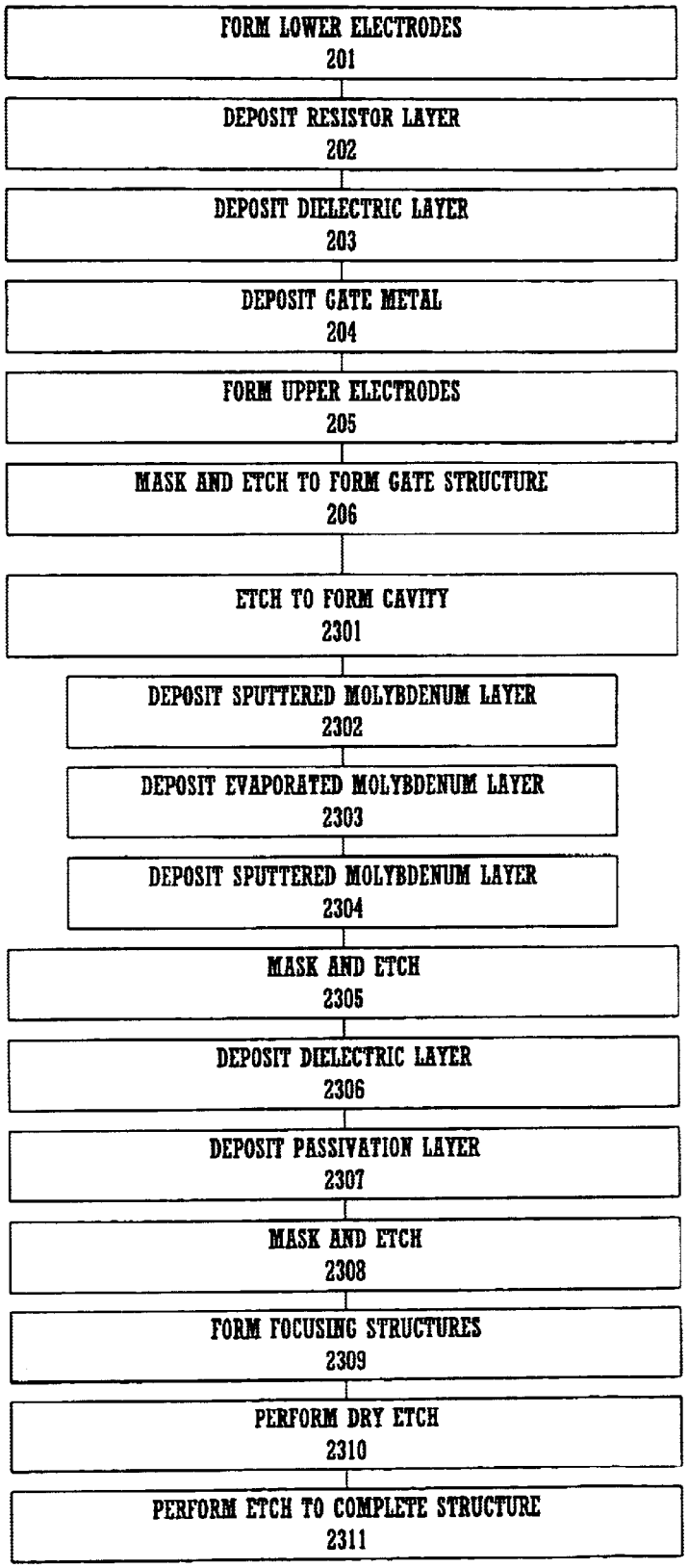
FIG. 23 is a diagram showing a method for forming an electrode structure of a display device in accordance with one embodiment of the present invention.

With reference now to FIGS. 23–24, yet another method for forming an electrode structure for a display device is shown. As shown by step 201 of FIG. 23, lower electrodes are formed over a substrate. A resistor layer and a dielectric layer are then deposited over the lower electrodes as shown by steps 202–203. A gate metal layer is deposited as shown by step 204, followed by the formation of upper electrodes as shown by step 205. An etch step is then performed to form a gate structure as shown by step 206 followed by etch step 2301 to form a cavity.

In the present embodiment, upper electrodes are formed by the deposition and etch of a metal alloy layer. In one embodiment, the metal alloy is an aluminum alloy that has a thickness of 500–5000 Angstroms. In one specific embodiment, an aluminum alloy is used that includes aluminum (Al) and Neodymium (Nd). In the present embodiment, the aluminum alloy has an concentration of from 0.5 to 6 atomic percent Nd. In another embodiment, an aluminum alloy is used that has a concentration of from 0.5 to 6 atomic percent Nd and from 0 to 5 atomic percent titanium (Ti).

Figure 24A:
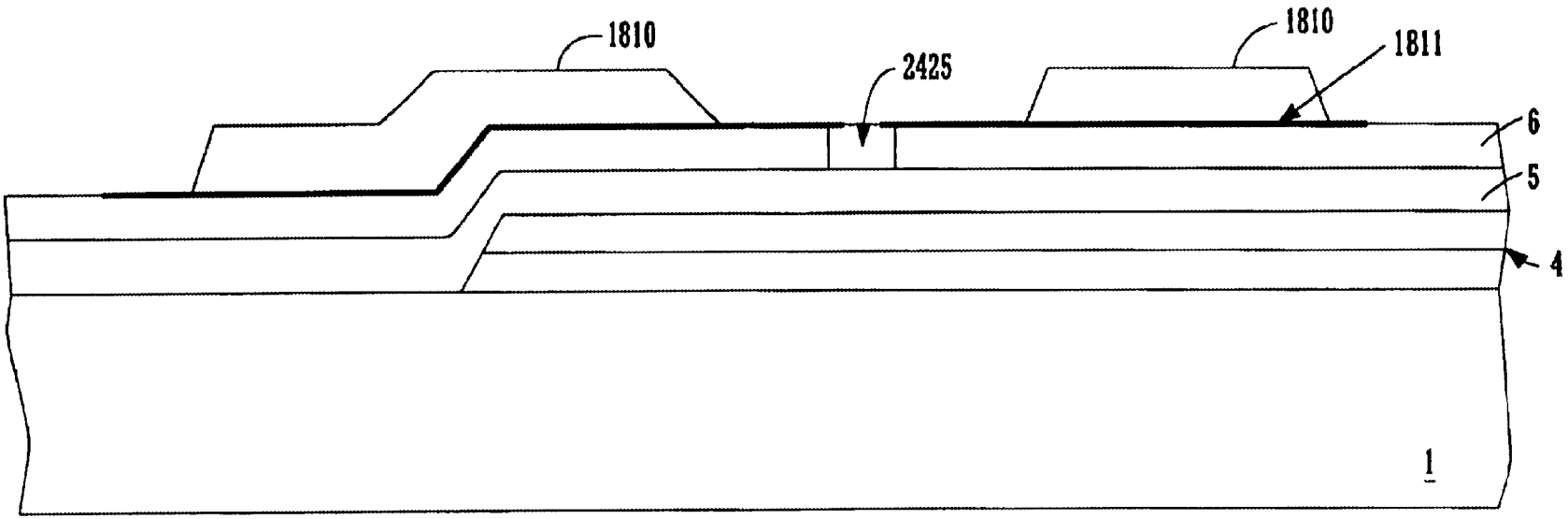
FIG. 24A is a side sectional view of a display device showing a backplate over which lower and upper electrodes are formed and having a resistor layer, a dielectric layer, and a gate structure in accordance with one embodiment of the present claimed invention.
Figure 24B:
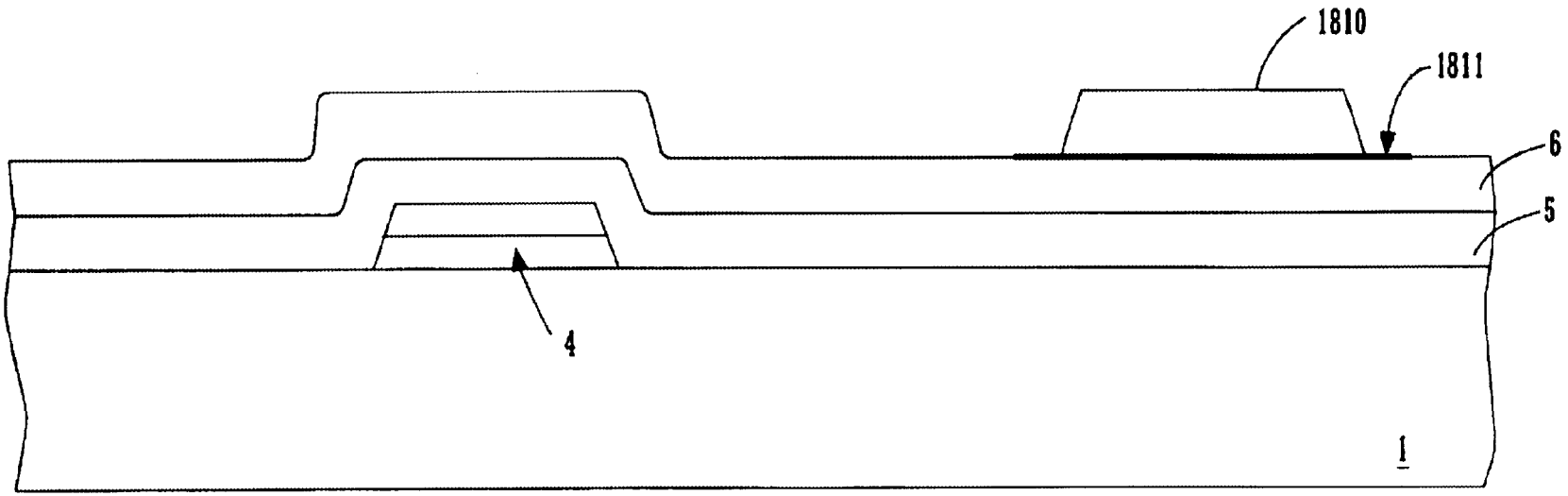
FIG. 24B is a side sectional view of a display device showing a backplate over which lower and upper electrodes are formed and having a resistor layer, a dielectric layer, and a gate structure in accordance with one embodiment of the present claimed invention.

Referring to FIGS. 24A–24B, a substrate 1 is shown after steps 201-206 have formed lower electrodes 4, resistor layer 5, dielectric layer 6, gate metal structure 1811 and upper electrodes 1810. Etch step 2301 forms cavity 2425.

Figure 24C:
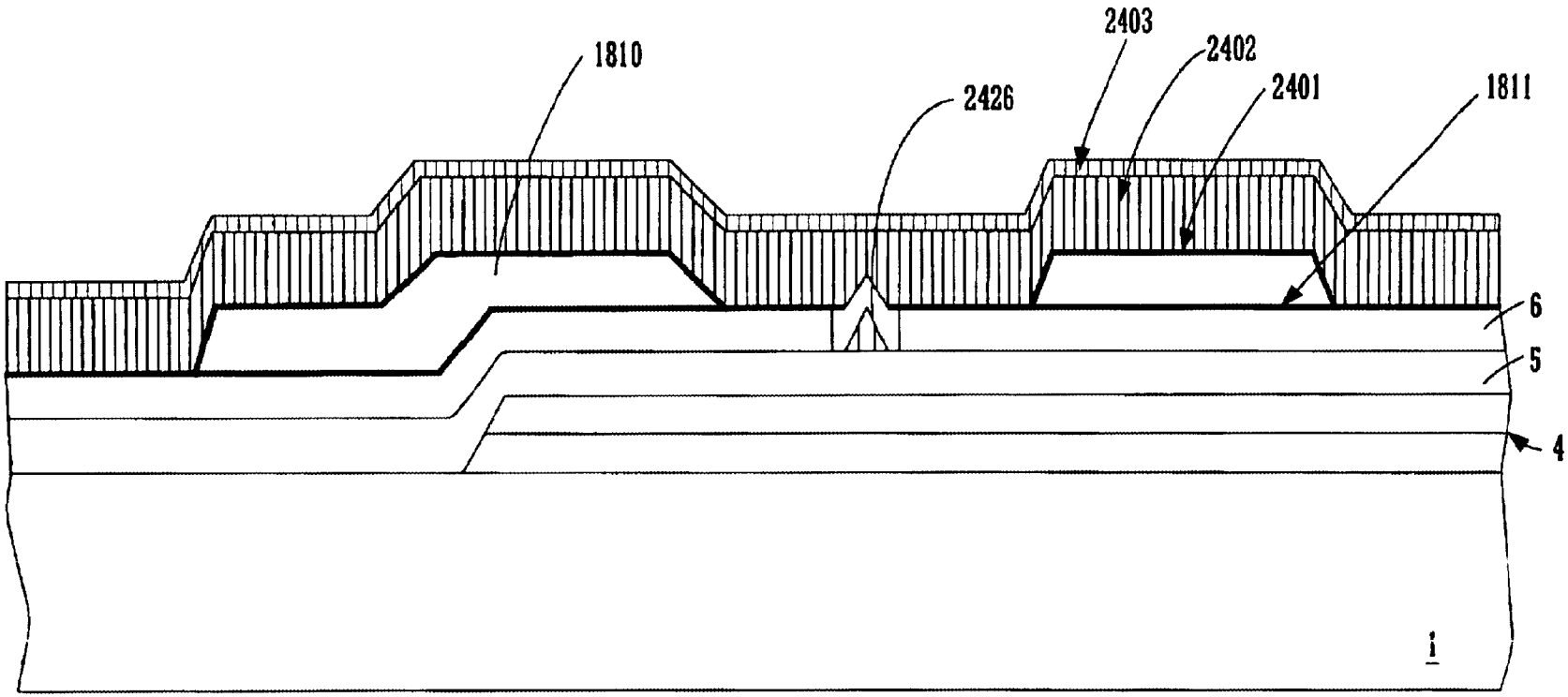
FIG. 24C is a side sectional view of a display device showing the structure of FIG. 24A after deposition of a sputtered molybdenum layer, deposition of an evaporated molybdenum layer, and deposition of a sputtered molybdenum layer in accordance with one embodiment of the present claimed invention.
Figure 24D:
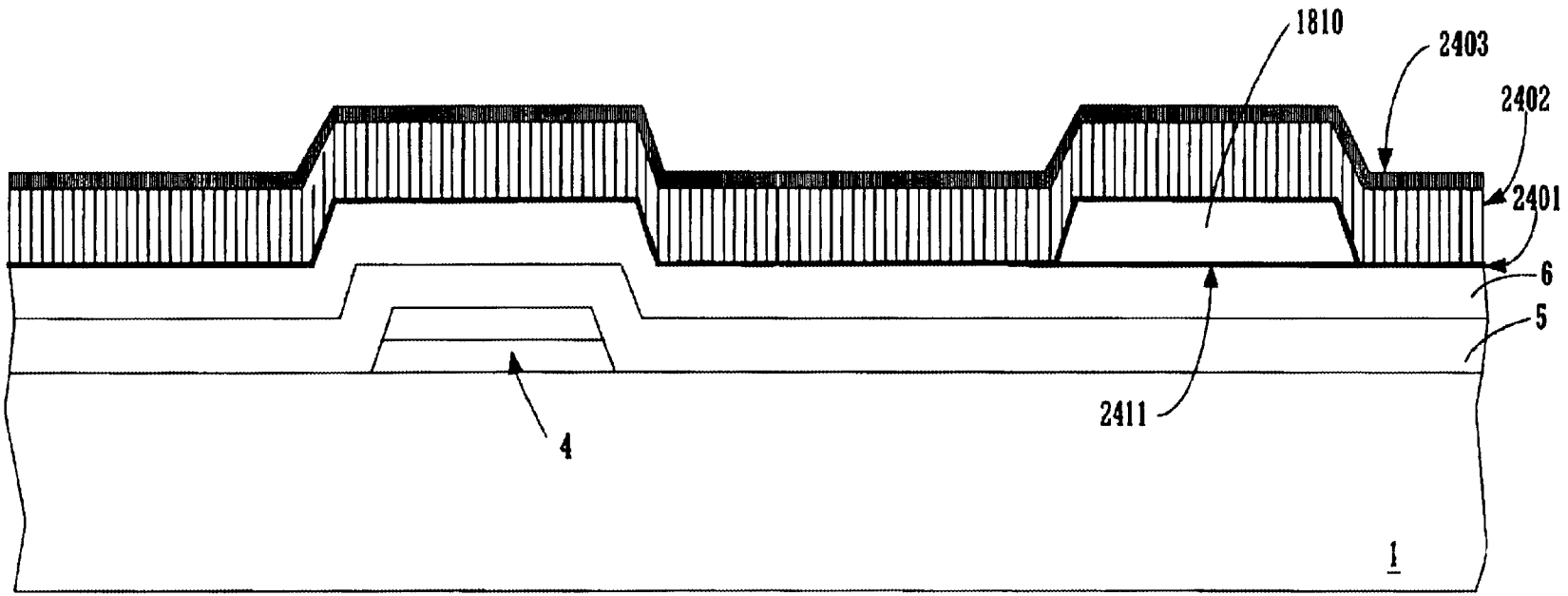
FIG. 24D is a side sectional view of a display device showing the structure of FIG. 24B after deposition of a sputtered molybdenum layer, deposition of an evaporated molybdenum layer, and deposition of a sputtered molybdenum layer in accordance with one embodiment of the present claimed invention.

Continuing with FIG. 23, a layer of sputtered molybdenum is then deposited as shown by step 2302. A layer of evaporated molybdenum is then deposited as shown by step 2303, followed by the deposition of a layer of sputtered molybdenum as shown by step 2304. Referring now to FIGS. 24C–24D, the structure of FIGS. 24A–24B is shown after steps 2302–2304 form sputtered molybdenum layer 2401, evaporated molybdenum layer 2402, sputtered molybdenum layer 2403 and cone 2426.

Figure 24E:
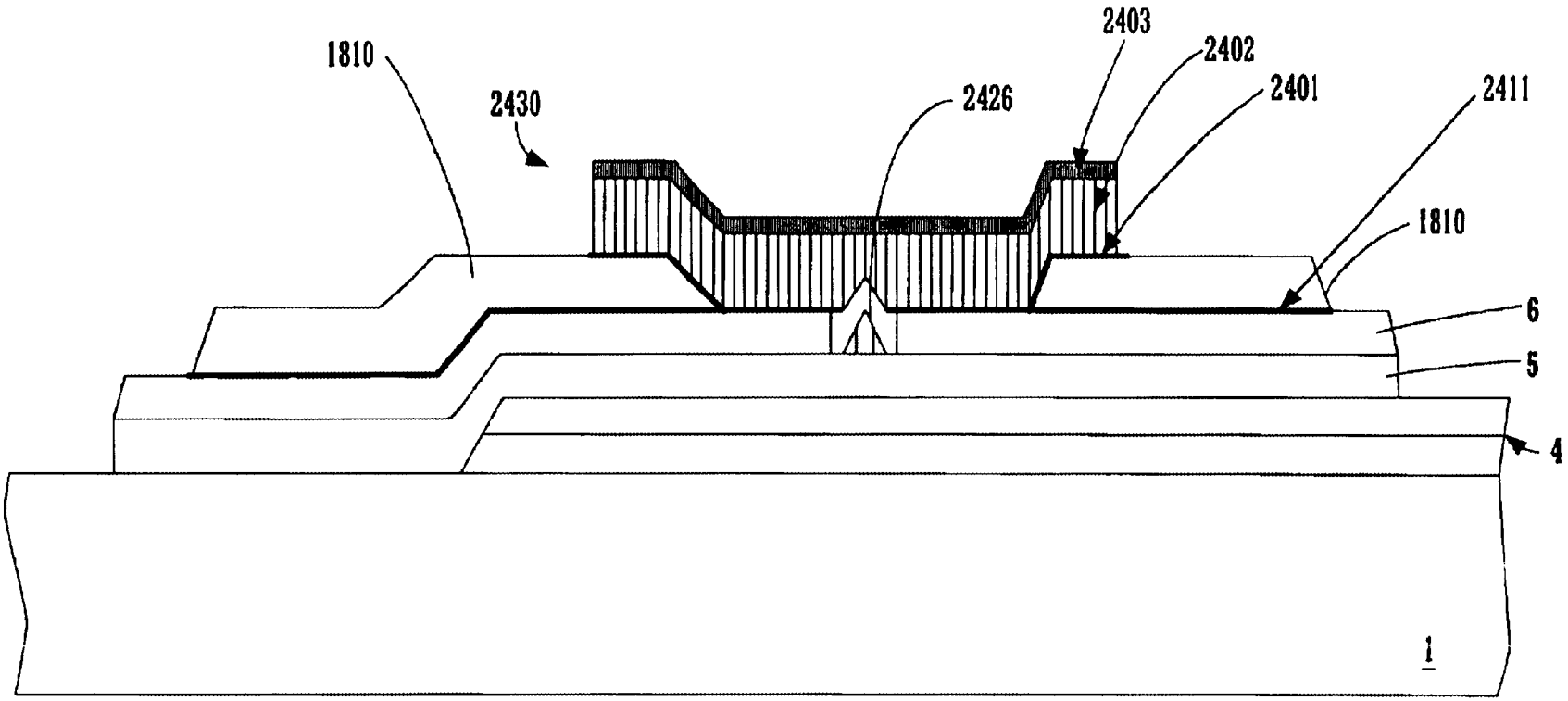
FIG. 24E is a side sectional view of a display device showing the structure of FIG. 24C after mask and etch steps have been performed in accordance with one embodiment of the present claimed invention.
Figure 24F:
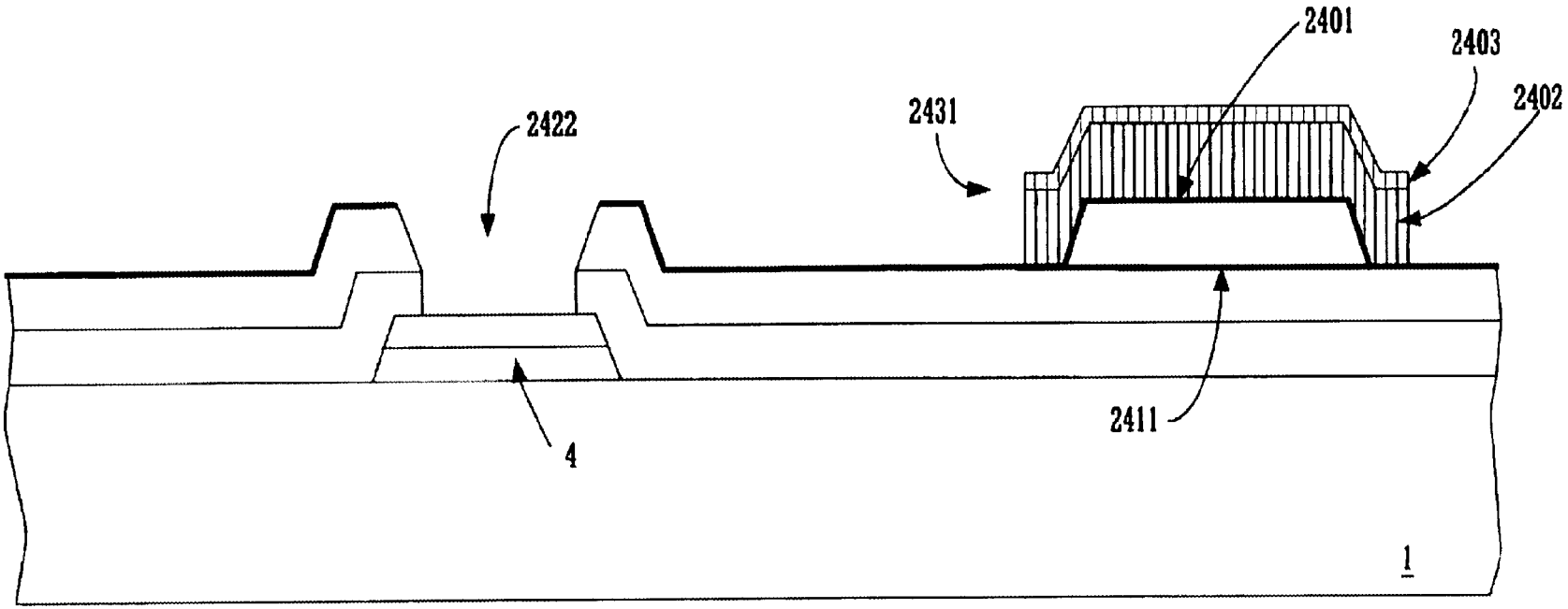
FIG. 24F is a side sectional view of a display device showing the structure of FIG. 24D after mask and etch steps have been performed in accordance with one embodiment of the present claimed invention.

Referring back to FIG. 23, as shown by step 2305, mask and etch steps are then performed. FIGS. 24E–24F show the structure of FIGS. 24C–24D after mask and etch steps have formed molybdenum structures 2430–2431 and an opening 2422 that extends to the top of lower electrode 4. In one embodiment, mask and etch step 2305 includes two separate mask and etch steps, a first mask and etch step that etches sputtered molybdenum layer 2403, evaporated molybdenum 2402 and molybdenum layer 2401, and a second mask and etch step that etches through dielectric layer 6 and resistor layer 5 to form opening 2422.

Referring to step 2306 of FIG. 23, a dielectric layer is deposited. In one embodiment, the dielectric layer is silicon dioxide.

Figure 24G:
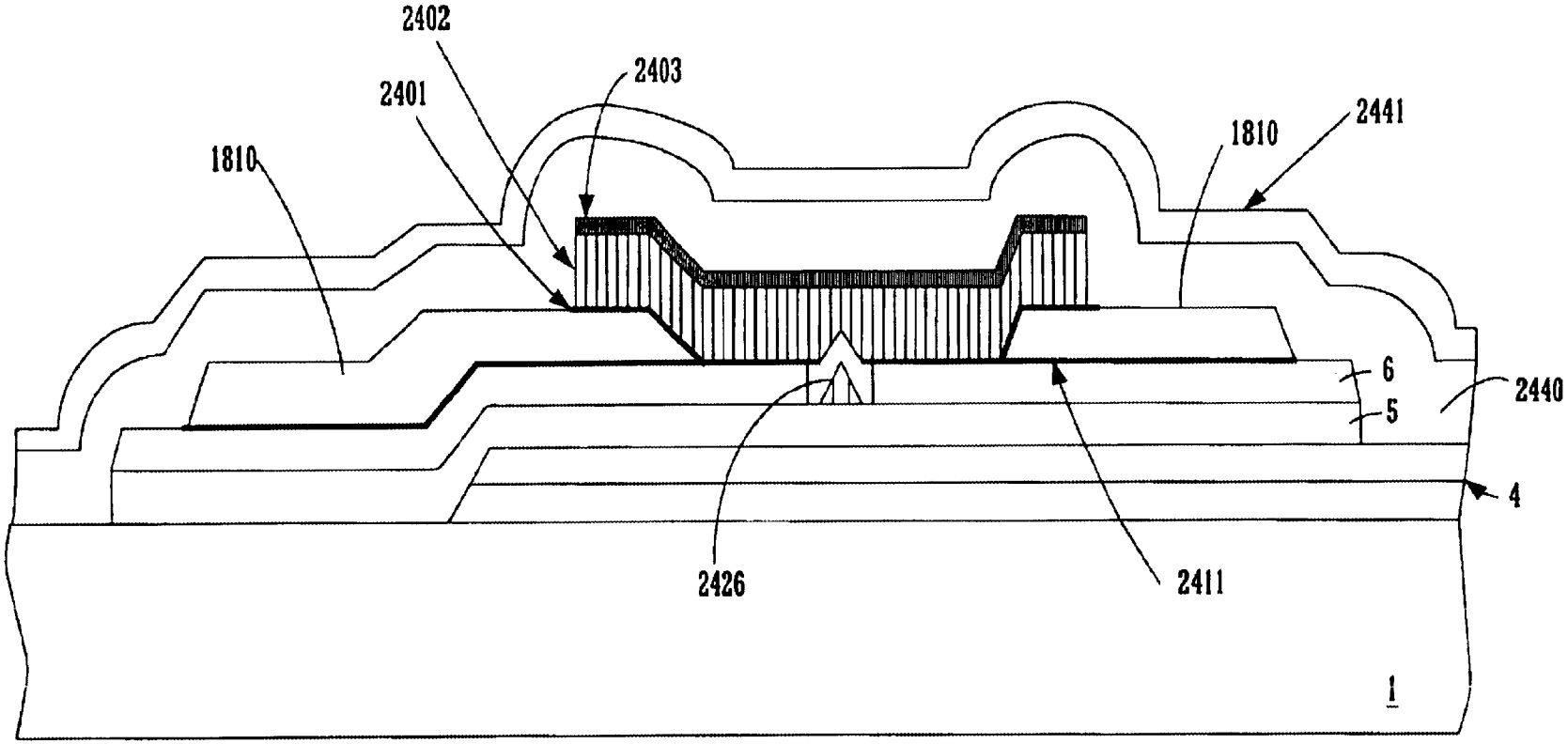
FIG. 24G is a side sectional view of a display device showing the structure of FIG. 24E after deposition of a dielectric layer and a passivation layer in accordance with one embodiment of the present claimed invention.
Figure 24H:
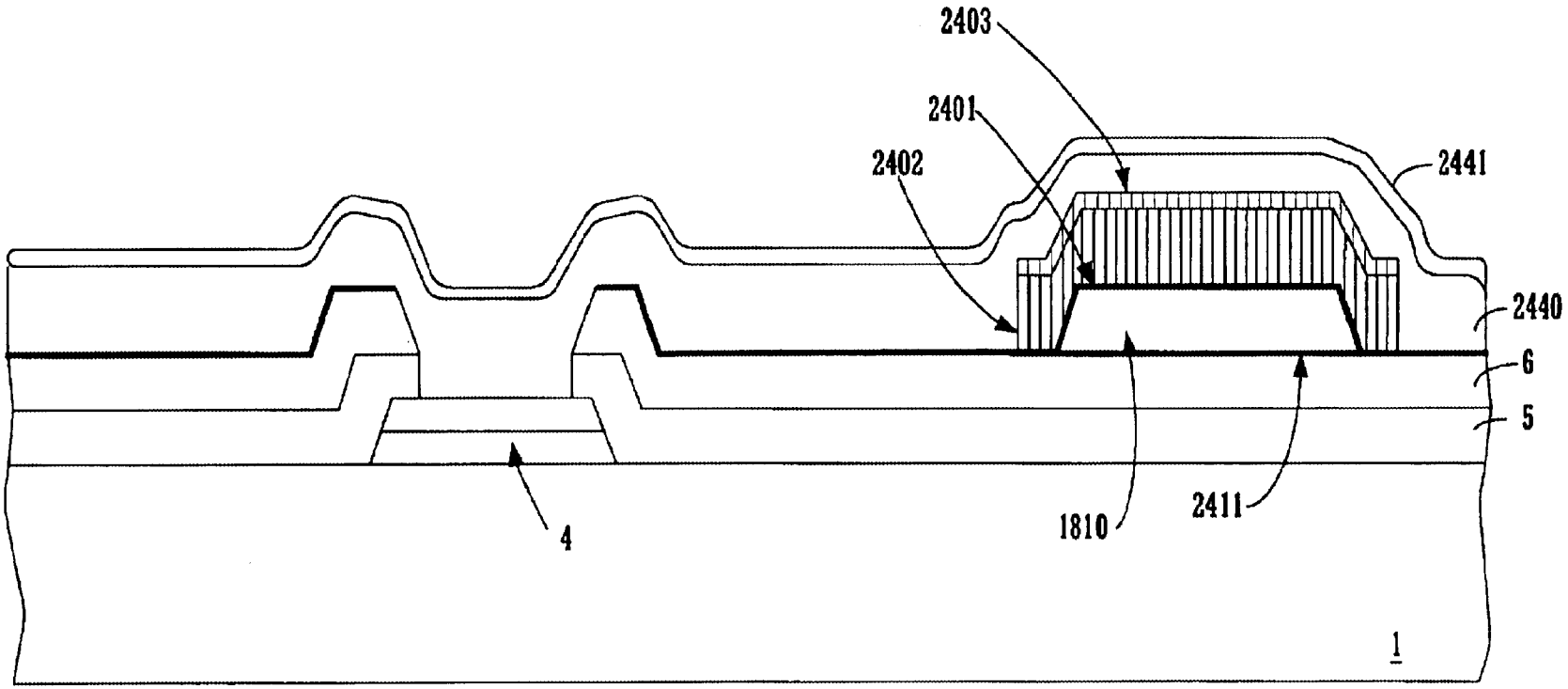
FIG. 24H is a side sectional view of a display device showing the structure of FIG. 24F after deposition of a dielectric layer and a passivation layer in accordance with one embodiment of the present claimed invention.

Referring now to step 2307 of FIG. 23, a passivation layer is deposited. In one embodiment, the passivation layer is silicon nitride deposited using a plasma enhanced chemical vapor deposition process. FIGS. 24G–24H show the structure of FIGS. 24E–34F after the deposition of dielectric layer 2440 and passivation layer 2441.

Figure 24I:
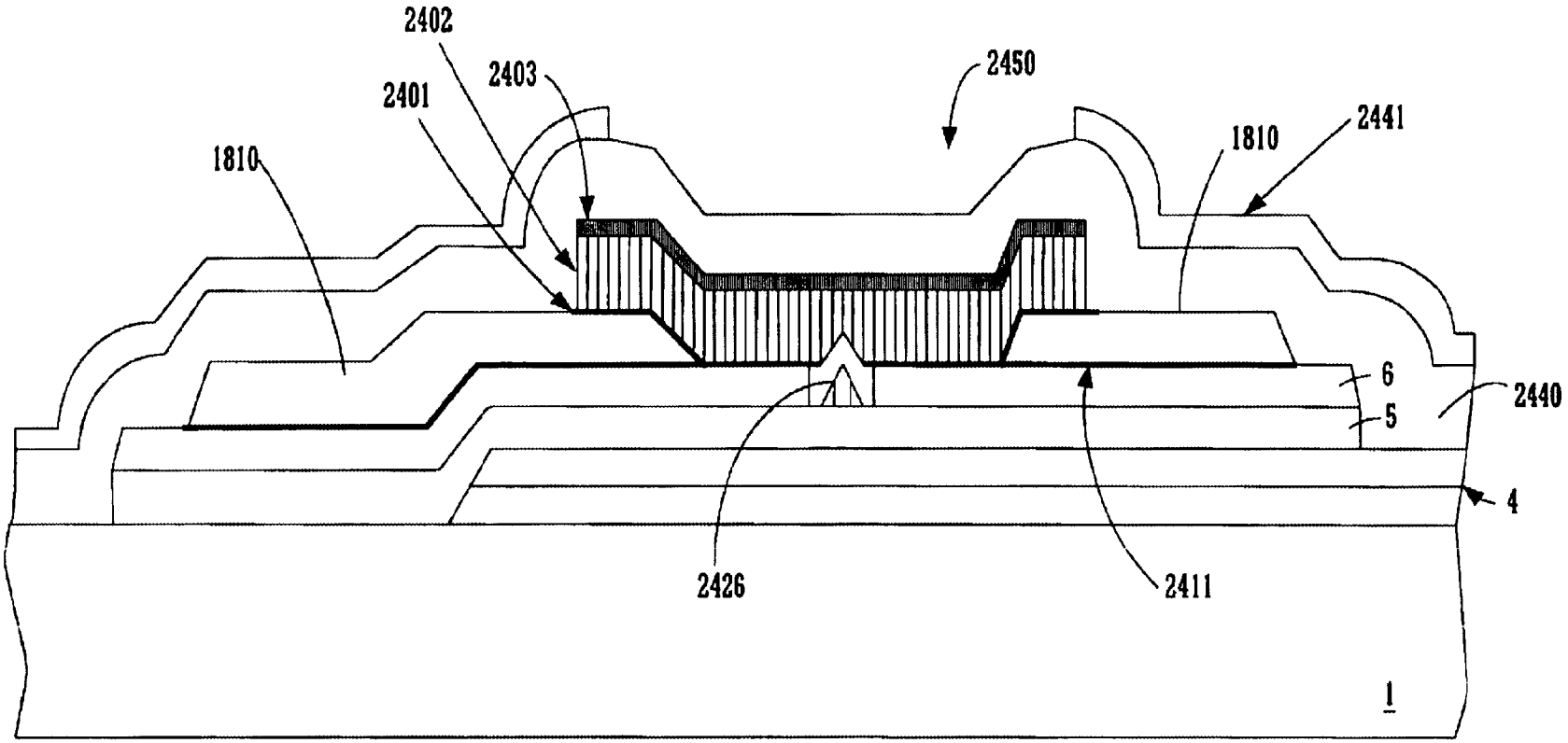
FIG. 24I is a side sectional view of a display device showing the structure of FIG. 24G after mask and etch steps have been performed in accordance with one embodiment of the present claimed invention.
Figure 24J:
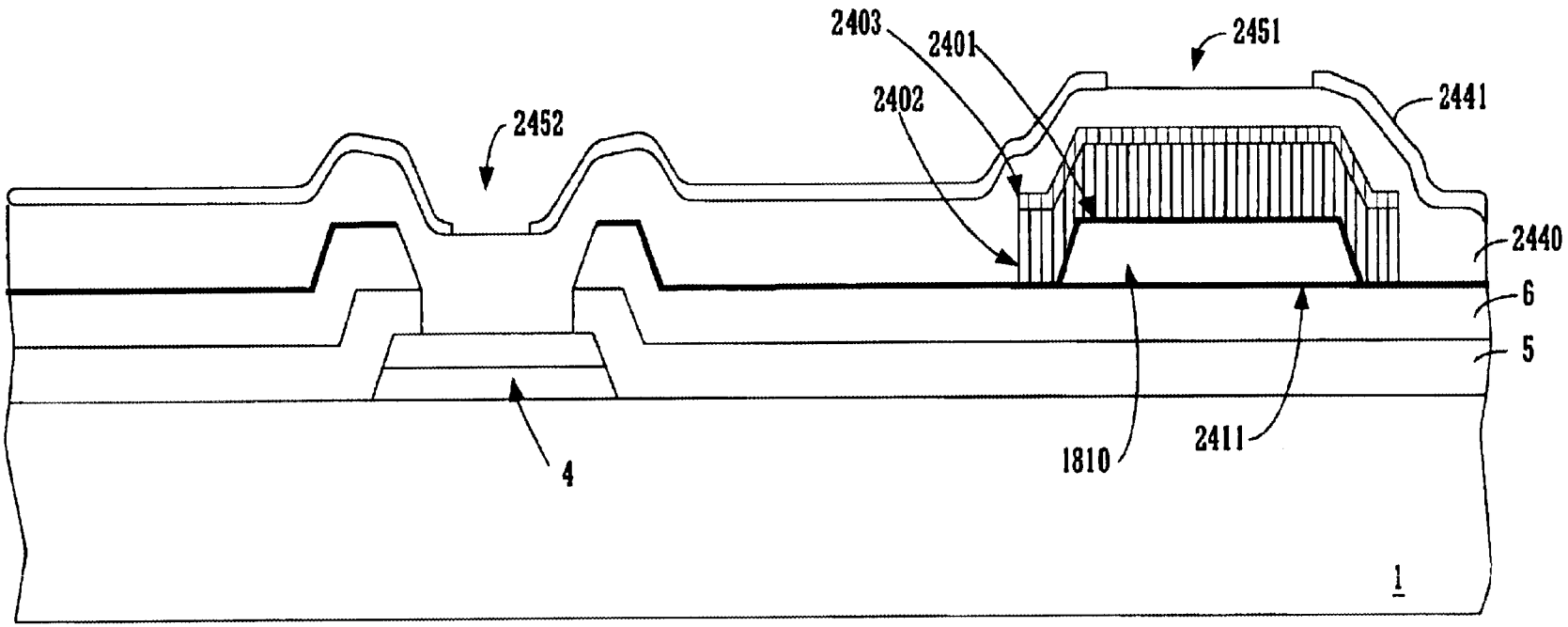
FIG. 24J is a side sectional view of a display device showing the structure of FIG. 24H after mask and etch steps have been performed in accordance with one embodiment of the present claimed invention.

Referring now to step 2308, mask and etch steps are then performed. Referring now to FIGS. 24I–24J step 2308 forms openings 2450–2452 that extend through passivation layer 2441.

Figure 24K:
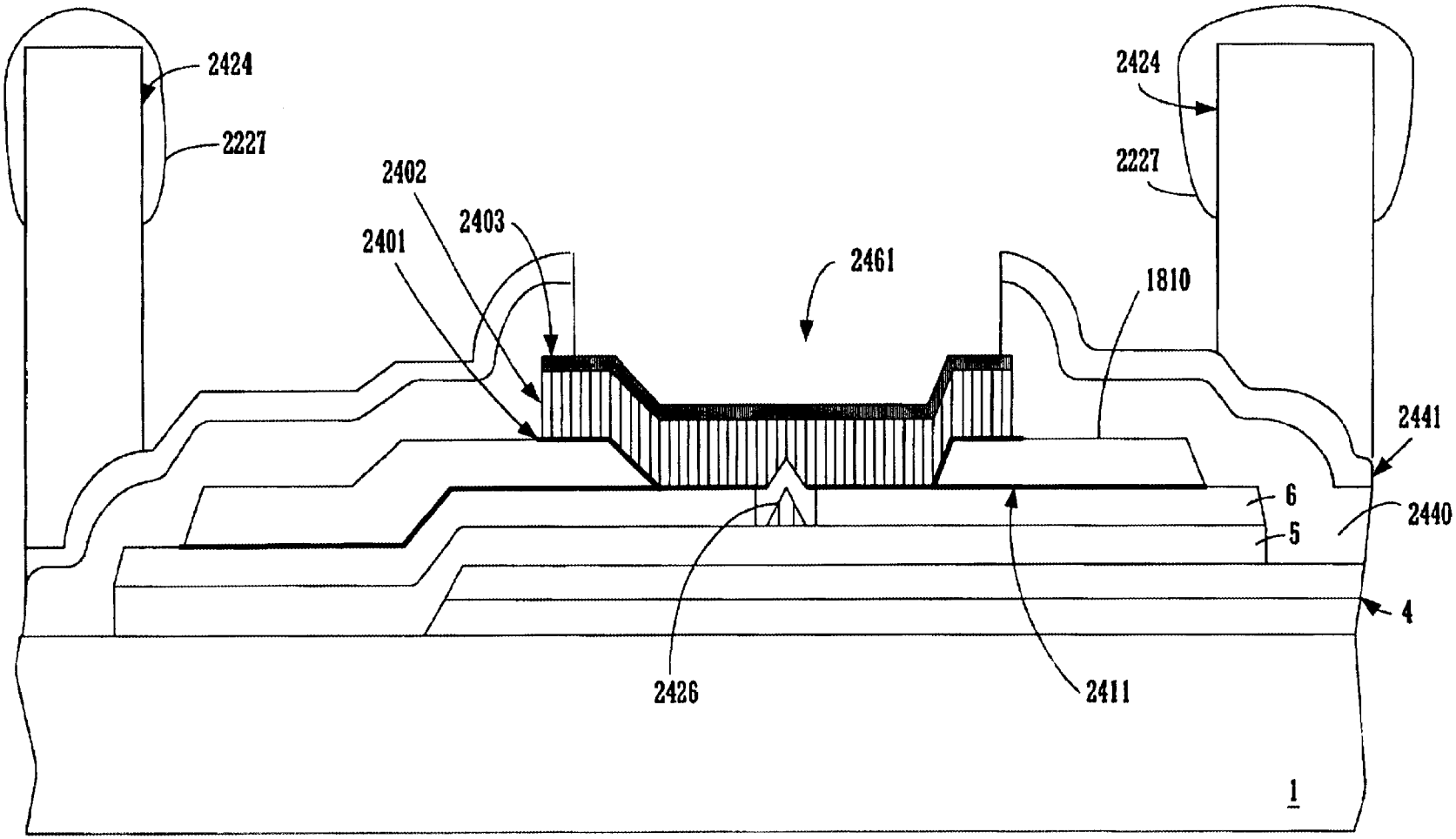
FIG. 24K is a side sectional view of a display device showing the structure of FIG. 24I after mask and etch steps have been performed and after focusing structures have been formed in accordance with one embodiment of the present claimed invention.
Figure 24L:
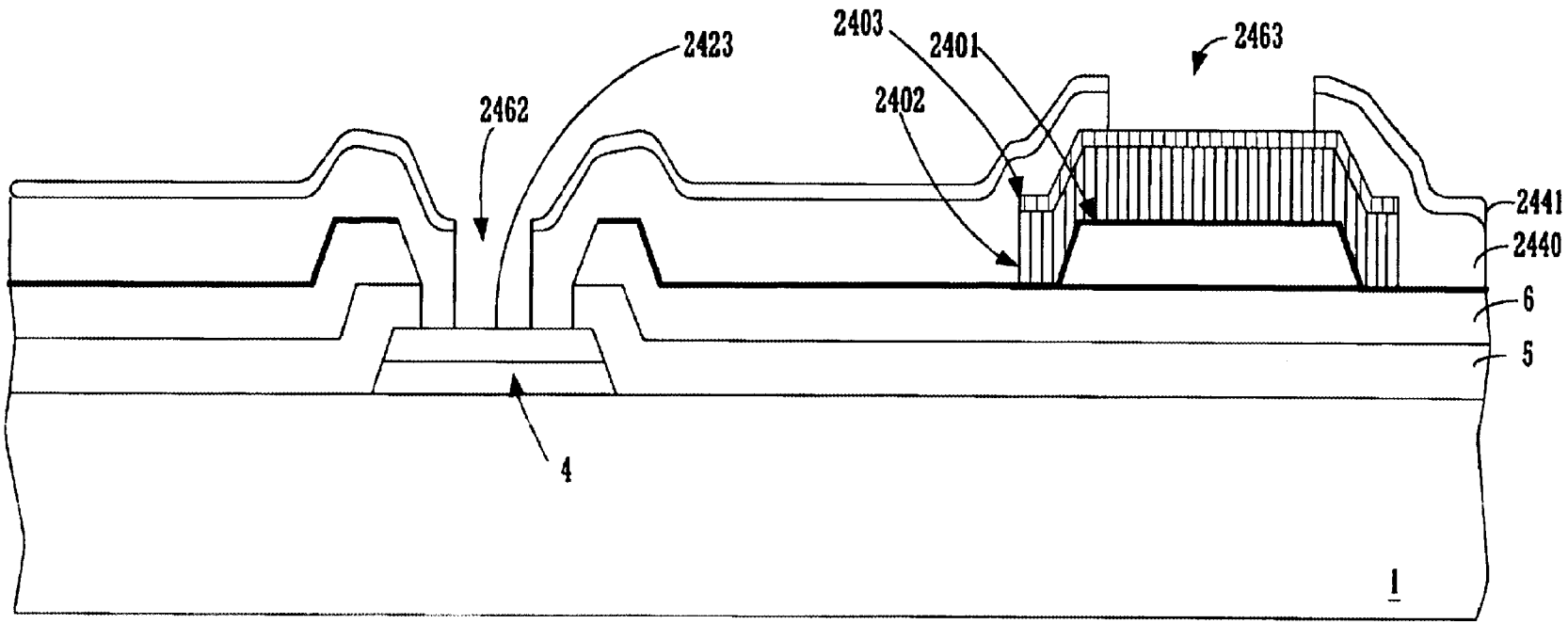
FIG. 24L is a side sectional view of a display device showing the structure of FIG. 24J after mask and etch steps have been performed and after focusing structures have been formed in accordance with one embodiment of the present claimed invention.
Figure 24M:
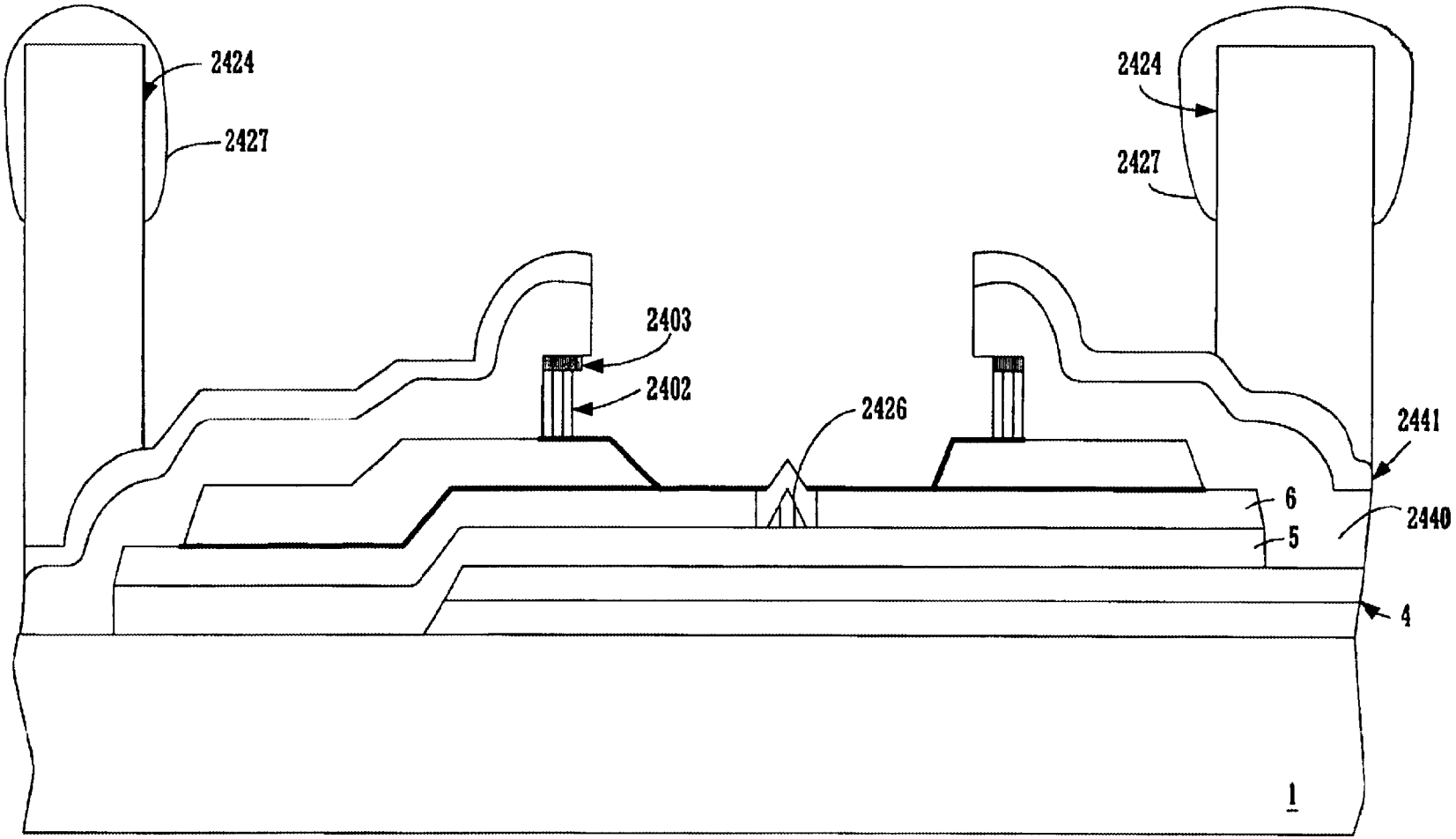
FIG. 24M is a side sectional view of a display device showing the structure of FIG. 24K after mask and etch steps have been performed in accordance with one embodiment of the present claimed invention.

As shown in step 2309, Focusing structures are formed. A dry etch process is then performed as shown by step 2310. Referring now to FIGS. 24K–24L, steps 2309–2310 form polyimide focusing structures 2424 and openings 2461–2463 that extend through dielectric layer 2440. Opening 2462 extends to the top surface of lower contact pad 4, forming lower contact pad 2423. Referring now to FIG. 24M, in the present embodiments focus waffle metal 2427 is formed over focusing structures 2424.

Figure 24N:
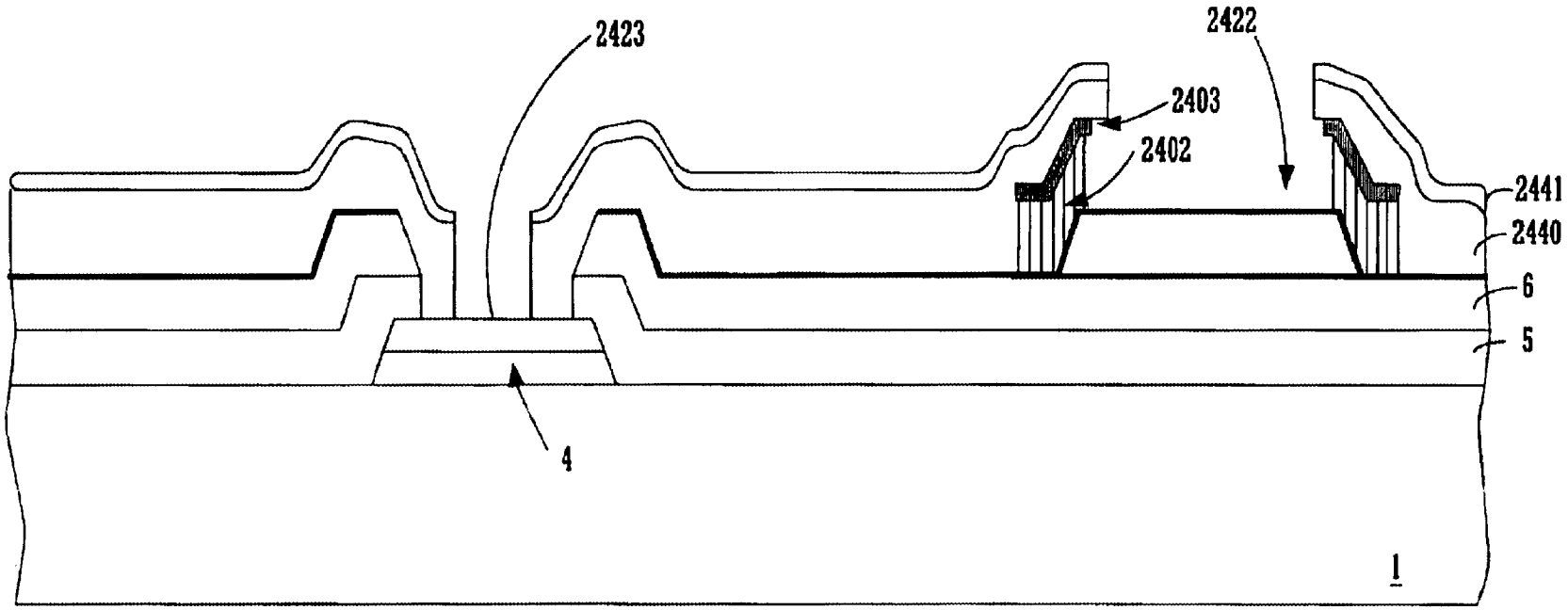
FIG. 24N is a side sectional view of a display device showing the structure of FIG. 24L after mask and etch steps have been performed in accordance with one embodiment of the present claimed invention.

Another etch is performed as shown by step 2311 to complete the structure. Referring now to FIGS. 24M–24N, etch step 2311 is shown to extend opening 2461 and opening 2463 of FIGS. 24K–24L through sputtered molybdenum layer 2403 and evaporated molybdenum layer 2402, forming contact pad 2422 and removing that portion of sputtered molybdenum layer 2403 and evaporated molybdenum layer 2402 that overlie cone 2426.

In the process shown in FIGS. 23–24, dielectric layer 2440 and passivation layer 2441 protect upper electrodes 1810, preventing damage to upper electrode 1810 as typically occurs in prior art processes. By preventing damage to upper electrode 1810, upper electrode shorts and opens are prevented. In addition, because upper electrode 1810 is protected, column shorts in the frit seal region are eliminated. Also, because there is less exposed metal as compared with prior art processes, upper electrode to focus waffle shorts are decreased.

Figure 25:
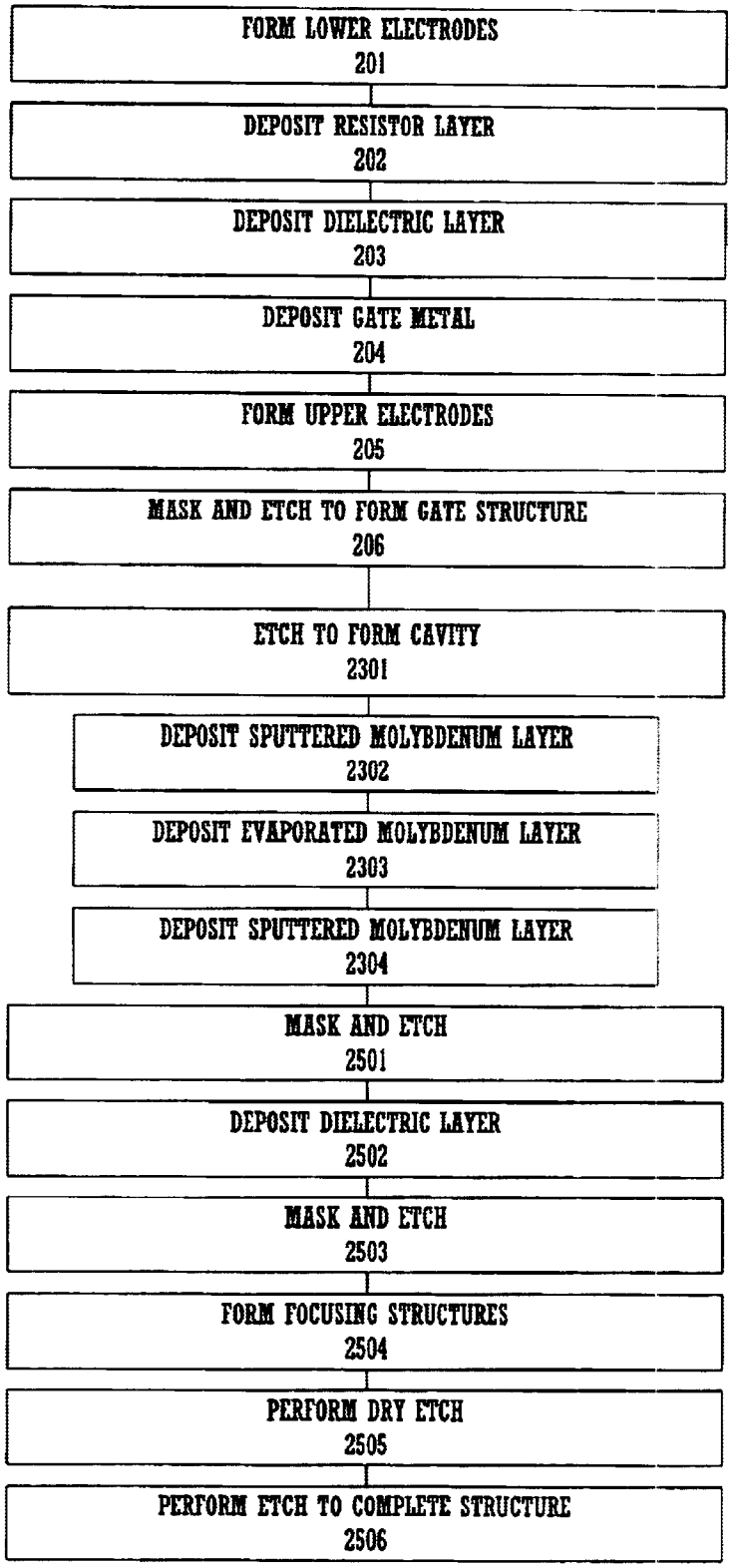
FIG. 25 is a diagram showing a method for forming an electrode structure of a display device in accordance with one embodiment of the present invention.

With reference now to FIGS. 25–26, yet another method for forming an electrode structure for a display device is shown. As shown by step 201 of FIG. 25, lower electrodes are formed over a substrate. A resistor layer and a dielectric layer are then deposited over the lower electrodes as shown by steps 202–203. A gate metal layer is deposited as shown by step 204, followed by the formation of upper electrodes as shown by step 205. Mask and etch step 206 forms a gate structure. A cavity is then etched as shown by step 2301.

A layer of sputtered molybdenum, a layer of evaporated molybdenum, and a second layer of sputtered molybdenum are then deposited as shown by steps 2302–2304. In one embodiment, steps 201–206 and 2301–2304 are identical to steps 201–206 and 2301–2304 of FIG. 23.

Referring now to step 2501 of FIG. 25, a mask and etch step is performed that selectively etches both sputtered molybdenum layers and the evaporated molybdenum layer. In the present embodiment, mask and etch step 2501 removes all of that portion of the sputtered molybdenum layers and the evaporated molybdenum layers that overlie the region where the upper electrode contact pad is to be formed. That is, in the present embodiment, structure 2431 shown in FIG. 24F is also removed during etch step 2501.

Referring to step 2502 of FIG. 25, a dielectric layer is deposited. In one embodiment, the dielectric layer is silicon dioxide.

Figure 26A:
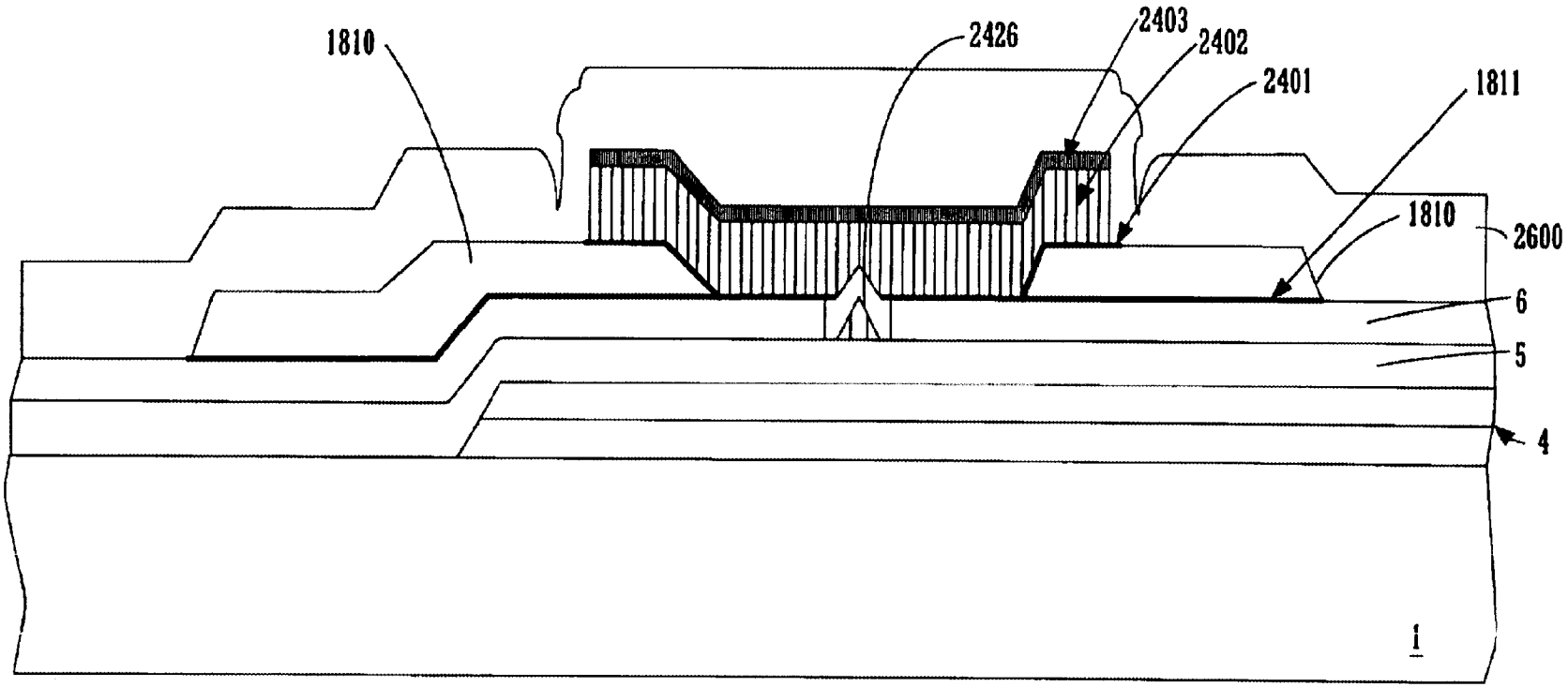
FIG. 26A is a side sectional view of a display device showing a backplate over which lower and upper electrodes are formed and having a resistor layer, a dielectric layer, a gate structure, a sputtered molybdenum layer, an evaporated molybdenum layer, and a sputtered molybdenum layer, after mask and etch steps and after the deposition of a dielectric layer in accordance with one embodiment of the present claimed invention.
Figure 26B:
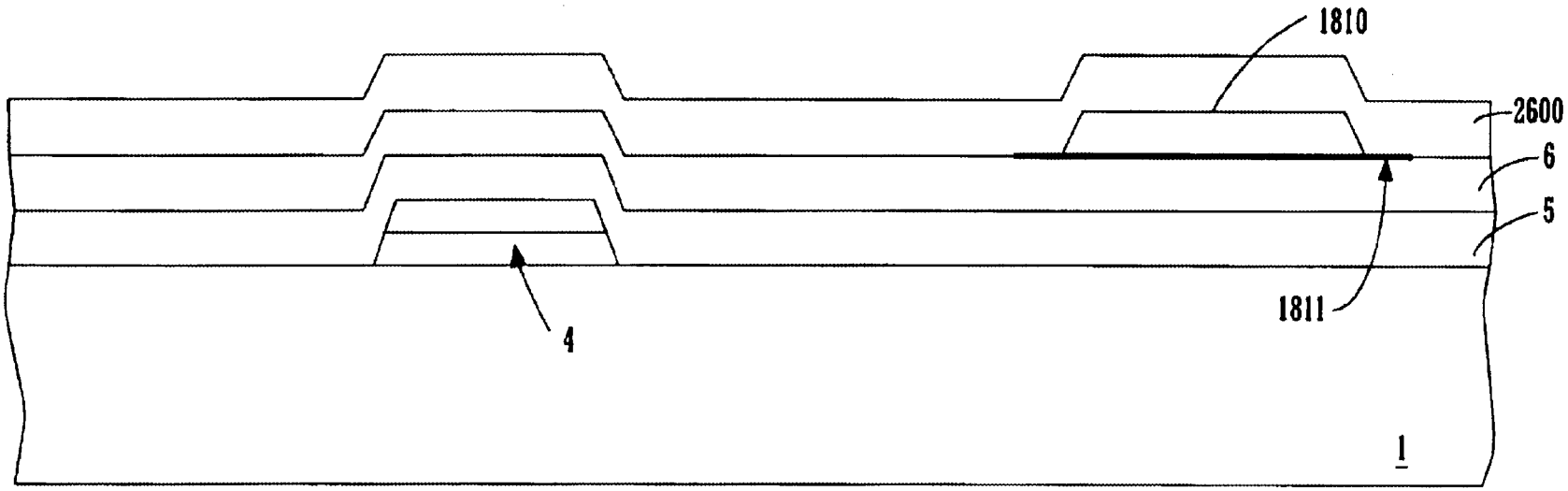
FIG. 26B is a side sectional view of a display device showing a backplate over which lower and upper electrodes are formed and having a resistor layer, a dielectric layer, a gate structure, a sputtered molybdenum layer, an evaporated molybdenum layer, and a sputtered molybdenum layer, after mask and etch steps and after the deposition of a dielectric layer in accordance with one embodiment of the present claimed invention.
Figure 26C:
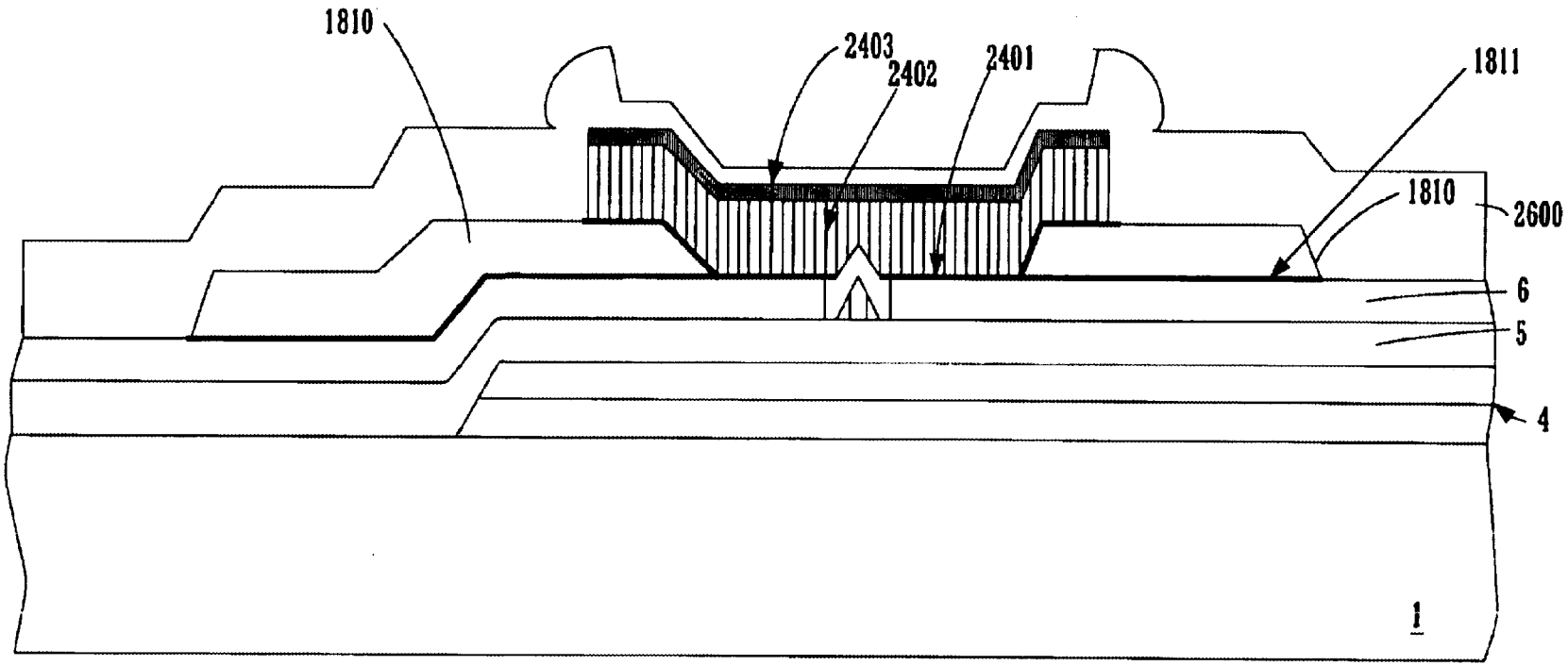
FIG. 26C is a side sectional view of a display device showing the structure of FIG. 26A after mask and etch steps have been performed in accordance with one embodiment of the present claimed invention.
Figure 26D:
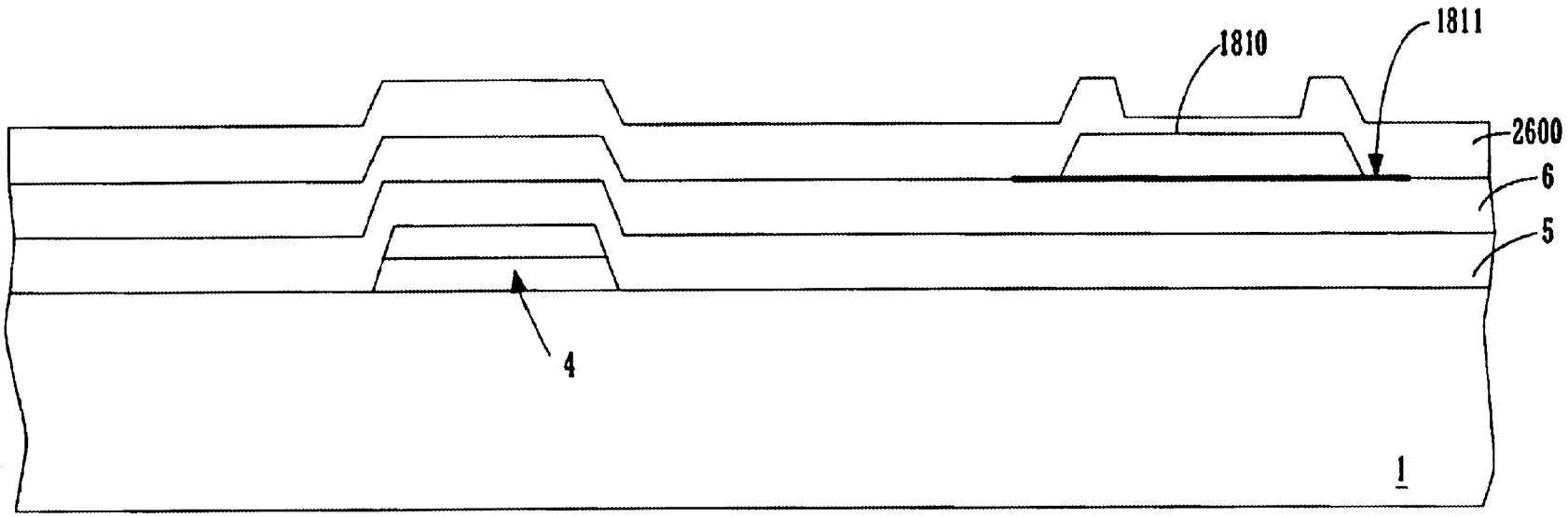
FIG. 26D is a side sectional view of a display device showing the structure of FIG. 26B after mask and etch steps have been performed in accordance with one embodiment of the present claimed invention.
Figure 26E:
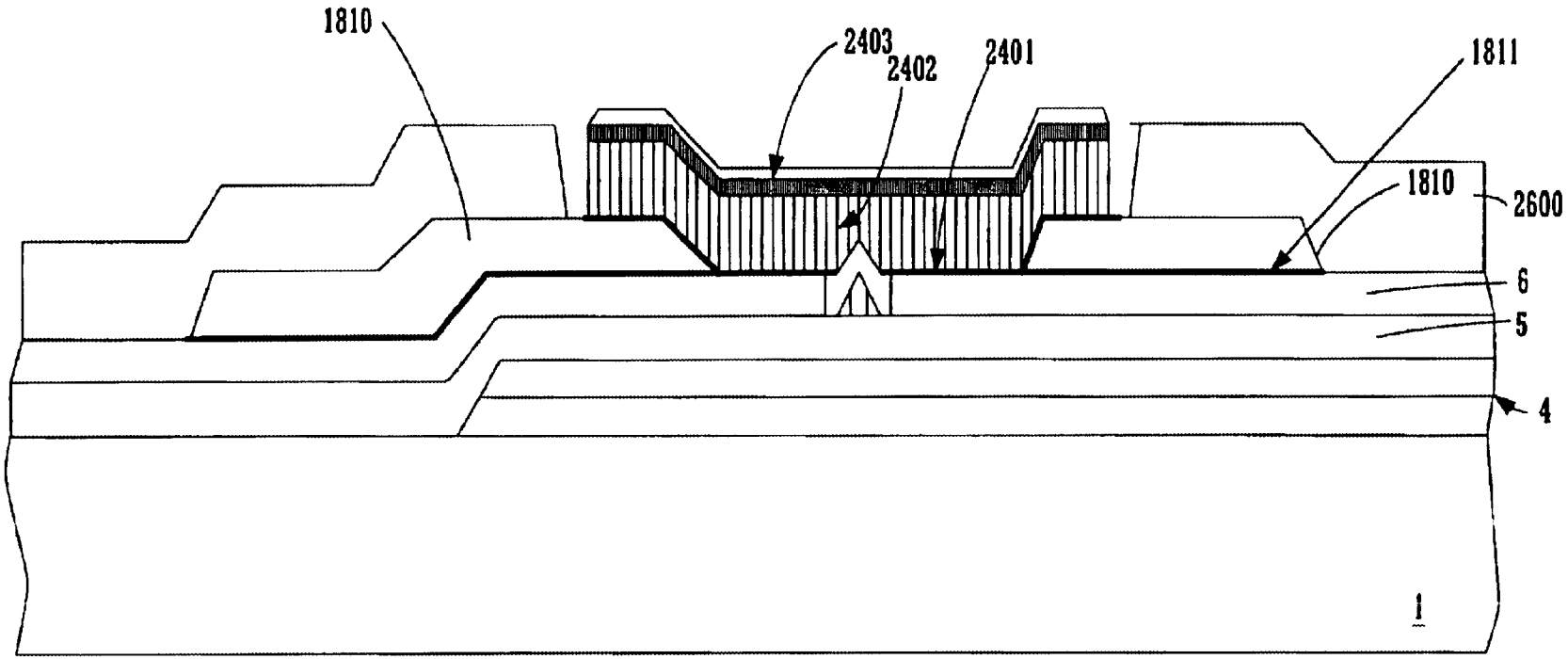
FIG. 26E is a side sectional view of a display device showing the structure of FIG. 26C after mask and etch steps have been performed in accordance with one embodiment of the present claimed invention.
Figure 26F:
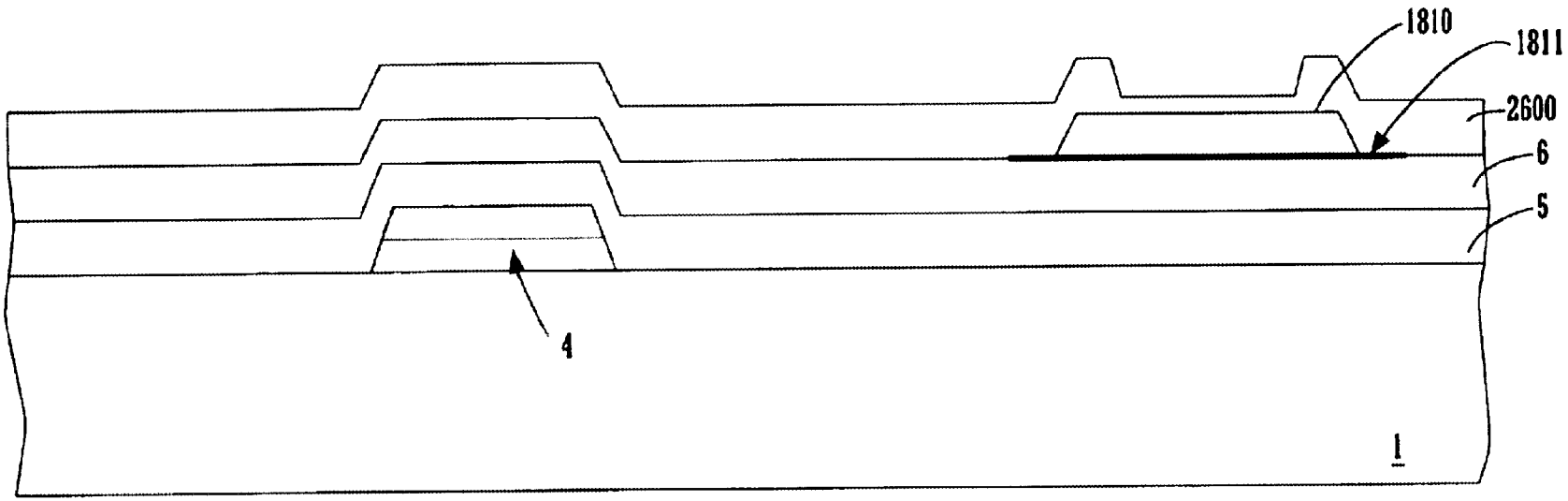
FIG. 26F is a side sectional view of a display device showing the structure of FIG. 26D after mask and etch steps have been performed in accordance with one embodiment of the present claimed invention.

Referring now to FIGS. 26A–26B, a substrate 1 is shown after steps 201–206, 2301–2304, and 2501–2502 of FIG. 25 have formed dielectric layer 2600, molybdenum layer 2401, evaporated molybdenum layer 2402, and sputtered molybdenum layer 2403 such that cone 2426 is formed. Also shown are gate metal layer 1811 and upper electrodes 1810 that overlie dielectric layer 6, resistor layer 5 and lower electrode 4.

Figure 26G:
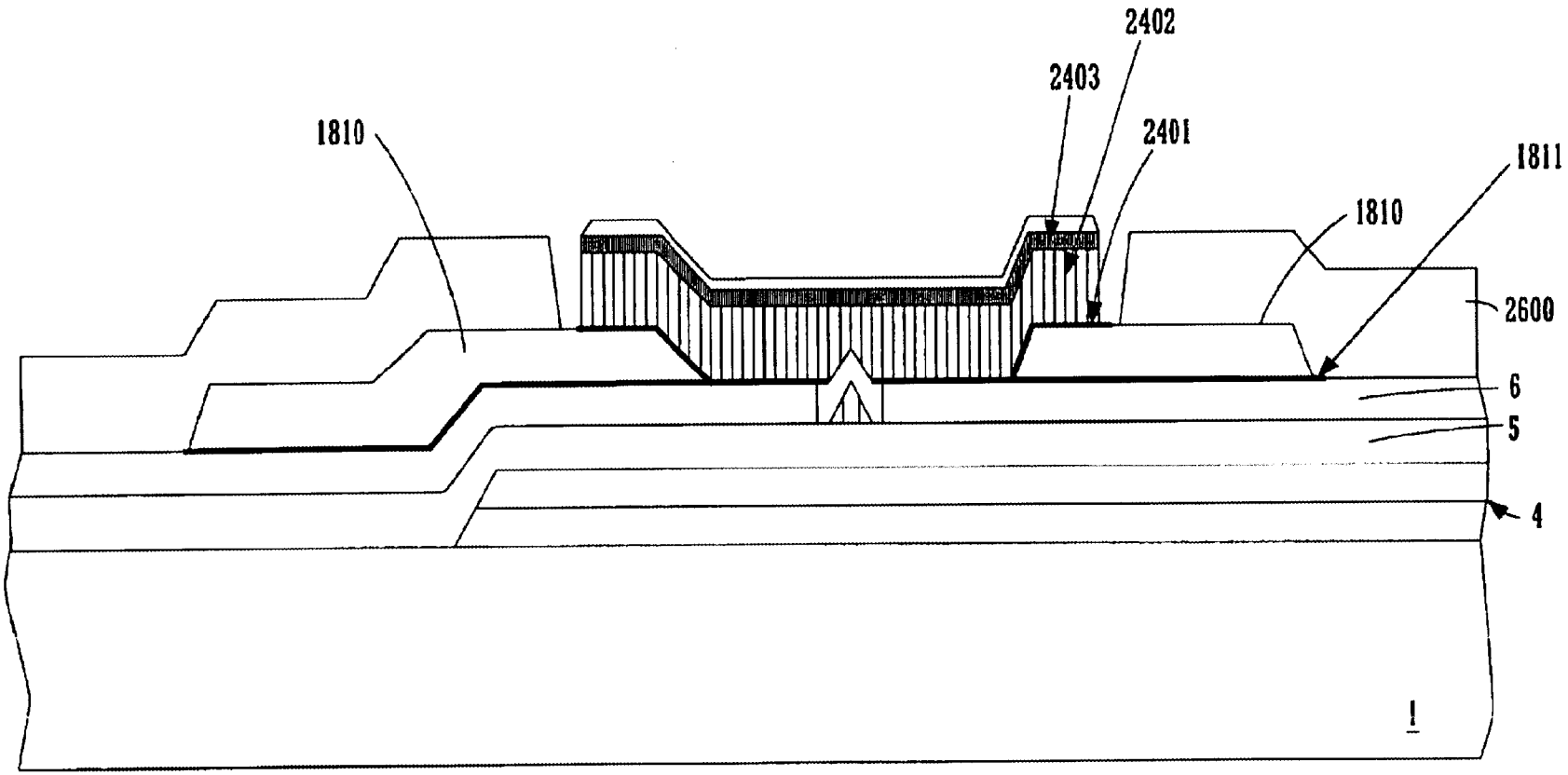
FIG. 26G is a side sectional view of a display device showing the structure of FIG. 26E after mask and etch steps have been performed in accordance with one embodiment of the present claimed invention.
Figure 26H:
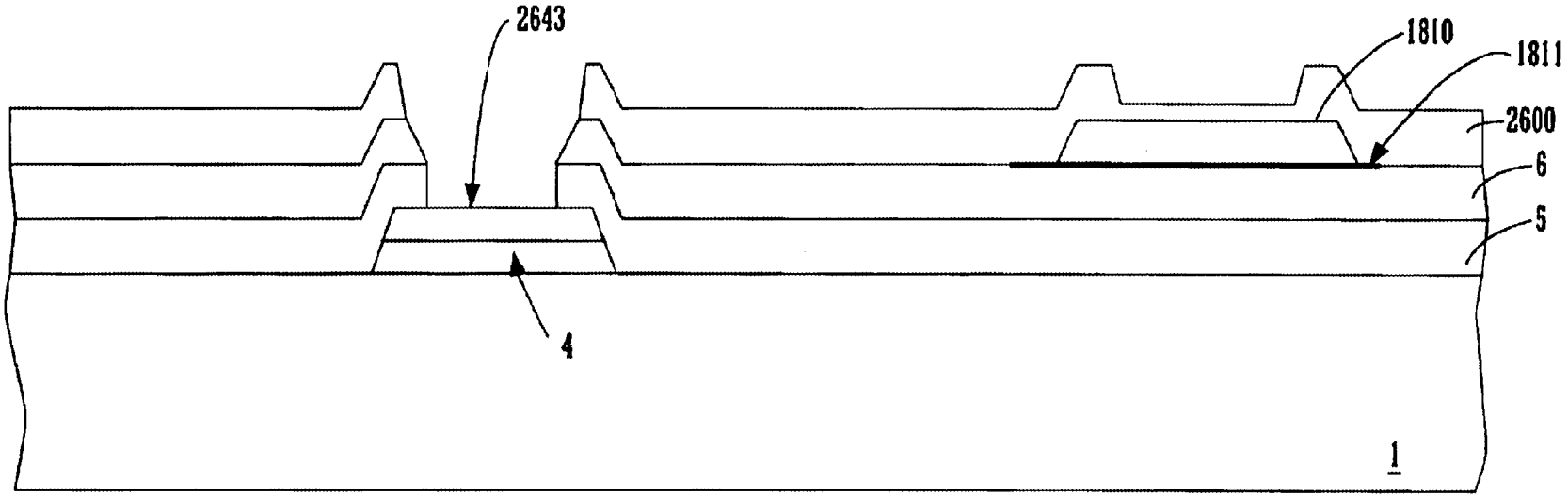
FIG. 26H is a side sectional view of a display device showing the structure of FIG. 26F after mask and etch steps have been performed in accordance with one embodiment of the present claimed invention.

Referring now to step 2503 of FIG. 25, mask and etch steps are performed. In one embodiment, mask and etch step 2503 includes three mask and etch steps, a first mask and etch step that produces the structure shown in FIGS. 26C–26D, a second mask and etch step that produces the structure shown in FIGS. 26E–26F and a third mask and etch step that produces the structure shown in FIGS. 26G–26H. Referring now to FIGS. 26G–26H, the third mask and etch step forms an opening that extends to lower electrode 4, forming contact pad 2643. In the present embodiment, first and second etches are dry etches and the third etch is a wet etch. However, the present invention is well adapted to the use of different mask and etch processes for producing the structure shown in FIGS. 26G–26H.

Figure 26I:
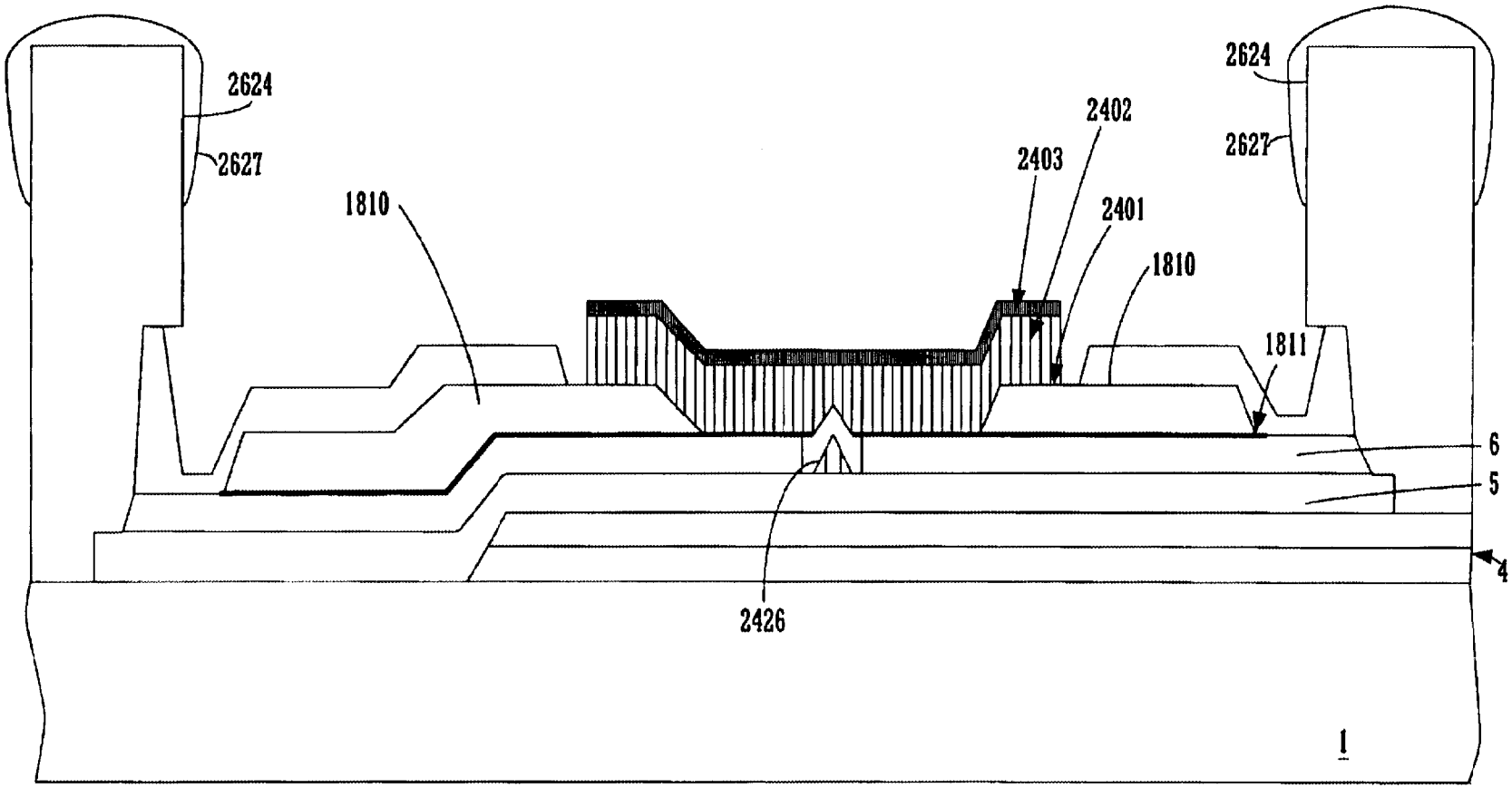
FIG. 26I is a side sectional view of a display device showing the structure of FIG. 26G after mask and etch steps and formation of a focusing structure in accordance with one embodiment of the present claimed invention.
Figure 26J:
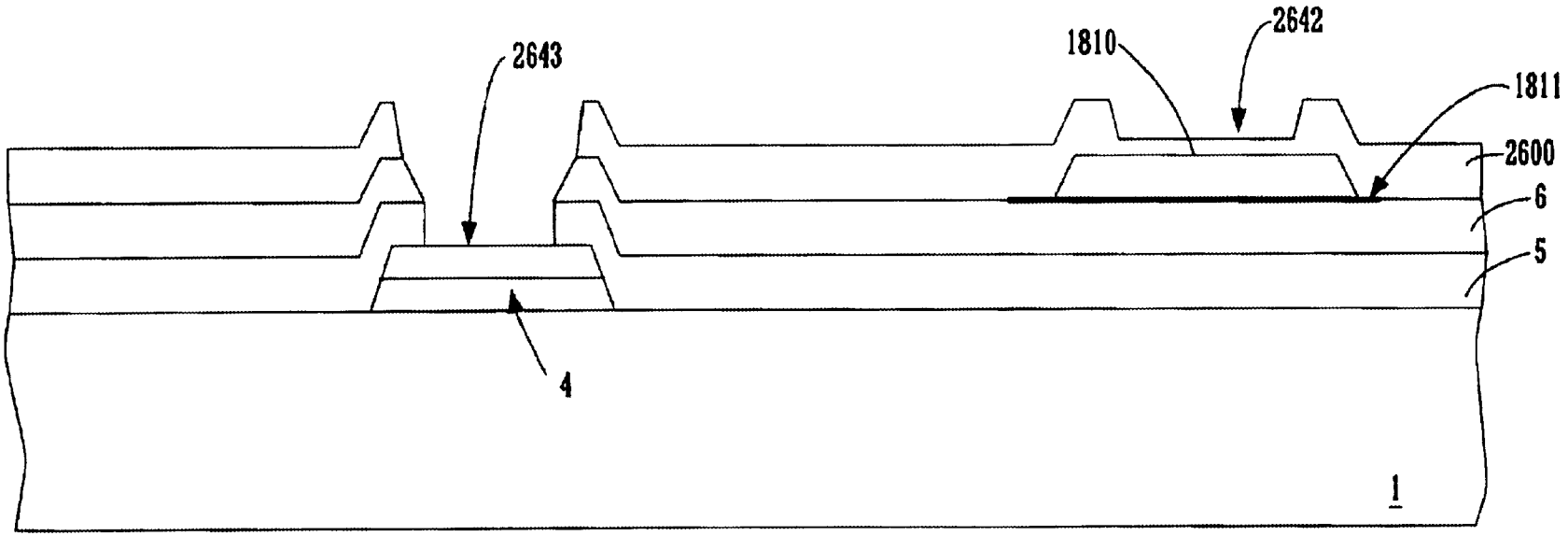
FIG. 26J is a side sectional view of a display device showing the structure of FIG. 26H after mask and etch steps and formation of a focusing structure in accordance with one embodiment of the present claimed invention.

As shown in step 2504, Focusing structures are formed. Referring to FIG. 26I, in the present embodiment, focus waffle metal 2627 is formed over focusing structures 2624. As shown by step 2505 of FIG. 25,an etch step is performed so as to further etch the remaining dielectric layer. In one embodiment, etch step 2504 uses a dry etch process. Referring now to FIGS. 26I–26J, step 2504 forms polyimide structures 2624 while step 2505 forms contact pad 2642.

Figure 26K:
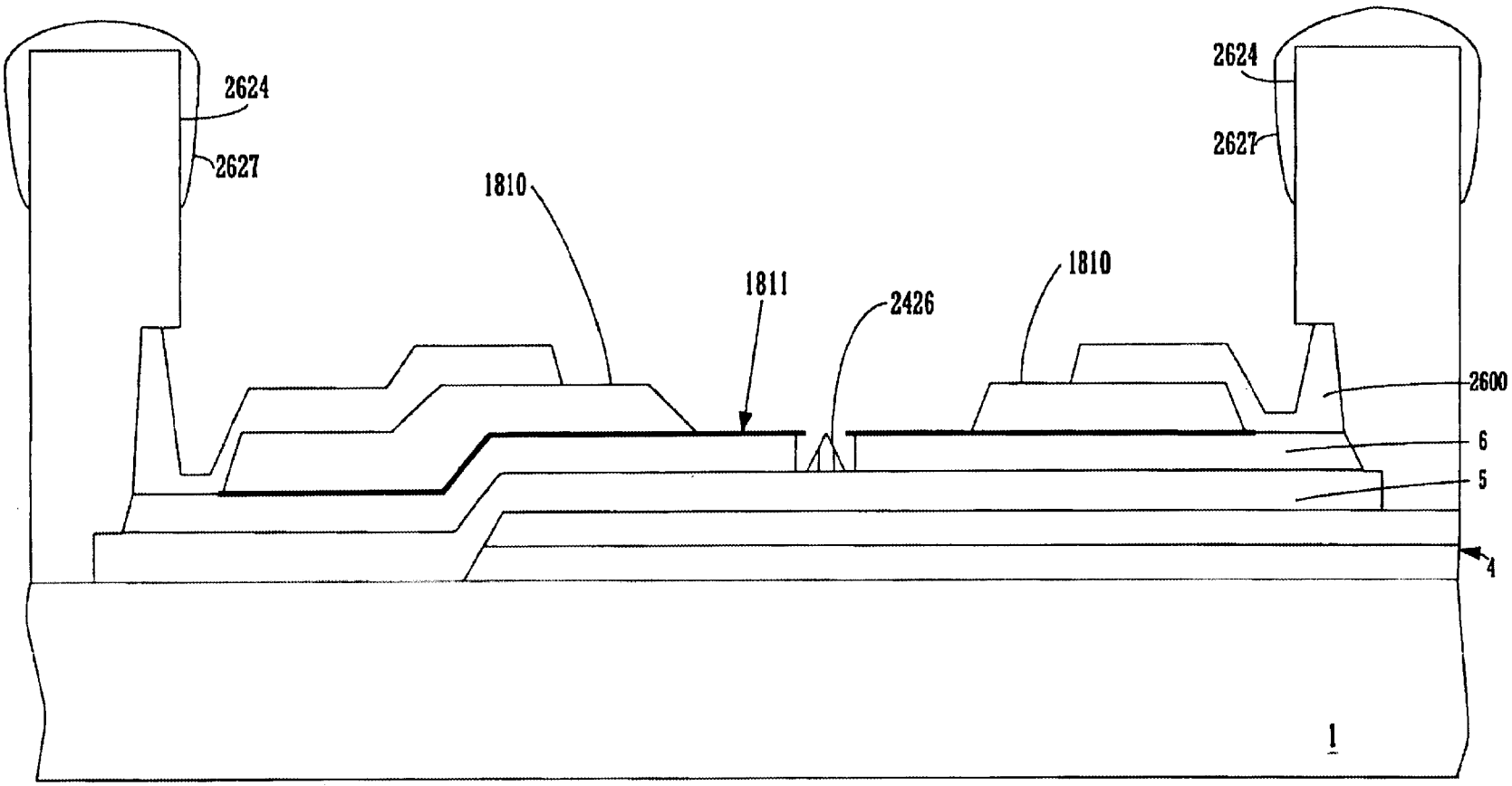
FIG. 26K is a side sectional view of a display device showing the structure of FIG. 26I after mask and etch steps have been performed in accordance with one embodiment of the present claimed invention.
Figure 26L:
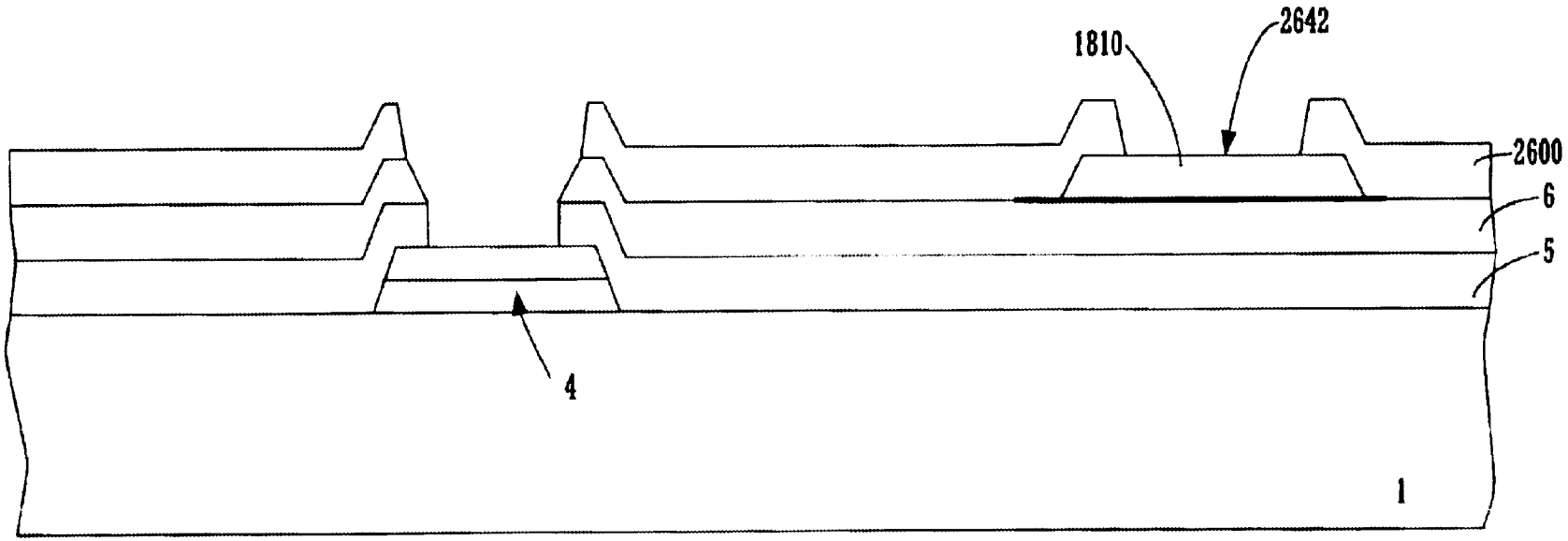
FIG. 26L is a side sectional view of a display device showing the structure of FIG. 26J after mask and etch steps have been performed in accordance with one embodiment of the present claimed invention.

Another etch is then performed as shown by step 2506 to complete the structure. In the present embodiment, as shown in FIGS. 26K–26L, etch step 2506 removes evaporated molybdenum layer 2553 and sputtered molybdenum layers 2552 and 2554.

Upper electrode 1810 is protected by dielectric layer 2600, preventing damage to upper electrode 1810 as typically occurs in prior art processes. By preventing damage to upper electrode 1810, upper electrode shorts and opens are prevented. In addition, because upper electrode 1810 is protected, column shorts in the frit seal region are eliminated. Also, because there is less exposed metal as compared with prior art processes, upper electrode to focus waffle shorts are decreased.

Figure 27:
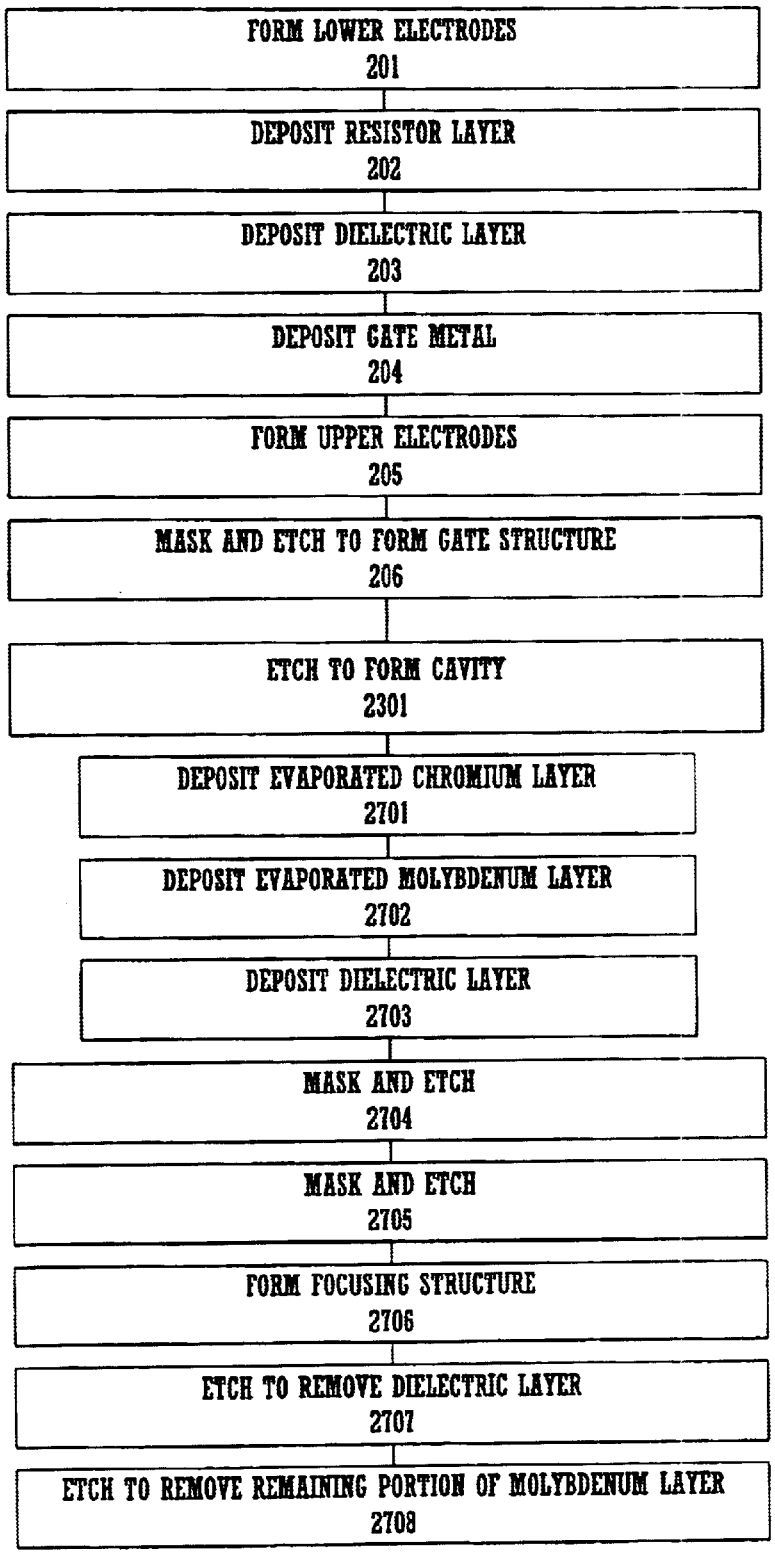
FIG. 27 is a diagram showing a method for forming an electrode structure of a display device in accordance with one embodiment of the present invention.

With reference now to FIGS. 27–28, yet another method for forming an electrode structure for a display device is shown. As shown by step 201 of FIG. 27, lower electrodes are formed over a substrate. A resistor layer and a dielectric layer are then deposited over the lower electrodes as shown by steps 202–203. A gate metal layer is deposited as shown by step 204. Upper electrodes are then formed as shown by step 205. As shown by step 206, mask and etch steps are then performed to form a gate structure. Mask and etch steps are then performed as shown by step 2301 to form a cavity. In one embodiment, steps 201–206 and 2301 are identical to steps 201–206 and 2301 of FIG. 23.

Continuing with FIG. 27, a layer of evaporated chromium is then deposited as shown by step 2701, followed by the deposition of a layer of evaporated molybdenum as shown by step 2702. A dielectric layer is then deposited as shown by step 2703.

Figure 28A:
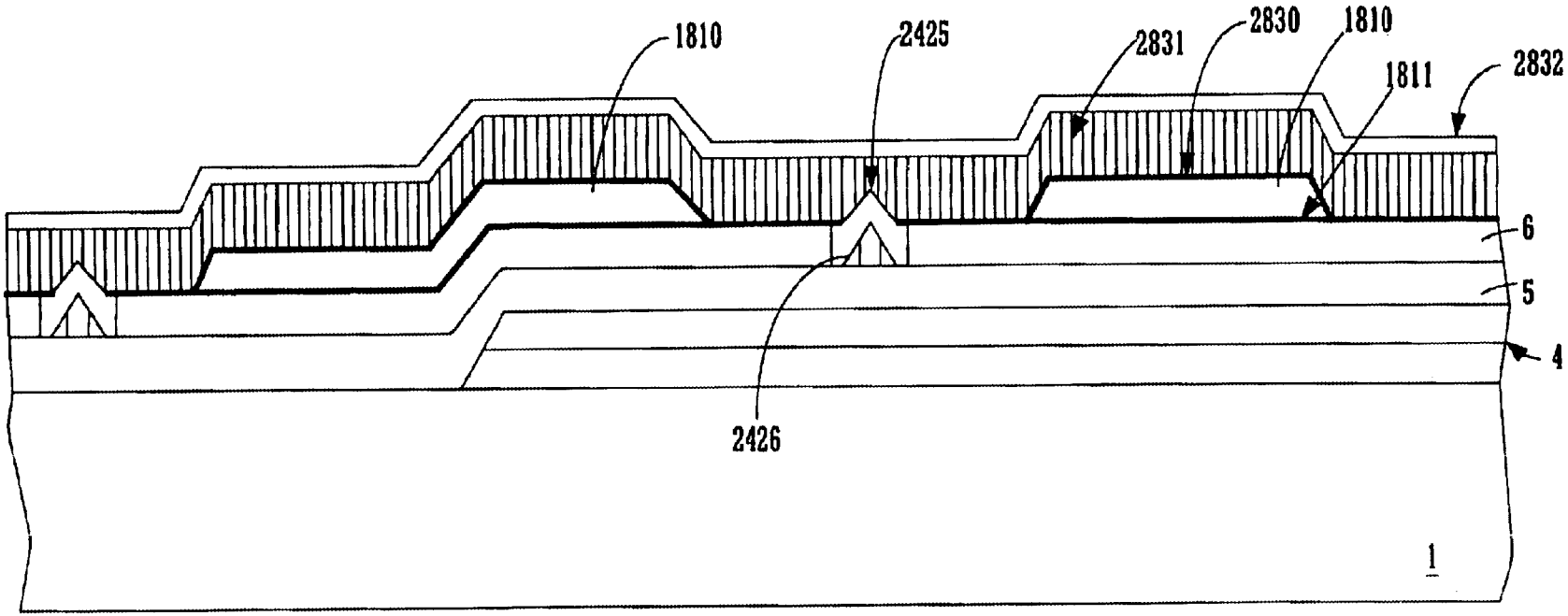
FIG. 28A is a side sectional view of a display device showing a backplate over which lower and upper electrodes are formed and having a resistor layer, a dielectric layer, a gate structure, an evaporated chromium layer, an evaporated molybdenum layer, and a dielectric layer in accordance with one embodiment of the present claimed invention.
Figure 28B:
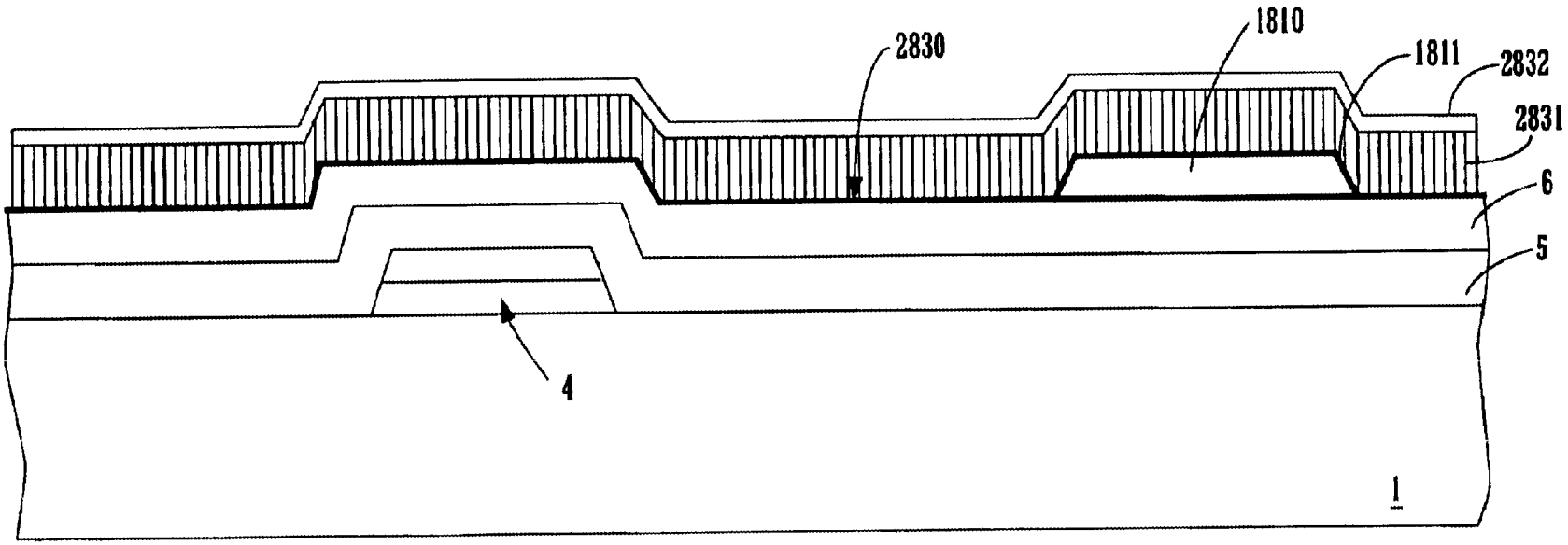
FIG. 28B is a side sectional view of a display device showing a backplate over which lower and upper electrodes are formed and having a resistor layer, a dielectric layer, a gate structure, an evaporated chromium layer, an evaporated molybdenum layer, and a dielectric layer in accordance with one embodiment of the present claimed invention.

Referring to FIGS. 28A–28B, a substrate 1 is shown after steps 201–206 have formed lower electrodes 4, resistor layer 5, dielectric layer 6, gate metal structure 1811 and upper electrodes 1810. Etch step 2301 forms cavity 2425. Steps 2701–2703 result in the formation of evaporated chromium layer 2830, evaporated molybdenum layer 2831, and dielectric layer 2832.

Figure 28C:
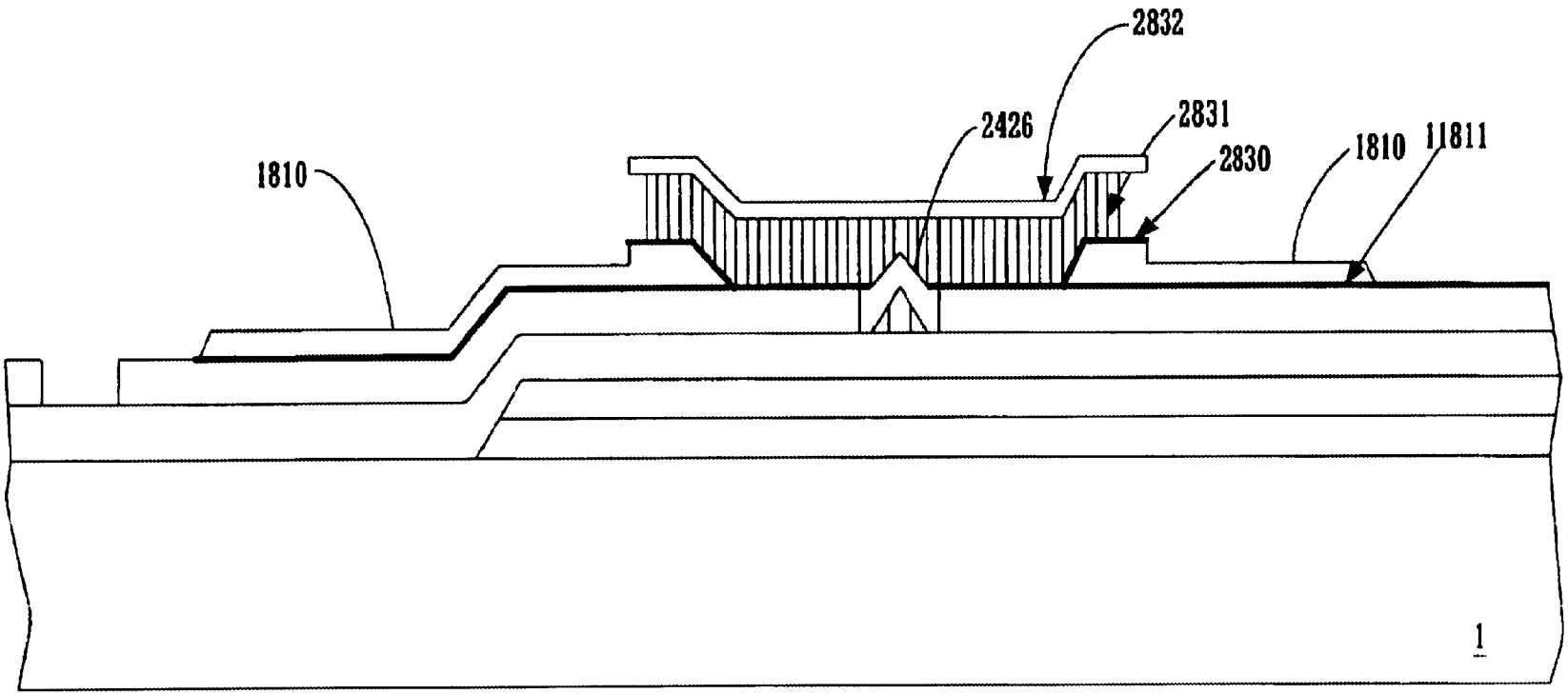
FIG. 28C is a side sectional view of a display device showing the structure of FIG. 28A after mask and etch steps have been performed in accordance with one embodiment of the present claimed invention.
Figure 28D:
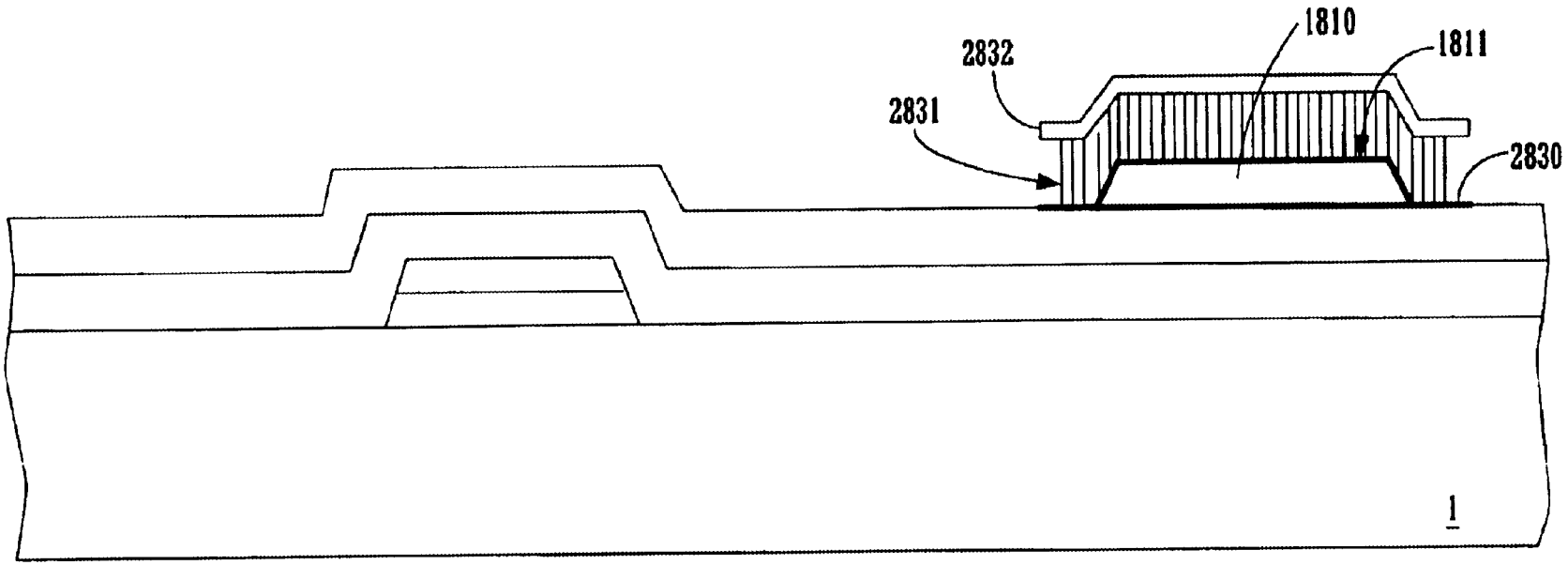
FIG. 28D is a side sectional view of a display device showing the structure of FIG. 28B after mask and etch steps have been performed in accordance with one embodiment of the present claimed invention.

Referring back to FIG. 27, as shown by step 2704, mask and etch steps are then performed. Referring now to FIGS. 28C–28D, step 2704 etches through dielectric layer 2832, molybdenum layer 2831, evaporated chromium layer 2830 and partially etches upper electrodes 1810.

Figure 28E:
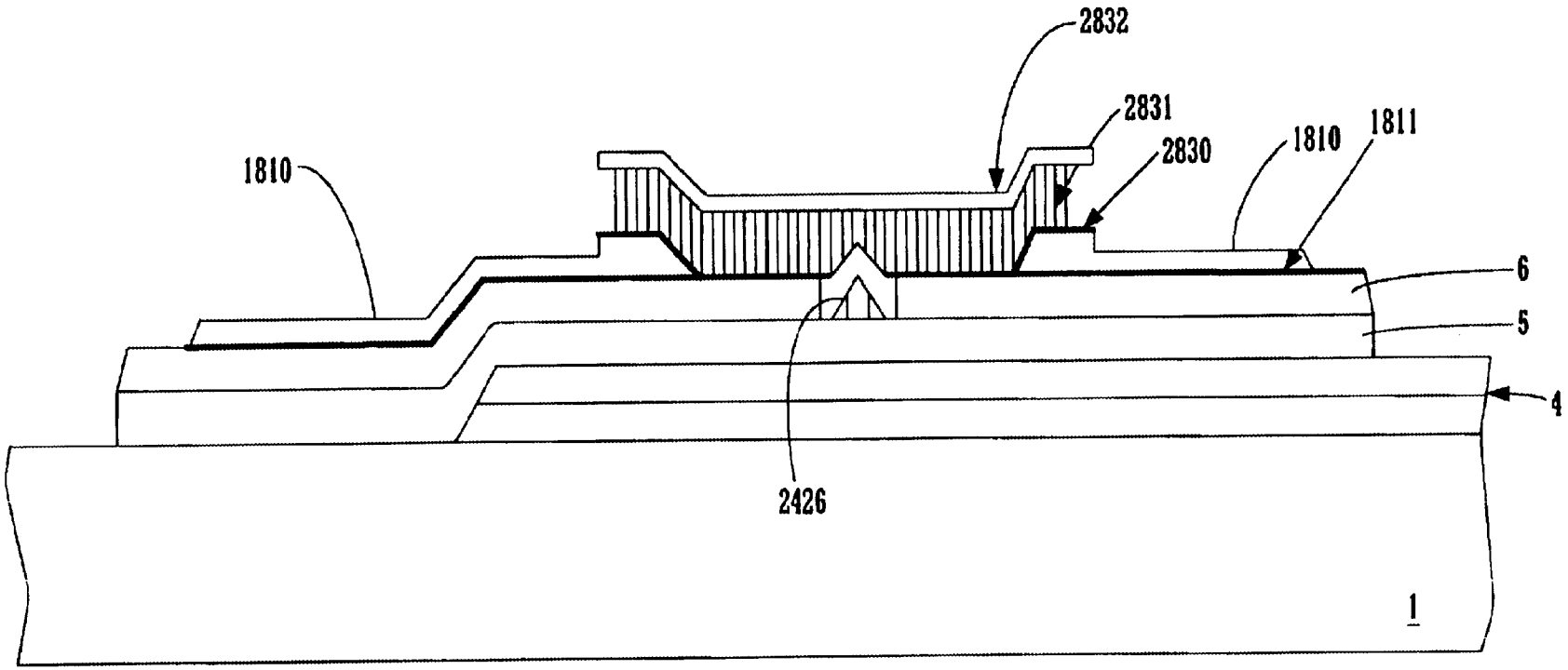
FIG. 28E is a side sectional view of a display device showing the structure of FIG. 28C after mask and etch steps have been performed in accordance with one embodiment of the present claimed invention.
Figure 28F:
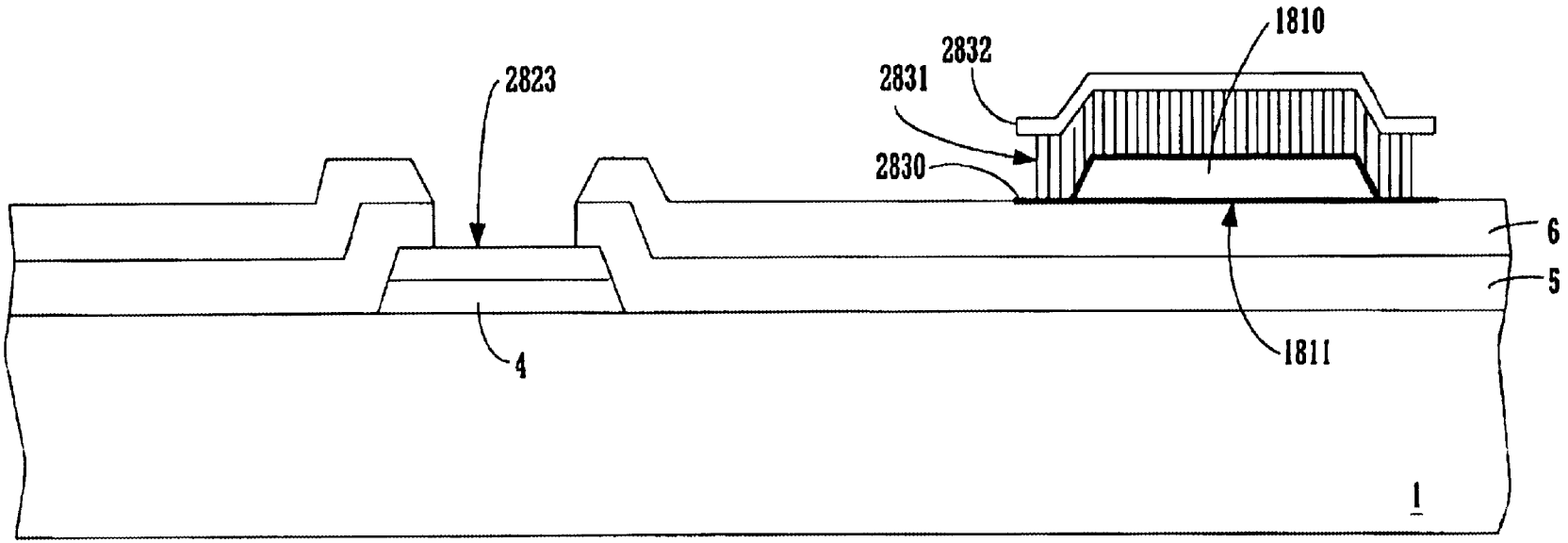
FIG. 28F is a side sectional view of a display device showing the structure of FIG. 28D after mask and etch steps have been performed in accordance with one embodiment of the present claimed invention.

Continuing with FIG. 27, as shown by step 2705, another etch step is performed that etches dielectric layer 6 and resistor layer 5, forming the structure shown in FIGS. 28E–28F. Step 2706 exposes a portion of lower electrode 4 so as to form contact pad 2823.

Figure 28G:
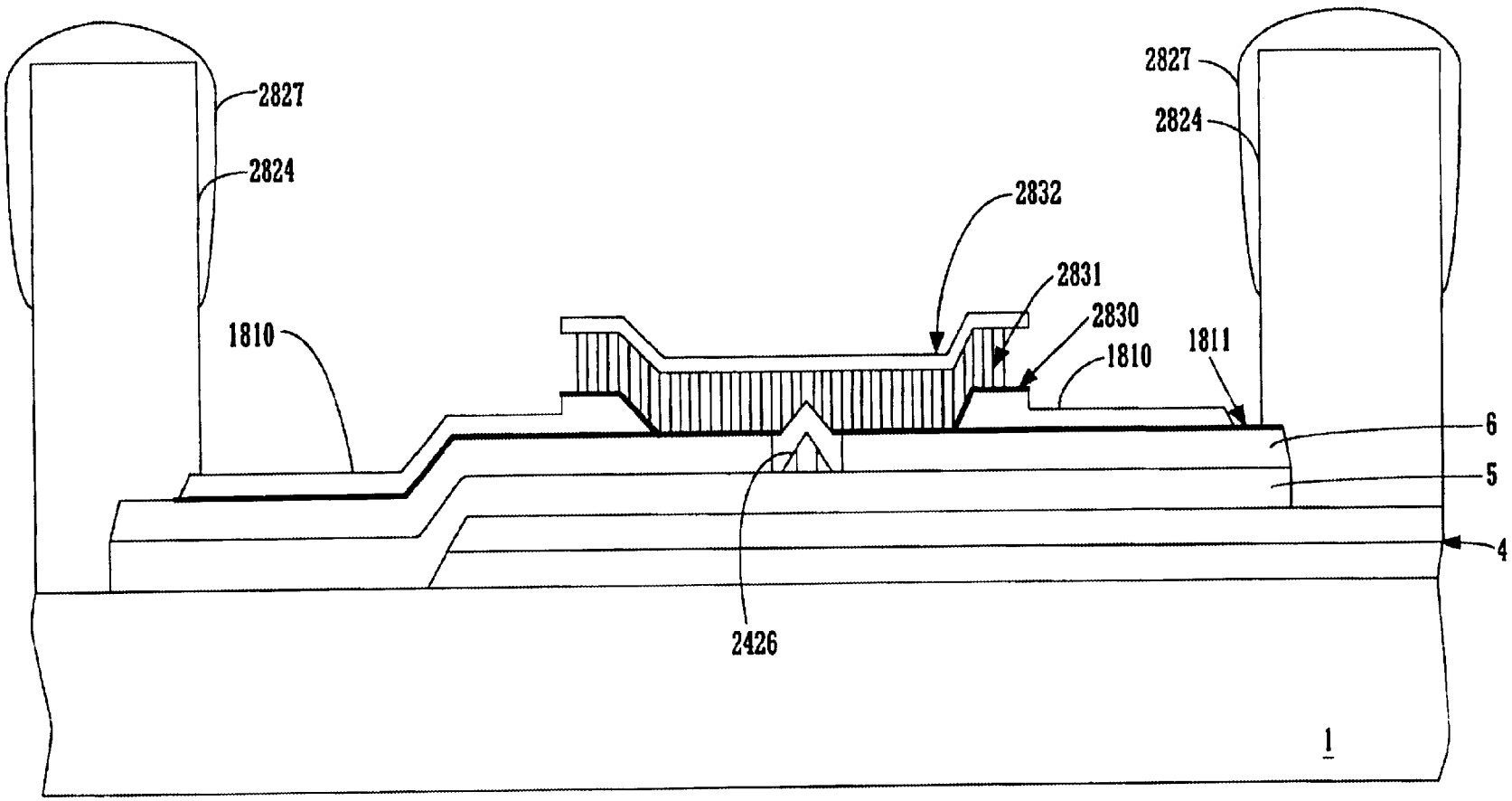
FIG. 28G is a side sectional view of a display device showing the structure of FIG. 28E after focusing structures have been formed in accordance with one embodiment of the present claimed invention.
Figure 28H:
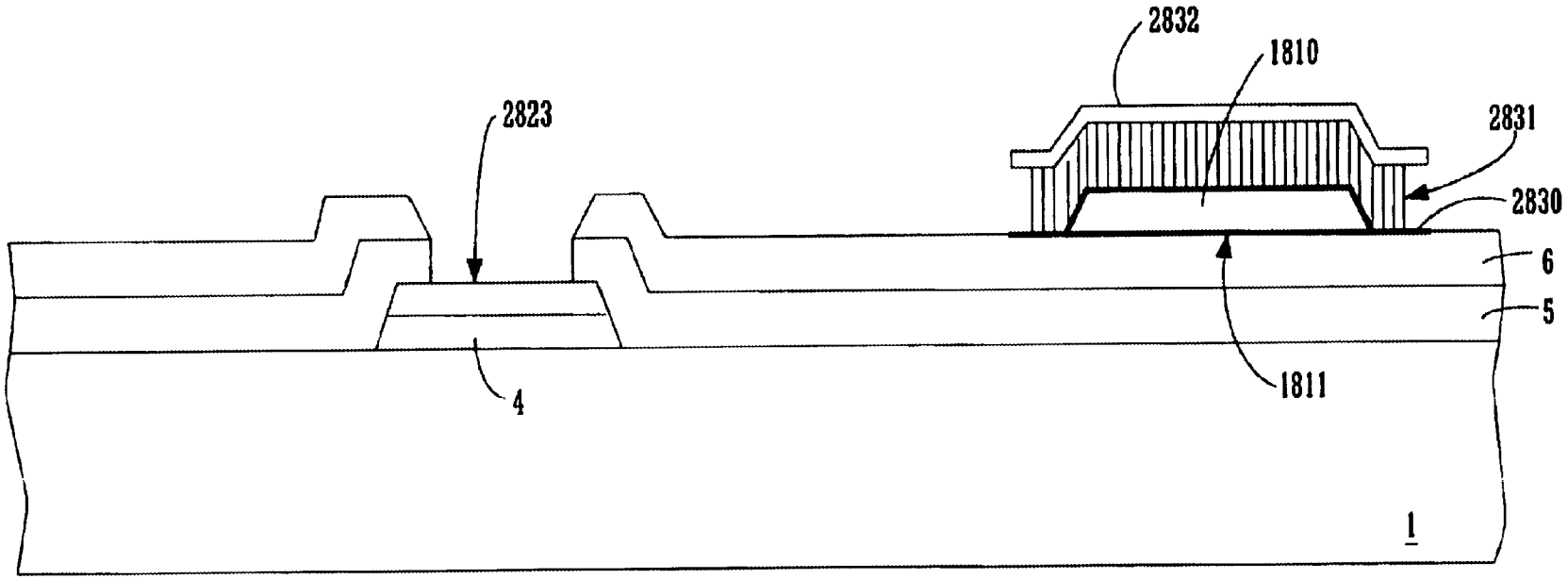
FIG. 28H is a side sectional view of a display device showing the structure of FIG. 28F focusing structures have been formed in accordance with one embodiment of the present claimed invention.

Continuing with FIG. 27, as shown by step 2706, the focusing structure is formed. Referring now to FIGS. 28G–H, focusing structure 2824 is shown to be formed. Referring now to FIG. 28G, in the present embodiment, focus waffle metal 2827 is formed over focusing structures 2824.

Figure 28I:
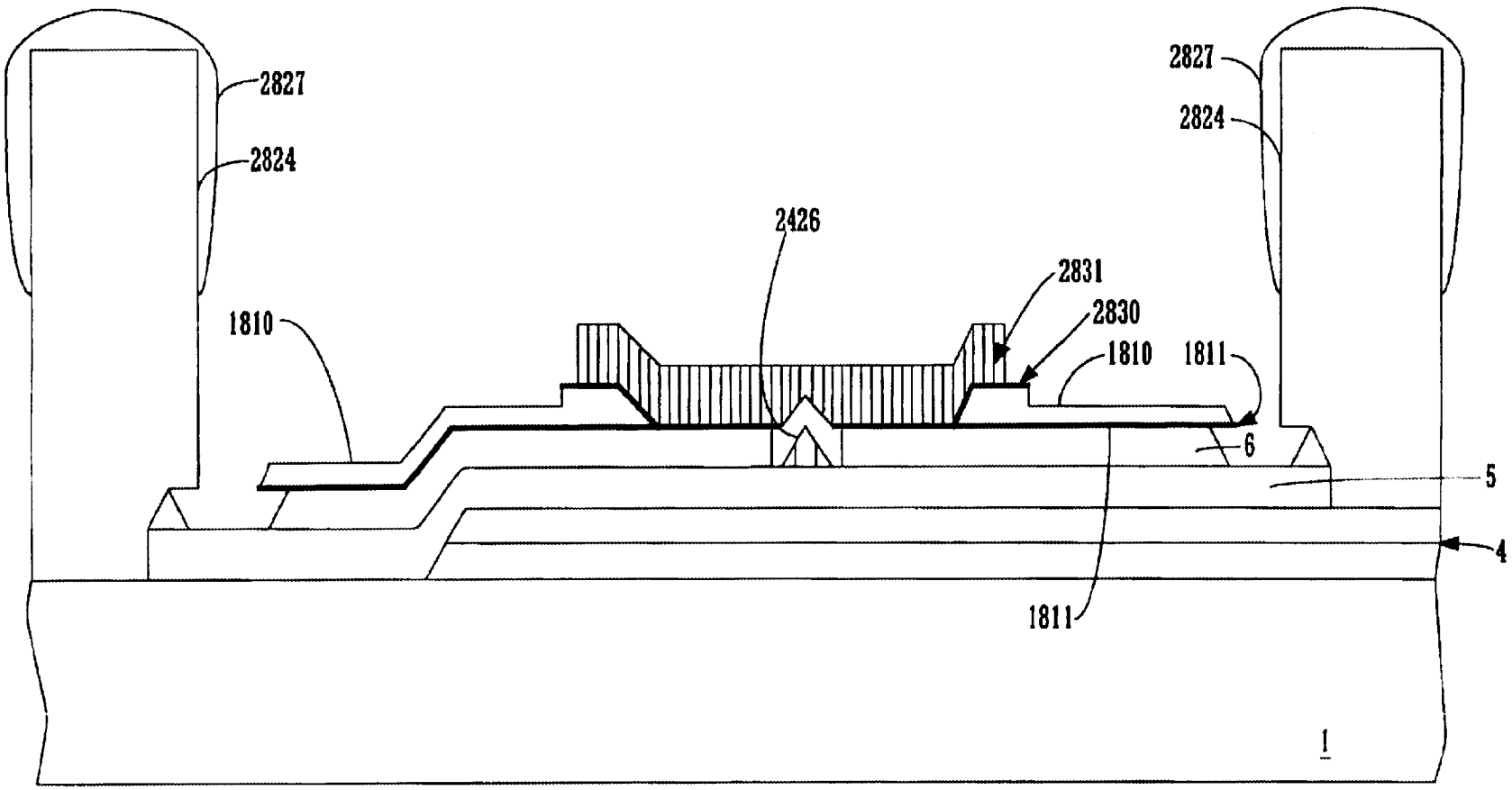
FIG. 28I is a side sectional view of a display device showing the structure of FIG. 28G after an etch step has been performed in accordance with one embodiment of the present claimed invention.
Figure 28J:
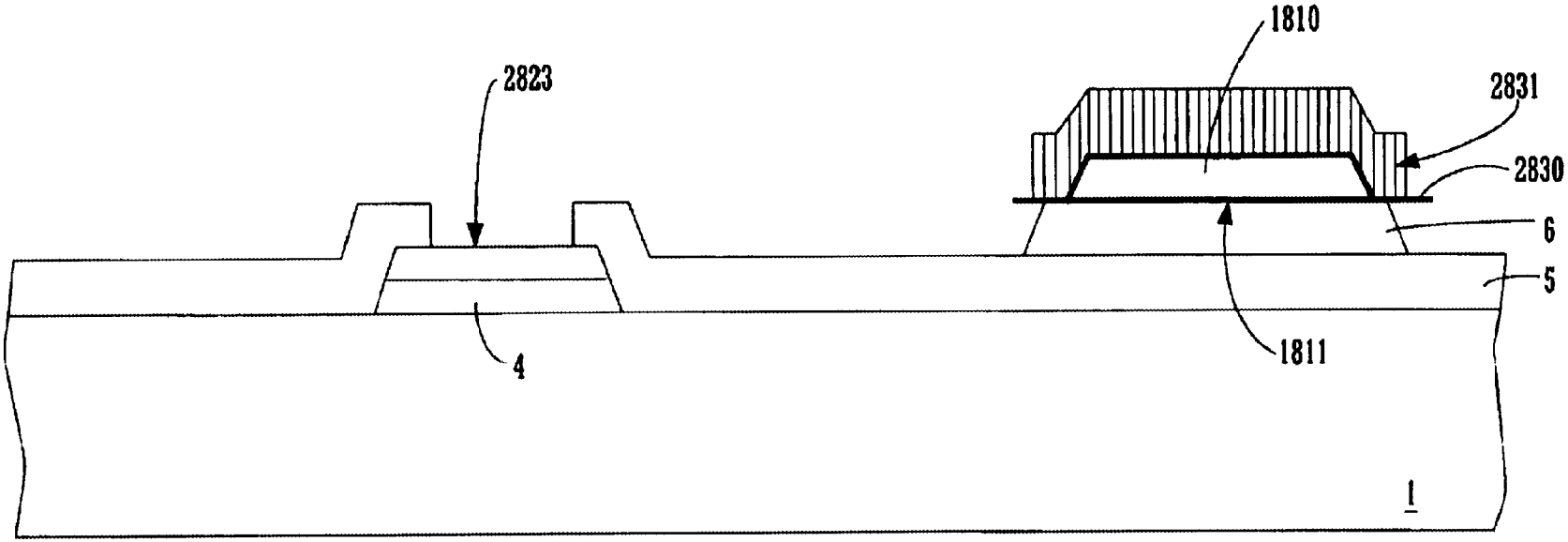
FIG. 28J is a side sectional view of a display device showing the structure of FIG. 28H after an etch step has been performed in accordance with one embodiment of the present claimed invention.

Continuing with FIG. 27, as shown by step 2707, an etch step is performed. Referring now to FIGS. 28I–28J, step 2707 is shown to remove dielectric layer 2832 and to partially remove a portion of dielectric layer 6.

Figure 28K:
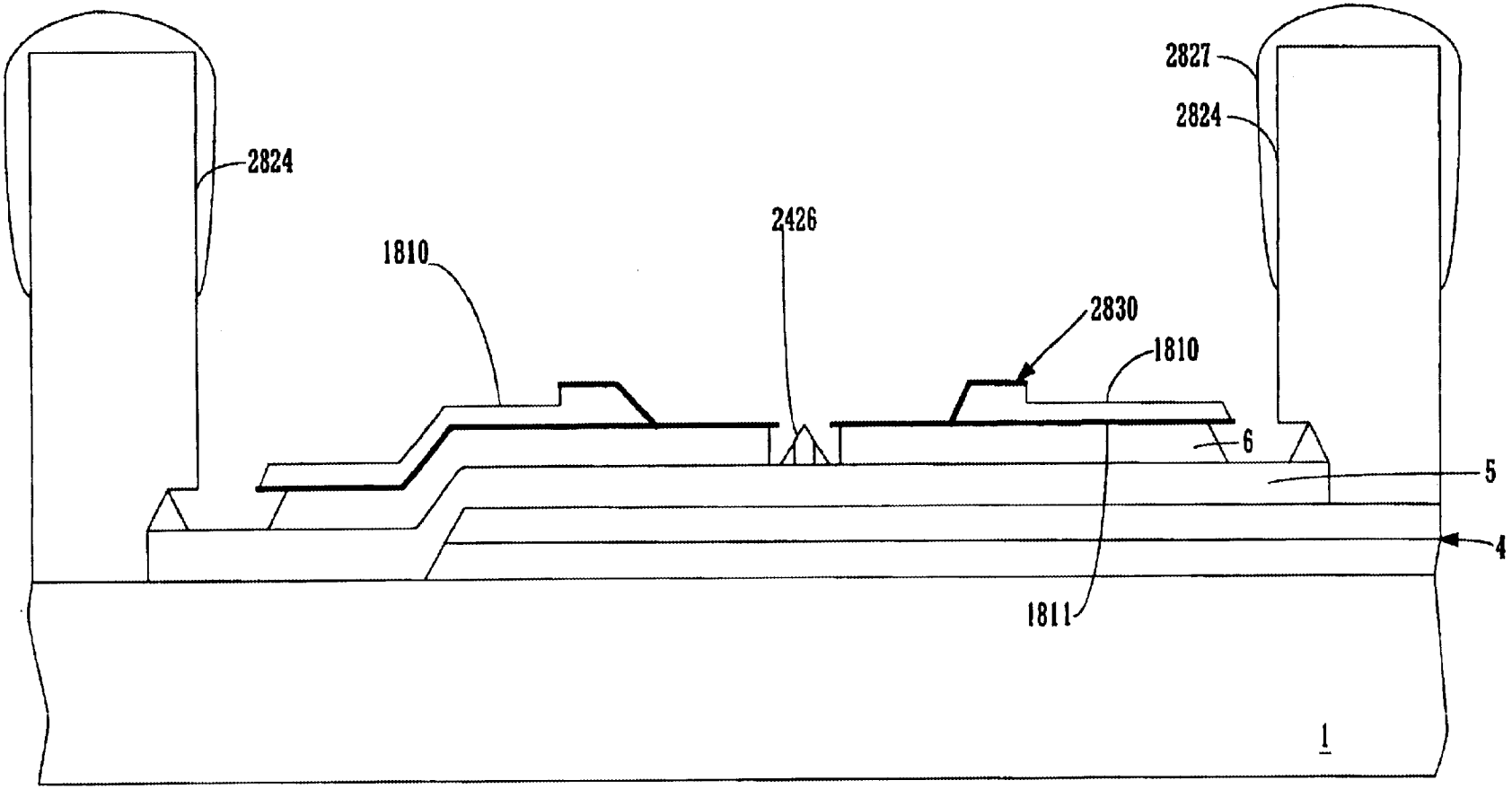
Figure 28L:
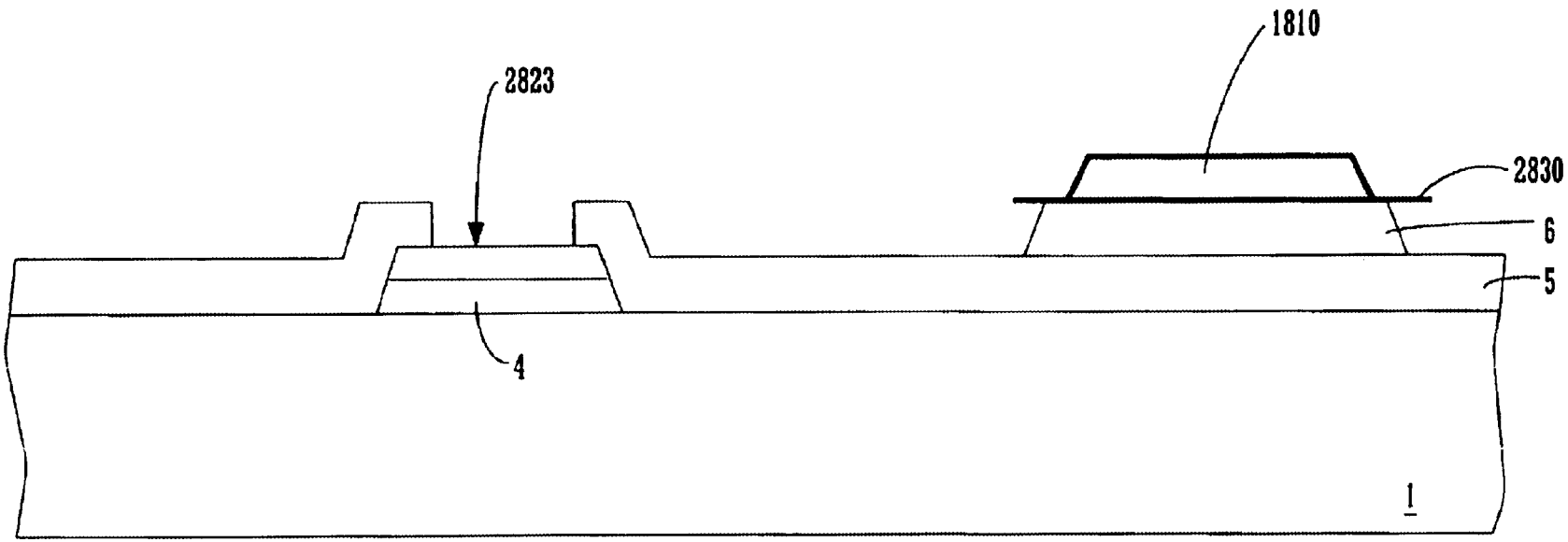

Another etch is then performed as shown by step 2708 to complete the structure. FIGS. 28K–28L show the structure of FIGS. 28I–28J after step 2708 has been performed. In the present embodiment, etch step 2708 removes evaporated molybdenum layer 2831.

During process steps 2704–2708, upper electrode 1810 is protected by evaporated chromium layer 2830. This prevents damage to upper electrode 1810 as typically occurs in prior art processes. By preventing damage to upper electrode 1810, upper electrode shorts and opens are prevented. In addition, because upper electrode 1810 is protected, column shorts in the frit seal region are eliminated. Also, because there is less exposed metal as compared with prior art processes, column to focus waffle shorts are decreased.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications are suited to the particular use contemplated. It is intended that the scope of the invention be defined by the Claims appended hereto and their equivalents.

What is claimed is:

1. An electrode structure for a display device comprising:

a) a plurality of first electrodes;

b) a resistor layer disposed over said plurality of first electrodes;

c) a first dielectric layer comprising a layer of silicon dioxide disposed over said resistor layer;

d) a plurality of second dielectric layer disposed over said plurality of second electrodes;

e) a second dielectric layer disposed over said plurality of second electrodes;

f) an evaporated molybdenum layer disposed over said second dielectric layer; and g) a sputtered molybdenum layer disposed over said evaporated molybdenum layer.

2. The electrode structure described in claim 1, wherein said plurality of first electrodes is disposed over a backplate.

3. The electrode structure described in claim 1, wherein said first electrodes and said second electrodes are formed of an aluminum alloy.

4. The electrode structure described in claim 1, wherein said second dielectric layer comprises a layer of silicon dioxide.

* * * * *